US011591885B2

(12) United States Patent
Eitschberger et al.

(10) Patent No.: US 11,591,885 B2
(45) Date of Patent: Feb. 28, 2023

(54) SELECTIVE UNTETHERED DRONE STRING FOR DOWNHOLE OIL AND GAS WELLBORE OPERATIONS

(71) Applicant: DynaEnergetics Europe GmbH, Troisdorf (DE)

(72) Inventors: Christian Eitschberger, Munich (DE); Andreas Robert Zemla, Much (DE); Liam McNelis, Bonn (DE); Thilo Scharf, Letterkenny (IE); Shmuel Silverman, Novato, CA (US); Arash Shahinpour, Troisdorf (DE); Gernot Uwe Burmeister, Austin, TX (US)

(73) Assignee: DynaEnergetics Europe GmbH, Troisdorf (DE)

( * ) Notice: Subject to any disclaimer, the term of this patent is extended or adjusted under 35 U.S.C. 154(b) by 94 days.

(21) Appl. No.: 17/059,205

(22) PCT Filed: Apr. 12, 2019

(86) PCT No.: PCT/IB2019/000526
§ 371 (c)(1),
(2) Date: Nov. 25, 2020

(87) PCT Pub. No.: WO2019/229520
PCT Pub. Date: Dec. 5, 2019

(65) Prior Publication Data

US 2021/0198983 A1 Jul. 1, 2021

Related U.S. Application Data

(63) Continuation-in-part of application No. PCT/IB2019/000530, filed on Mar. 29, 2019, which
(Continued)

(51) Int. Cl.
*E21B 43/1185* (2006.01)
*E21B 43/117* (2006.01)
*E21B 43/119* (2006.01)

(52) U.S. Cl.
CPC ..... *E21B 43/1185* (2013.01); *E21B 43/117* (2013.01); *E21B 43/119* (2013.01)

(58) Field of Classification Search
CPC .. E21B 43/117; E21B 43/1185; E21B 43/119; E21B 47/017
See application file for complete search history.

(56) References Cited

U.S. PATENT DOCUMENTS 2,216,359 A 10/1940 Spencer
2,358,466 A 9/1944 Miller
(Continued)

FOREIGN PATENT DOCUMENTS

CA 2821506 A1 1/2015
CA 3038451 A1 3/2018
(Continued)

OTHER PUBLICATIONS

US 11,274,530 B2, 03/2022, Eitschberger et al. (withdrawn)
(Continued)

*Primary Examiner* — Abby J Flynn
*Assistant Examiner* — Yanick A Akaragwe
(74) *Attorney, Agent, or Firm* — Moyles IP, LLC

(57) ABSTRACT

According to some embodiments, devices, systems, and methods for autonomously or semi-autonomously conveying downhole oil and gas wellbore tools and performing downhole oil and gas wellbore operations are disclosed. The exemplary devices, systems, and methods may include an untethered drone that substantially disintegrates and/or dissolves into a proppant when shaped charges that the untethered drone carries are detonated. Two or more untethered
(Continued)

drones, wellbore tools, and/or data collection devices may be connected in an untethered drone string and selectively detonated for efficiently performing wellbore operations and reducing the amount of debris left in the wellbore after such operations.

16 Claims, 19 Drawing Sheets

Related U.S. Application Data is a continuation-in-part of application No. PCT/IB2019/000537, filed on Mar. 18, 2019, and a continuation-in-part of application No. 16/272,326, filed on Feb. 11, 2019, now Pat. No. 10,458,213.

(60) Provisional application No. 62/831,215, filed on Apr. 9, 2019, provisional application No. 62/827,468, filed on Apr. 1, 2019, provisional application No. 62/823,737, filed on Mar. 26, 2019, provisional application No. 62/780,427, filed on Dec. 17, 2018, provisional application No. 62/765,185, filed on Aug. 20, 2018, provisional application No. 62/699,484, filed on Jul. 17, 2018, provisional application No. 62/690,314, filed on Jun. 26, 2018, provisional application No. 62/678,636, filed on May 31, 2018.

(56) References Cited

U.S. PATENT DOCUMENTS

| | | | |
|---|---|---|---|
| 2,418,486 | A | 4/1947 | Smylie |
| 2,519,116 | A | 8/1950 | Crake |
| 2,550,004 | A | 4/1951 | Doll |
| 2,621,744 | A | 12/1952 | Toelke |
| 2,696,258 | A | 12/1954 | Greene |
| 2,755,863 | A | 7/1956 | Stansbury et al. |
| 2,873,675 | A | 2/1959 | Lebourg |
| 2,889,775 | A | 6/1959 | Owen |
| 3,155,164 | A | 11/1964 | Keener |
| 3,170,400 | A | 2/1965 | Nelson |
| 3,213,414 | A | 10/1965 | Moser |
| 3,233,674 | A | 2/1966 | Kurt |
| 3,246,707 | A | 4/1966 | Bell |
| 3,374,735 | A | 3/1968 | Moore |
| 3,504,723 | A | 4/1970 | Cushman et al. |
| 3,713,334 | A | 1/1973 | Vann et al. |
| 3,859,921 | A | 1/1975 | Stephenson |
| 4,007,790 | A | 2/1977 | Henning |
| 4,007,796 | A | 2/1977 | Boop |
| 4,058,061 | A | 11/1977 | Mansur, Jr. et al. |
| 4,094,248 | A | 6/1978 | Jacobson |
| 4,140,188 | A | 2/1979 | Vann |
| 4,182,216 | A | 1/1980 | DeCaro |
| 4,266,613 | A | 5/1981 | Boop |
| 4,290,486 | A | 9/1981 | Regalbuto |
| 4,491,185 | A | 1/1985 | McClure |
| 4,496,008 | A | 1/1985 | Pottier et al. |
| 4,523,650 | A | 6/1985 | Sehnert et al. |
| 4,566,544 | A | 1/1986 | Bagley et al. |
| 4,574,892 | A | 3/1986 | Grigar et al. |
| 4,598,775 | A | 7/1986 | Vann et al. |
| 4,619,320 | A | 10/1986 | Adnyana et al. |
| 4,621,396 | A | 11/1986 | Walker et al. |
| 4,657,089 | A | 4/1987 | Stout |
| 4,747,201 | A | 5/1988 | Donovan et al. |
| 4,753,170 | A | 6/1988 | Regalbuto et al. |
| 4,757,479 | A | 7/1988 | Masson et al. |
| 4,776,393 | A | 10/1988 | Forehand et al. |
| 4,790,383 | A | 12/1988 | Savage et al. |
| 4,800,815 | A | 1/1989 | Appledorn et al. |
| 4,808,925 | A | 2/1989 | Baird |
| 4,884,506 | A | 12/1989 | Guerreri |
| 4,889,183 | A | 12/1989 | Sommers et al. |
| 5,027,708 | A | 7/1991 | Gonzalez et al. |
| 5,052,489 | A | 10/1991 | Carisella et al. |
| 5,060,573 | A | 10/1991 | Montgomery et al. |
| 5,088,413 | A | 2/1992 | Huber |
| 5,098,487 | A | 3/1992 | Brauer et al. |
| 5,105,742 | A | 4/1992 | Sumner |
| 5,115,196 | A | 5/1992 | Low et al. |
| 5,159,145 | A | 10/1992 | Carisella et al. |
| 5,322,019 | A | 6/1994 | Hyland |
| 5,366,013 | A | 11/1994 | Edwards et al. |
| 5,383,405 | A | 1/1995 | Everest |
| 5,392,860 | A | 2/1995 | Ross |
| 5,436,791 | A | 7/1995 | Turano et al. |
| 5,603,384 | A | 2/1997 | Bethel et al. |
| 5,703,319 | A | 12/1997 | Fritz et al. |
| 5,775,426 | A | 7/1998 | Snider et al. |
| 5,816,343 | A | 10/1998 | Markel et al. |
| 5,960,894 | A | 10/1999 | Lilly et al. |
| 5,984,006 | A | 11/1999 | Read et al. |
| 5,992,289 | A | 11/1999 | George et al. |
| 6,006,833 | A | 12/1999 | Burleson et al. |
| 6,012,525 | A | 1/2000 | Burleson et al. |
| 6,056,058 | A | 5/2000 | Gonzalez |
| 6,062,310 | A | 5/2000 | Wesson et al. |
| 6,070,662 | A | 6/2000 | Ciglenec et al. |
| 6,112,666 | A | 9/2000 | Murray et al. |
| 6,164,375 | A | 12/2000 | Carisella |
| 6,173,606 | B1 | 1/2001 | Mosley |
| 6,269,875 | B1 | 8/2001 | Harrison, III et al. |
| 6,298,915 | B1 | 10/2001 | George |
| 6,305,287 | B1 | 10/2001 | Capers et al. |
| 6,333,699 | B1 | 12/2001 | Zierolf |
| 6,354,374 | B1 | 3/2002 | Edwards et al. |
| 6,412,573 | B2 | 7/2002 | Vaynshteyn |
| 6,414,905 | B1 | 7/2002 | Owens et al. |
| 6,418,853 | B1 | 7/2002 | Duguet et al. |
| 6,464,011 | B2 | 10/2002 | Tubel |
| 6,467,387 | B1 | 10/2002 | Espinosa et al. |
| 6,584,406 | B1 | 6/2003 | Harmon et al. |
| 6,588,267 | B1 | 7/2003 | Bradley |
| 6,651,747 | B2 | 11/2003 | Chen et al. |
| 6,688,231 | B1 | 2/2004 | Herrmann |
| 6,739,265 | B1 | 5/2004 | Badger et al. |
| 6,742,602 | B2 | 6/2004 | Trotechaud |
| 6,752,083 | B1 | 6/2004 | Lerche et al. |
| 6,763,883 | B2 | 7/2004 | Green et al. |
| 6,779,605 | B2 | 8/2004 | Jackson |
| 6,820,693 | B2 | 11/2004 | Hales et al. |
| 6,837,310 | B2 | 1/2005 | Martin |
| 6,843,317 | B2 | 1/2005 | Mackenzie |
| 6,966,262 | B2 | 11/2005 | Jennings, III |
| 6,988,449 | B2 | 1/2006 | Teowee et al. |
| 7,082,877 | B2 | 8/2006 | Jennings, III |
| 7,147,068 | B2 | 12/2006 | Vail, III |
| 7,193,527 | B2 | 3/2007 | Hall |
| 7,217,917 | B1 | 5/2007 | Tumlin et al. |
| 7,322,416 | B2 | 1/2008 | Burris, II et al. |
| 7,331,394 | B2 | 2/2008 | Edwards et al. |
| 7,363,967 | B2 | 4/2008 | Burris et al. |
| 7,387,162 | B2 | 6/2008 | Mooney, Jr. et al. |
| 7,393,423 | B2 | 7/2008 | Liu |
| 7,510,017 | B2 | 3/2009 | Howell et al. |
| 7,568,429 | B2 | 8/2009 | Hummel et al. |
| 7,591,318 | B2 | 9/2009 | Tilghman |
| 7,617,775 | B2 | 11/2009 | Teowee |
| 7,681,500 | B2 | 3/2010 | Teowee |
| 7,762,172 | B2 | 7/2010 | Li et al. |
| 7,775,273 | B2 | 8/2010 | Merlau et al. |
| 7,778,006 | B2 | 8/2010 | Stewart et al. |
| 7,810,430 | B2 | 10/2010 | Chan et al. |
| 7,819,064 | B2 | 10/2010 | Saenger et al. |
| 7,870,825 | B2 | 1/2011 | Teowee |
| 7,908,970 | B1 | 3/2011 | Jakaboski et al. |
| 7,913,603 | B2 | 3/2011 | LaGrange et al. |
| 7,929,270 | B2 | 4/2011 | Hummel et al. |
| 7,980,309 | B2 | 7/2011 | Crawford |
| 8,066,083 | B2 | 11/2011 | Hales et al. |
| 8,069,789 | B2 | 12/2011 | Hummel et al. |

(56) References Cited

U.S. PATENT DOCUMENTS 8,074,713 B2 12/2011 Ramos et al.
8,091,477 B2 1/2012 Brooks et al.
8,157,022 B2 4/2012 Bertoja et al.
8,165,714 B2 4/2012 Mier et al.
8,167,044 B2 5/2012 Huang et al.
8,181,718 B2 5/2012 Burleson et al.
8,182,212 B2 5/2012 Parcell
8,186,259 B2 5/2012 Burleson et al.
8,240,251 B2 8/2012 Waddell et al.
8,256,337 B2 9/2012 Hill
8,336,437 B2 12/2012 Barlow et al.
8,395,878 B2 3/2013 Stewart et al.
8,451,137 B2 5/2013 Bonavides et al.
8,505,632 B2 8/2013 Guerrero et al.
8,576,090 B2 11/2013 Lerche et al.
8,646,520 B2 2/2014 Chen
8,661,978 B2 3/2014 Backhus et al.
8,695,506 B2 4/2014 Lanclos
8,810,247 B2 8/2014 Kuckes
8,863,665 B2 10/2014 DeVries et al.
8,875,787 B2 11/2014 Tassaroli
8,881,816 B2 11/2014 Glenn et al.
8,884,778 B2 11/2014 Lerche et al.
8,899,322 B2 12/2014 Cresswell et al.
8,950,480 B1 2/2015 Strickland
8,981,957 B2 3/2015 Gano et al.
8,991,489 B2 3/2015 Redlinger et al.
9,045,692 B2 6/2015 Lumley
9,062,539 B2 6/2015 Schmidt et al.
9,080,433 B2 7/2015 Lanclos et al.
9,181,790 B2 11/2015 Mace et al.
9,194,219 B1 11/2015 Hardesty et al.
9,267,346 B2 2/2016 Robertson et al.
9,284,168 B2 3/2016 Mau et al.
9,284,819 B2 3/2016 Tolman et al.
9,317,038 B2 4/2016 Ozick et al.
9,328,577 B2 5/2016 Hallundbaek et al.
9,359,884 B2 6/2016 Hallundbaek et al.
9,441,470 B2 9/2016 Guerrero et al.
9,464,508 B2 10/2016 Lerche et al.
9,476,289 B2 10/2016 Wells
9,494,021 B2 11/2016 Parks et al.
9,518,454 B2 12/2016 Current et al.
9,556,676 B2 1/2017 Konduc et al.
9,556,725 B2 1/2017 Fripp et al.
9,581,422 B2 2/2017 Preiss et al.
9,593,548 B2 3/2017 Hill et al.
9,598,942 B2 3/2017 Wells et al.
9,605,937 B2 3/2017 Eitschberger et al.
9,617,194 B2 4/2017 Glenn
9,617,814 B2 4/2017 Seals et al.
9,617,829 B2 4/2017 Dale et al.
9,677,363 B2 6/2017 Schacherer et al.
9,683,821 B2 6/2017 Stecher et al.
9,726,005 B2 8/2017 Hallundbaek et al.
9,732,561 B2 8/2017 Carter, Jr.
9,784,549 B2 10/2017 Eitschberger
9,797,238 B2 10/2017 Frosell et al.
9,835,428 B2 12/2017 Mace et al.
9,896,920 B2 2/2018 Holder
9,903,192 B2 2/2018 Entchev et al.
9,921,038 B2 3/2018 Weinhold
9,963,955 B2 5/2018 Tolman et al.
10,001,007 B2 6/2018 Pelletier et al.
10,053,968 B2 8/2018 Tolman et al.
10,066,921 B2 9/2018 Eitschberger
10,077,641 B2 9/2018 Rogman et al.
10,119,358 B2 11/2018 Walton et al.
10,138,691 B2 11/2018 Kos et al.
10,138,713 B2 11/2018 Tolman et al.
10,151,180 B2 12/2018 Robey et al.
10,167,534 B2 1/2019 Fripp et al.
10,190,398 B2 1/2019 Goodman et al.
10,196,868 B2 2/2019 Layden
10,287,873 B2 5/2019 Filas et al.
10,301,910 B2 5/2019 Whitsitt et al.
10,337,310 B2 7/2019 Bell et al.
10,352,144 B2 7/2019 Entchev et al.
10,458,213 B1 10/2019 Eitschberger et al.
10,598,002 B2 3/2020 Sites
10,605,037 B2 3/2020 Eitschberger et al.
10,689,955 B1 6/2020 Mauldin et al.
10,704,867 B2 7/2020 Church et al.
10,794,122 B2 10/2020 Kitchen et al.
10,794,159 B2 10/2020 Eitschberger et al.
10,844,684 B2 11/2020 Eitschberger
10,927,650 B2 * 2/2021 Schultz ..... E21B 23/08
10,982,513 B2 4/2021 Gupta et al.
11,002,118 B2 5/2021 Hinton et al.
11,021,923 B2 6/2021 Mulhern et al.
11,136,866 B2 10/2021 Holodnak et al.
11,286,756 B2 3/2022 Harrigan et al.
11,306,547 B2 4/2022 Thomas
11,306,556 B2 4/2022 Price
11,339,632 B2 5/2022 Eitschberger et al.
2002/0020320 A1 2/2002 Lebaudy et al.
2002/0040783 A1 4/2002 Zimmerman et al.
2002/0062991 A1 5/2002 Farrant et al.
2002/0145423 A1 10/2002 Yoo
2003/0000411 A1 1/2003 Cernocky et al.
2003/0001753 A1 1/2003 Cernocky et al.
2004/0094305 A1 5/2004 Skjærseth et al.
2004/0216632 A1 11/2004 Finsterwald
2004/0216823 A1 11/2004 Dahlberg et al.
2004/0239521 A1 12/2004 Zierolf
2005/0011645 A1 1/2005 Aronstam et al.
2005/0167101 A1 8/2005 Sugiyama
2005/0178282 A1 8/2005 Brooks et al.
2005/0194146 A1 9/2005 Barker et al.
2005/0217844 A1 10/2005 Edwards et al.
2005/0229805 A1 10/2005 Myers, Jr. et al.
2005/0241824 A1 11/2005 Burris et al.
2005/0241825 A1 11/2005 Burris et al.
2005/0241835 A1 11/2005 Burris et al.
2005/0269083 A1 12/2005 Burris, II et al.
2007/0084336 A1 4/2007 Neves
2007/0101889 A1 5/2007 Bayliss et al.
2007/0119327 A1 * 5/2007 Myers ..... E21B 43/117
102/306
2007/0125540 A1 6/2007 Gerez et al.
2008/0047456 A1 2/2008 Li et al.
2008/0110612 A1 5/2008 Prinz et al.
2008/0134922 A1 6/2008 Grattan et al.
2008/0149338 A1 6/2008 Goodman et al.
2008/0173204 A1 7/2008 Anderson et al.
2008/0264639 A1 10/2008 Parrott et al.
2008/0307875 A1 12/2008 Hassan et al.
2009/0050322 A1 2/2009 Hill et al.
2009/0139423 A1 6/2009 Dahlberg
2009/0223668 A1 9/2009 Smart et al.
2009/0301723 A1 12/2009 Gray
2009/0308589 A1 12/2009 Bruins et al.
2010/0000789 A1 1/2010 Barton et al.
2010/0089643 A1 4/2010 Vidal
2010/0163224 A1 7/2010 Strickland
2010/0206064 A1 8/2010 Estes
2010/0230104 A1 9/2010 Nölke et al.
2011/0024116 A1 2/2011 McCann et al.
2012/0085538 A1 4/2012 Guerrero et al.
2012/0199031 A1 8/2012 Lanclos
2012/0199352 A1 8/2012 Lanclos et al.
2012/0226443 A1 9/2012 Cresswell et al.
2012/0241169 A1 9/2012 Hales et al.
2012/0242135 A1 9/2012 Thomson et al.
2012/0247769 A1 10/2012 Schacherer et al.
2012/0247771 A1 * 10/2012 Black ..... E21B 43/1185
166/55
2012/0298361 A1 11/2012 Sampson
2013/0062055 A1 3/2013 Tolman et al.
2013/0112396 A1 5/2013 Splittstoeßer
2013/0118342 A1 5/2013 Tassaroli
2013/0199843 A1 8/2013 Ross
2013/0248174 A1 9/2013 Dale et al.
2014/0000877 A1 1/2014 Robertson et al.

(56) References Cited

U.S. PATENT DOCUMENTS

| | | | |
|---|---|---|---|
| 2014/0076542 | A1 | 3/2014 | Whitsitt et al. |
| 2014/0131035 | A1 | 5/2014 | Entchev et al. |
| 2014/0218207 | A1 | 8/2014 | Gano et al. |
| 2015/0136422 | A1 | 5/2015 | Rodgers |
| 2015/0176386 | A1 | 6/2015 | Castillo et al. |
| 2015/0260496 | A1 | 9/2015 | Backhus et al. |
| 2015/0308208 | A1 | 10/2015 | Capps et al. |
| 2015/0330192 | A1 | 11/2015 | Rogman et al. |
| 2015/0337648 | A1 | 11/2015 | Zippel et al. |
| 2016/0003025 | A1 | 1/2016 | Beekman et al. |
| 2016/0032711 | A1 | 2/2016 | Sheiretov et al. |
| 2016/0040520 | A1* | 2/2016 | Tolman ..... E21B 43/116 166/308.1 |
| 2016/0061572 | A1 | 3/2016 | Eitschberger et al. |
| 2016/0069163 | A1 | 3/2016 | Tolman et al. |
| 2016/0084075 | A1 | 3/2016 | Ingraham et al. |
| 2016/0108722 | A1 | 4/2016 | Whitsitt et al. |
| 2016/0168942 | A1 | 6/2016 | Broome et al. |
| 2016/0168961 | A1 | 6/2016 | Parks et al. |
| 2016/0320769 | A1 | 11/2016 | Deffenbaugh et al. |
| 2016/0333675 | A1 | 11/2016 | Wells et al. |
| 2016/0369620 | A1 | 12/2016 | Pelletier et al. |
| 2017/0030693 | A1 | 2/2017 | Preiss et al. |
| 2017/0044875 | A1 | 2/2017 | Hebebrand et al. |
| 2017/0067303 | A1 | 3/2017 | Thiemann et al. |
| 2017/0138150 | A1 | 5/2017 | Yencho |
| 2017/0145798 | A1 | 5/2017 | Robey et al. |
| 2017/0175488 | A1 | 6/2017 | Lisowski et al. |
| 2017/0211363 | A1 | 7/2017 | Bradley et al. |
| 2017/0211381 | A1 | 7/2017 | Chemali |
| 2017/0226814 | A1 | 8/2017 | Clemens et al. |
| 2017/0241244 | A1 | 8/2017 | Barker et al. |
| 2017/0268326 | A1 | 9/2017 | Tao et al. |
| 2017/0268860 | A1 | 9/2017 | Eitschberger |
| 2017/0314372 | A1 | 11/2017 | Tolman et al. |
| 2017/0314385 | A1 | 11/2017 | Hori et al. |
| 2017/0357021 | A1 | 12/2017 | Valero et al. |
| 2018/0030334 | A1 | 2/2018 | Collier et al. |
| 2018/0100387 | A1 | 4/2018 | Kouchmeshky et al. |
| 2018/0135398 | A1 | 5/2018 | Entchev et al. |
| 2018/0148995 | A1 | 5/2018 | Burky et al. |
| 2018/0156029 | A1 | 6/2018 | Harrison et al. |
| 2018/0171744 | A1 | 6/2018 | Markel et al. |
| 2018/0209251 | A1 | 7/2018 | Robey et al. |
| 2018/0274311 | A1 | 9/2018 | Zsolt |
| 2018/0274342 | A1 | 9/2018 | Sites |
| 2018/0299239 | A1 | 10/2018 | Eitschberger et al. |
| 2018/0305993 | A1 | 10/2018 | Perkins et al. |
| 2018/0318770 | A1 | 11/2018 | Eitschberger et al. |
| 2018/0340412 | A1 | 11/2018 | Singh et al. |
| 2018/0363450 | A1 | 12/2018 | Legendre et al. |
| 2019/0031307 | A1 | 1/2019 | Siersdorfer |
| 2019/0032470 | A1 | 1/2019 | Harrigan |
| 2019/0040722 | A1 | 2/2019 | Yang et al. |
| 2019/0048693 | A1 | 2/2019 | Henke et al. |
| 2019/0049225 | A1 | 2/2019 | Eitschberger |
| 2019/0071963 | A1 | 3/2019 | Sites |
| 2019/0085685 | A1 | 3/2019 | McBride |
| 2019/0195054 | A1 | 6/2019 | Bradley et al. |
| 2019/0211655 | A1 | 7/2019 | Bradley et al. |
| 2019/0218880 | A1 | 7/2019 | Cannon et al. |
| 2019/0284889 | A1 | 9/2019 | LaGrange et al. |
| 2019/0292886 | A1 | 9/2019 | Shahinpour et al. |
| 2019/0292887 | A1 | 9/2019 | Austin, II et al. |
| 2019/0301261 | A1 | 10/2019 | Anthony et al. |
| 2019/0316449 | A1 | 10/2019 | Schultz et al. |
| 2019/0322342 | A1 | 10/2019 | Dabbous et al. |
| 2019/0368301 | A1 | 12/2019 | Eitschberger et al. |
| 2019/0368321 | A1 | 12/2019 | Eitschberger et al. |
| 2019/0368331 | A1 | 12/2019 | Vick, Jr. et al. |
| 2020/0018139 | A1 | 1/2020 | Eitschberger et al. |
| 2020/0063553 | A1 | 2/2020 | Zemla et al. |
| 2020/0088011 | A1 | 3/2020 | Eitschberger et al. |
| 2020/0332618 | A1 | 10/2020 | Eitschberger et al. |
| 2020/0378221 | A1 | 12/2020 | Harrigan et al. |
| 2021/0040809 | A1 | 2/2021 | Eitschberger |
| 2021/0123330 | A1 | 4/2021 | Eitschberger et al. |
| 2021/0198983 | A1 | 7/2021 | Eitschberger et al. |
| 2021/0199002 | A1 | 7/2021 | Zemla et al. |
| 2021/0215039 | A1 | 7/2021 | Scharf et al. |
| 2022/0154560 | A1 | 5/2022 | Eitschberger et al. |
| 2022/0170727 | A1 | 6/2022 | Eitschberger |
| 2022/0178230 | A1 | 6/2022 | Eitschberger et al. |

FOREIGN PATENT DOCUMENTS

| | | | |
|---|---|---|---|
| CA | 3075858 | A1 | 3/2019 |
| CA | 3101558 | A1 | 12/2019 |
| CN | 85107897 | A | 9/1986 |
| CN | 101397890 | A | 4/2009 |
| CN | 101435829 | A | 5/2009 |
| CN | 201546707 | U | 8/2010 |
| CN | 201620848 | U | 11/2010 |
| CN | 102278098 | B | 9/2013 |
| CN | 205577894 | U | 9/2016 |
| CN | 105822223 | B | 3/2017 |
| EP | 822384 | B1 | 10/2001 |
| EP | 1688584 | B1 | 8/2011 |
| EP | 2952675 | A2 | 9/2015 |
| EP | 3568664 | A1 | 11/2019 |
| EP | 3478928 | B1 | 6/2021 |
| FR | 1595508 | A | 6/1970 |
| FR | 2573751 | A1 | 10/1987 |
| GB | 839486 | A | 6/1960 |
| GB | 2383236 | B | 1/2004 |
| GB | 2395970 | A | 6/2004 |
| GB | 2548101 | A | 9/2017 |
| JP | 2006071236 | B | 3/2006 |
| KR | 101346238 | B1 | 1/2014 |
| RU | 7852 | U1 | 10/1998 |
| RU | 2561828 | C2 | 9/2015 |
| RU | 2633904 | C1 | 10/2017 |
| WO | 0159401 | A1 | 8/2001 |
| WO | 2001059401 | A1 | 8/2001 |
| WO | 2009091422 | A2 | 7/2009 |
| WO | 2011051435 | A2 | 5/2011 |
| WO | 2011146866 | A2 | 11/2011 |
| WO | 2011150251 | A1 | 12/2011 |
| WO | 2012006357 | A2 | 1/2012 |
| WO | 2012135101 | A2 | 10/2012 |
| WO | 2012106640 | A3 | 11/2012 |
| WO | 2012149584 | A1 | 11/2012 |
| WO | 2012161854 | A2 | 11/2012 |
| WO | 2014007843 | A1 | 1/2014 |
| WO | 2014046670 | A1 | 3/2014 |
| WO | 2014089194 | A1 | 6/2014 |
| WO | 2014193397 | A1 | 12/2014 |
| WO | 2015006869 | A1 | 1/2015 |
| WO | 2015028204 | A2 | 3/2015 |
| WO | 2015028204 | A3 | 3/2015 |
| WO | 2015134719 | A1 | 9/2015 |
| WO | 2015196095 | A1 | 12/2015 |
| WO | 2016100064 | A1 | 6/2016 |
| WO | 2016145420 | A1 | 9/2016 |
| WO | 2017147329 | A1 | 8/2017 |
| WO | 2018009223 | A1 | 1/2018 |
| WO | 2018026952 | A1 | 2/2018 |
| WO | 2018067598 | A1 | 4/2018 |
| WO | 2018182565 | A1 | 10/2018 |
| WO | 2019098991 | A1 | 5/2019 |
| WO | 2019180462 | A1 | 9/2019 |
| WO | 2020254099 | A1 | 12/2020 |

OTHER PUBLICATIONS

Amit Govil, Selective Perforation: A Game Changer in Perforating Technology—Case Study, presented at the 2012 European and West African Perforating Symposium, Schlumberger, Nov. 7-9, 2012, 14 pgs.

Austin Powder Company; A-140 F & Block, Detonator & Block Assembly; Jan. 5, 2017; 2 pgs.; https://www.austinpowder.com/wp-content/uploads/2019/01/OilStar_A140Fbk-2.pdf.

(56) References Cited

OTHER PUBLICATIONS

Baker Hughes, Long Gun Deployment Systems IPS-12-28; 2012 International Perforating Symposium; Apr. 26-27, 2011; 11 pages.
Baker Hughes; SurePerf Rapid Select-Fire System Perforate production zones in a single run; 2012; 2 pages.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
Entchev et al., Autonomous Perforating System for Multizone Completions, SPE International, 2011, 7 pgs., https://www.onepetro.org/conference-paper/SPE-147296-MS.
GE Oil & GAS, Pipe Recovery Technology & Wireline Accessories, 2013, 435 pages.
Gilliat et al.; New Select-Fire System: Improved Reliability and Safety in Select Fire Operations; 2012; 16 pgs.
Giromax Directional,Gyroscopic and magnetic borehole surveying systems with outstanding quality andreliability, Feb. 14, 2016, 4 pgs., https://www.gyromax.com.au/inertial-sensing.html.
GR Energy Services, ZipRelease Addressable Wireline Release Tool, Dec. 8, 2016, 2 pgs.,https://grenergyservices.com/completion-services/perforating/addressable-wireline-release.
Halliburtion, World's first acoustic firing head system allows safer and more flexible TCP operations, Aug. 2015, 2 pgs., https://www.halliburton.com/content/dam/ps/public/lp/contents/Case_Histories/web/acoustic-firing-tcp.pdf.
Halliburton, Maxfire Electronic Firing Systems, Nov. 2014, 7 pgs., https://www.halliburton.com/content/dam/ps/public/lp/contents/Brochures/web/MaxFire pdf.
Halliburton, Releasable Cable Heads, 1 pg., Mar. 23, 2018, https://www.halliburton.com/en-US/ps/wireline-perforating/wireline-and-perforating/deployment-risk-avoidance/releasable-wireline-cable-head-rwch-tool.html.
Halliburton, Releasable Wireline Cable Head (RWCH Tool), 2016, 2 pgs., https://www.halliburton.com/content/dam/ps/public/lp/contents/Data_Sheets/web/H/Releasable-Wireline-Cable-Head-Tool-RWCH.pdf.
Halliburton, RexConnect—Have a dialogue with your reserviour, 2015, 8 pgs., https://www.halliburton.com/content/dam/ps/public/ts/contents/Brochures/web/RezConnectBrochure.pdf.
Halliburton; Wireline and Perforating Advances in Perforating; dated Nov. 2012; 12 pages.
Harrison Jet Gun Xtra Penetrator, website visited Nov. 29. 2018, 1 pg., https://www.google.com/search?q=harrison+jet+gun+xtra+penetrator&client=firefox-b-1-d&source=Inms&tbm=isch&sa=X&ved=0ahUKEwjY0KOQ1YTjAhXHmeAKHa00DeYQ_AUIESgC&biw=1440&bih=721#imgrc=ZlqpUcJ_-TL3IM.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Energy Service,ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.
Hunting Titan Inc.; Petition for Post Grant Review of U.S. Pat. No. 10,429,161; dated Jun. 30, 2020; 109 pages.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
International Searchiing Authority, International Search Report and Written Opinion of International App. No. PCT/EP2019/063966, dated Aug. 30, 2019, 10 pages.
International Searching Authority, International Search Report and Written Opinion for PCT App. No. PCT/IB2019/000526; dated Sep. 25, 2019, 17 pgs.
International Searching Authority, International Search Report and Written Opinion for PCT App. No. PCT/IB2019/000530; dated Oct. 8, 2019; 13 pgs.
International Searching Authority, The International Search Report and Written Opinion of International App. No. PCT/IB2019/000537, dated Sep. 25, 2019, 18 pgs.
International Searching Authority; Communication Relating to the Results of the Partial International Search for PCT/EP2020/070291; dated Oct. 20, 2020; 8 pages.
International Searching Authority; International Preliminary Report on Patentability for International Application No. PCT/IB2019/000537; dated Dec. 10, 2020; 11 pages.
International Searching Authority; International Preliminary Report on Patentability for International Application No. PCT/IB2019/000526; dated Dec. 10, 2020; 10 pages.
International Searching Authority; International Preliminary Report on Patentability for PCT/EP2019/066919; dated Jan. 7, 2021; 9 pages.
International Searching Authority; International Preliminary Report on Patentability for PCT/B2019/000530; dated Jan. 7, 2021; 9 pages.
International Searching Authority; International Preliminary Report on Patentability International Application No. PCT/EP2019/063966; dated Dec. 10, 2020; 7 pages.
International Searching Authority; International Preliminary Report on Patentability of the International Searching Authority for PCT/EP2019/072064; dated Feb. 25, 2021; 9 pages.
International Searching Authority; International Preliminary Report on Patentability of the International Searching Authority for PCT/EP2019/072032; dated Mar. 4, 2021; 9 pages.
International Searching Authority; International Search Report and Written Opinion for PCT App. No. PCT/EP2019/066919; dated Sep. 10, 2019; 11 pages.
International Searching Authority; International Search Report and Written Opinion for PCT App. No. PCT/EP2019/072032; dated Nov. 15, 2019; 13 pages.
International Searching Authority; International Search Report and Written Opinion for PCT App. No. PCT/EP2019/072064; dated Nov. 20, 2019; 15 pages.
International Searching Authority; International Search Report and Written Opinion of the International Searching Authority for PCT/EP2020/075788; dated Mar. 16, 2021; 17 pages.
International Searching Authority; International Search Report and Written Opinion of the International Searching Authority for PCT/EP2020/070291; dated Dec. 15, 2020; 14 pages.
International Searching Authority; Invitation to Pay Additional Fees with Partial International Search for Application No. PCT/EP2020/075788; dated Jan. 19, 2021; 9 pages.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Merol Applied Intelligence, Matrix Roxar Metrol Wireless Interface, 1 pg., https://www.metrol.co.uk/assets/docs/datasheets/MET-MATRIX-V01.pdf.
Micro Smart Systems, Slickline Triggers & Perforators, 1 pg., https://www.micro-smart.com/pdf/slickline_trigger_overview.pdf.
Owen Oil Tools & Pacific Scientific; RF-Safe Green Det, Side Block for Side Initiation, Jul. 26, 2017, 2 pgs.
Owen Oil Tools, Recommended Practice for Oilfield Explosive Safety, Presented at 2011 MENAPS Middle East and North Africa Perforating Symposium, Nov. 28-30, 2011, 6 pages.

(56) References Cited

OTHER PUBLICATIONS

Salt Warren et al.; New Perforating Gun System Increases Safety and Efficiency; dated Apr. 1, 2016; 11 pages.
Schlumberger & Said Abubakr, Combining and Customizing Technologies for Perforating Horizontal Wells in Algeria, Presented at 2011 MENAPS, Nov. 28-30, 2011, 20 pages.
Schlumberger, eFire-TCP Firing Head Enabled by Muzic Telemetry, 2016, 2 pgs., www.slb.com/perforating.
Smylie, Tom, New Safe and Secure Detonators for the Industry's consideration, presented at Explosives Safety & Security Conference, Marathon Oil Co, Houston; Feb. 23-24, 2005, 20 pages.
U.S. Patent Trial and Appeal Board, Institution of Inter Partes Review of U.S. Pat. No. 9581422, Case IPR2018-00600,Aug. 21, 2018, 9 pages.
United States District Court for the Southern District of Texas Houston Division, Case 4:19-cv-01611 for U.S. Pat. No. 9,581,42282, Plaintiffs Complaint and Exhibits, dated May 2, 2019, 26 pgs.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Final Office Action of U.S. Appl. No. 16/542,890, dated May 12, 2020, 16 pgs.
United States Patent and Trademark Office, Final Office Action of U.S. Appl. No. 16/423,230, dated Nov. 4, 2019, 14 pgs.
United States Patent and Trademark Office, Non-final Office Action of U.S. Appl. No. 16/451,440, dated Oct. 24, 2019, 22 pgs.
United States Patent and Trademark Office, Notice of Allowance for U.S. Appl. No. 16/788,107, dated Jul. 30, 2020, 9 pgs.
United States Patent and Trademark Office, Office Action of U.S. Appl. No. 16/423,230, dated Aug. 27, 2019, 16 pgs.
United States Patent and Trademark Office; Final Office Action for U.S. Appl. No. 16/451,440; dated Feb. 7, 2020; 11 pages.
United States Patent and Trademark Office; Non-Final Office Action for U.S. Appl. No. 16/542,890; dated Nov. 4, 2019; 16 pages.
United States Patent and Trademark Office; Non-Final Office Action for U.S. Appl. No. 16/542,890; filed Sep. 30, 2020; 17 pages.
United States Patent and Trademark Office; Notice of Allowance for U.S. Appl. No. 16/451,440; dated Jun. 5, 2020; 8 pages.
United States Patent and Trademark Office; Requirement for Restriction/Election for U.S. Appl. No. 16/537,720; dated Apr. 27, 2021; 8 pages.
USPTO, Notice of Allowance for U.S. Appl. No. 16/423,230, dated Nov. 27, 2019, 7 pgs.
USPTO, Office Action of U.S. Appl. No. 16/788,107, dated Apr. 6, 2020, 15 pgs.
International Searching Authority; International Search Report and Written Opinion for PCT Appl PCT/EP2020/065180; dated Oct. 6, 2020; 11 pages.
United States Patent and Trademark Office; Non-Final Office Action for U.S. Appl. No. 16/537,720; dated Jun. 15, 2021; 13 pages.
International Searching Authority; International Preliminary Report on Patentability of the International Searching Authority for PCT/EP2020/065180; dated Dec. 21, 2021; 7 pages.
United States Patent and Trademark Office; Advisory Action Before the Filing of an Appeal Brief for U.S. Appl. No. 16/537,720; dated Dec. 27, 2021; 3 pages.
United States Patent and Trademark Office; Non-Final Office Action for U.S. Appl. No. 17/254,198; dated Dec. 22, 2021; 17 pages.
U.S. Appl. No. 29/748,612, filed Aug. 31, 2020, Christian Eitschberger.
U.S. Appl. No. 62/861,601, filed Jun. 14, 2019, Christian Eitschberger.
U.S. Appl. No. 62/945,942, filed Dec. 10, 2019, Christian Eitschberger.
U.S. Appl. No. 63/001,766, filed Mar. 30, 2020, Christian Eitschberger.
U.S. Appl. No. 63/003,222, filed Mar. 31, 2020, Christian Eitschberger.
China National Intellectual Property Administration; First Office Action for CN Application No. 201980039397.6; dated Aug. 3, 2022; 12 pages.
European Patent Office; Rule 161 Communication for EP Application No. 20746535.2; dated Mar. 1, 2022; 3 pages.
Hunting Titan, Inc.; Defendant Hunting Titan, Inc.'s Opposition to Plaintiffs Motion for Summary Judgement for Civil Action No. 4:20-cv-02123; dated Mar. 30, 2022; 37 pages.
Hunting Titan, Inc.; Defendant's Final Invalidity Contentions for Civil Action No. 4:20-cv-02123; dated Jan. 7, 2022; 54 pages.
Hunting Titan, Inc.; Defendant's Preliminary Invalidity Contentions for Civil Action No. 4:20-cv-02123; dated Aug. 6, 2021; 52 pages.
Hunting Titan, Inc.; Exhibit A to Defendant's Preliminary Invalidity Contentions, Invalidity of U.S. Pat. No. 10,429,161; dated Aug. 6, 2021; 93 pages.
Hunting Titan, Inc.; Exhibit B to Defendant's Preliminary Invalidity Contentions, Invalidity of U.S. Pat. No. 10,472,938; dated Aug. 6, 2021; 165 pages.
Hunting Titan, Inc.; Exhibit C to Defendant's Final Invalidity Contentions, Invalidity of U.S. Pat. No. 10,429,161; dated Jan. 7, 2022; 3 pages.
Hunting Titan, Inc.; Exhibit D to Defendant's Final Invalidity Contentions, Invalidity of U.S. Pat. No. 10,472,938; dated Jan. 7, 2022; 6 pages.
International Searching Authority; International Preliminary Report on Patentability of the International Searching Authority for PCT/EP2020/075788; dated Mar. 31, 2022; 10 pages.
International Searching Authority; International Preliminary Report on Patentability of the International Searching Authority for PCT/EP2020/070291; dated Feb. 3, 2022; 8 pages.
United States District Court for the Northern District of Texas Dallas Division; Memorandum Opinion and Order in Civil Action No. 3:21-cv-00192-M; Mar. 23, 2022; 34 pages (order is redacted to protect confidential information; redacted order has not yet been filed by the Court).
United States Patent and Trademark Office; Advisory Action Before the Filing of an Appeal Brief for U.S. Appl. No. 17/254,198; dated Aug. 2, 2022; 3 pages.
United States Patent and Trademark Office; Final Office Action for U.S. Appl. No. 17/254,198; dated May 26, 2022; 19 pages.
United States Patent and Trademark Office; Non-Final Office Action for U.S. Appl. No. 17/072,067; dated Mar. 31, 2022; 15 pages.
United States Patent and Trademark Office; Non-Final Office Action for U.S. Appl. No. 17/608,173; dated Mar. 29, 2022; 5 pages.
United States Patent and Trademark Office; Notice of Allowance for U.S. Appl. No. 16/919,473; dated Jun. 14, 2022; 8 pages.
United States Patent and Trademark Office; Notice of Allowance for U.S. Appl. No. 17/072,067; dated Aug. 12, 2022; 10 pages.
United States Patent and Trademark Office; Notice of Allowance for U.S. Appl. No. 17/076,099; dated Mar. 28, 2022; 7 pages.
United States Patent and Trademark Office; Patent Trial and Appeal Board Decision on Appeal; dated Apr. 11, 2022; 12 pages.

* cited by examiner

SELECTIVE UNTETHERED DRONE STRING FOR DOWNHOLE OIL AND GAS WELLBORE OPERATIONS

CROSS-REFERENCE TO RELATED APPLICATIONS

This application is a national phase of and claims priority to Patent Cooperation Treaty (PCT) Application No. PCT/IB2019/000526 filed Apr. 12, 2019, which claims priority to International Patent Application No. PCT/IB2019/000537, filed Mar. 18, 2019, which claims the benefit of U.S. Provisional Patent Application No. 62/678,636 filed May 31, 2018. PCT/IB2019/000526 claims priority to International Patent Application No. PCT/IB2019/000530 filed Mar. 29, 2019, which claims the benefit of U.S. Provisional Patent Application No. 62/690,314 filed Jun. 26, 2018. PCT/IB2019/000526 claims the benefit of U.S. Provisional Patent Application No. 62/765,185 filed Aug. 20, 2018. PCT/IB2019/000526 claims priority to U.S. patent application Ser. No. 16/272,326 filed Feb. 11, 2019, which claims the benefit of U.S. Provisional Patent Application No. 62/780,427 filed Dec. 17, 2018 and U.S. Provisional Patent Application No. 62/699,484 filed Jul. 17, 2018. PCT/IB2019/000526 claims the benefit of U.S. Provisional Patent Application No. 62/823,737 filed Mar. 26, 2019. PCT/IB2019/000526 claims the benefit of U.S. Provisional Patent Application No. 62/827,468 filed Apr. 1, 2019. PCT/IB2019/000526 claims the benefit of U.S. Provisional Patent Application No. 62/831,215 filed Apr. 9, 2019. The entire contents of each application listed above are incorporated herein by reference.

FIELD OF THE DISCLOSURE

Devices, systems, and methods for autonomous or semi-autonomous downhole delivery of one or more wellbore tools in an oil or gas wellbore. More specifically, devices, systems, and methods for improving efficiency of downhole wellbore operations and minimizing debris in the wellbore from such operations.

BACKGROUND OF THE DISCLOSURE

Hydraulic Fracturing (or, "fracking") is a commonly-used method for extracting oil and gas from geological formations (i.e., "hydrocarbon bearing formations") such as shale and tight-rock formations. Fracking typically involves, among other things, drilling a wellbore into a hydrocarbon bearing formation; installing casing(s) and tubing; deploying a perforating gun including shaped explosive charges in the wellbore via a wireline or other methods; positioning the perforating gun within the wellbore at a desired area; perforating the wellbore and the hydrocarbon formation by detonating the shaped charges; pumping high hydraulic pressure fracking fluid into the wellbore to force open perforations, cracks, and imperfections in the hydrocarbon formation; delivering a proppant material (such as sand or other hard, granular materials) into the hydrocarbon formation to hold open the perforations, fractures, and cracks (giving the tight-rock formation permeability) through which hydrocarbons flow out of the hydrocarbon formation; and, collecting the liberated hydrocarbons via the wellbore.

Perforating the wellbore and the hydrocarbon formations is typically done using one or more perforating guns. For example, as shown in FIG. 1A and further described in U.S. Pat. No. 9,494,021 which is incorporated herein by reference in its entirety, a conventional perforating gun string 100 may have two or more perforating guns 110. Each perforating gun 110 may have a substantially cylindrical carrier body 120 housing a charge carrier 130 including, among other things, one more shaped charges 140, a detonating cord 150 for detonating the shaped charges 140, and a conductive line 160 for relaying an electrical signal between connected perforating guns 110. In such "enclosed" perforating guns 110, the carrier body 120 may use, for example, a variety of seals and connections (unnumbered) to prevent the charge carrier 130, shaped charges 140, and other internal components from being exposed to harsh wellbore conditions which may include damaging temperatures, pressures, fluids, corrosive materials, etc. Exposure to such conditions may, for example, deactivate or destroy the perforating gun 110 and associated components or cause premature detonation.

Another known perforating gun type is an "exposed" perforating gun 200, as shown in FIG. 1B. The exposed perforating gun 200 includes a charge carrier 220 with a plurality of encapsulated shaped charges 210. The encapsulated shaped charges 210 are exposed to the surrounding environment. Thus, the encapsulated shaped charges 210 may include a structure and/or material that substantially isolates and seals the internal components of the encapsulated shaped charge 210 from external conditions. The exposed perforating gun 200 also includes a conductive line 250 for relaying an electrical signal along the length of the perforating gun 200 and a detonating cord 230 for detonating the encapsulated shaped charges 210. The conductive line 250 and the detonating cord 230 are exposed to external conditions. Thus, the conductive line 250 and the detonating cord 230 must be configured to withstand the temperatures, pressures, and materials that are found within a wellbore. In addition, as shown in FIG. 1B, the exposed perforating gun 200 includes a firing head 240 that will house an initiator (not shown) and initiate the detonating cord 230 upon activation. Multiple exposed perforating guns 200 may also be connected in a gun string.

Gun strings including multiple perforating guns help to improve operational efficiency by allowing multiple perforating intervals to be perforated during one wireline run into the wellbore. The gun string may also include wellbore tools such as one or more fracking plugs ("frac plug") or bridge plugs, tubing cutters, etc. for downhole operations. For ease of reference in this disclosure, a "gun string" may include any combination of perforating guns and wellbore tools, which further encompasses control devices and the like for use in downhole wellbore operations. Each of the individual perforating guns and/or wellbore tools in the string may have selective detonation/initiation capability. By "selective" what is meant is that a detonator or initiator assembly of an individual perforating gun or wellbore tool is configured to receive one or more specific digital sequence(s), which differs from a digital sequence that might be used to arm and/or detonate another detonator or initiator assembly in a different, adjacent perforating gun or tool. So, detonation of the various perforating guns and/or tools does not necessarily have to occur sequentially upon a single detonation signal. Any specific perforating gun or tool can be selectively detonated/initiated, although the sequence must progress from the bottom up—i.e., the gun/tool that is furthest downstream (within the wellbore) must be detonated before others—otherwise the conductive line that relays the electrical signal through successive guns/tools will be severed and downstream guns/tools may not be initiated. For purposes of this disclosure, "downstream"

means in a direction deeper or further into the wellbore and "upstream" means in a direction towards the wellbore entrance or surface. Thus, in operation, the gun string is lowered or pumped down into the wellbore to a desired location, one or more of the perforating guns and/or tools is detonated/initiated, and the wireline is retracted to the next desired location at which additional perforating gun(s) and/or tool(s) are detonated/initiated. The process repeats until all of the operations have been completed. The wireline cable is then retracted to the surface of the wellbore along with any components that have remained attached to the gun string. Additional debris that remains in the wellbore may need to be recovered or is left in situ.

FIG. 2 shows a cross-sectional view of a wellbore and wellhead according to the prior art use of a wireline cable 2012 to place drones in a wellbore 2016. In oil and gas wells, the wellbore 2016, as illustrated in FIG. 2 is a narrow shaft drilled in the ground, vertically and/or horizontally deviated. A wellbore 2016 can include a substantially vertical portion as well as a substantially horizontal portion and a typical wellbore may be over a mile in depth (e.g., the vertical portion) and several miles in length (e.g., the horizontal portion). The wellbore 2016 is usually fitted with a wellbore casing that includes multiple segments (e.g., about 40-foot segments) that are connected to one another by couplers. A coupler (e.g., a collar), may connect two sections of wellbore casing.

In the oil and gas industry, the wireline cable 2012, electric line or e-line are cabling technology used to lower and retrieve equipment or measurement devices into and out of the wellbore 2016 of an oil or gas well for the purpose of delivering an explosive charge, evaluation of the wellbore 2016 or other well-related tasks. Other methods include tubing conveyed (i.e., TCP for perforating) or coil tubing conveyance. A speed of unwinding the wireline cable 2012 and winding the wireline cable 2012 back up is limited based on a speed of the wireline equipment 2062 and forces on the wireline cable 2012 itself (e.g., friction within the well). Because of these limitations, it typically can take several hours for a wireline cable 2012 and a toolstring 2031 to be lowered into a well and another several hours for the wireline cable 2012 to be wound back up and the expended toolstring retrieved. The wireline equipment 2062 feeds wireline 2012 through wellhead 2060. When detonating explosives, the wireline cable 2012 will be used to position the toolstring 2031 of perforating guns 2018 containing the explosives into the wellbore 2016. After the explosives are detonated, the wireline cable 2012 will have to be extracted or retrieved from the well.

Wireline cables and TCP systems have other limitations such as becoming damaged after multiple uses in the wellbore due to, among other issues, friction associated with the wireline cable rubbing against the sides of the wellbore. Location within the wellbore is a simple function of the length of wireline cable that has been sent into the well. Thus, the use of wireline may be a critical and very useful component in the oil and gas industry yet also presents significant engineering challenges and is typically quite time consuming. It would therefore be desirable to provide a system that can minimize or even eliminate the use of wireline cables for activity within a wellbore while still enabling the position of the downhole equipment, e.g., the toolstring 2031, to be monitored.

During many critical operations utilizing equipment disposed in a wellbore, it is important to know the location and depth of the equipment in the wellbore at a particular time. When utilizing a wireline cable for placement and potential retrieval of equipment, the location of the equipment within the well is known or, at least, may be estimated depending upon how much of the wireline cable has been fed into the wellbore. Similarly, the speed of the equipment within the wellbore is determined by the speed at which the wireline cable is fed into the wellbore. As is the case for a toolstring 2031 attached to a wireline, determining depth, location and orientation of a toolstring 2031 within a wellbore 2016 is typically a prerequisite for proper functioning.

One known means of locating a toolstring 2031, whether tethered or untethered, within a wellbore involves a casing collar locator ("CCL") or similar arrangement, which utilizes a passive system of magnets and coils to detect increased thickness/mass in a wellbore casing 1580 (FIG. 15) at portions where coupling collars 1590 (FIG. 15) connect two sections of wellbore casing 1582, 1584 (FIG. 15). A toolstring 2031 equipped with a CCL may be moved through a portion of the wellbore casing 1580 having the collar 1590. The increased wellbore wall thickness/mass the collar 1590 results in a distortion of the magnetic field (flux) around the CCL magnet. This magnetic field distortion, in turn, results in a small current being induced in a coil; this induced current is detected by a processor/onboard computer which is part of the CCL. In a typical embodiment of known CCL, the computer 'counts' the number of coupling collars 1590 detected and calculates a location along the wellbore 2016 based on the running count.

Another known means of locating a toolstring 2031 within a wellbore 2016 involves tags attached at known locations along the wellbore casing 1580. The tags, e.g., radio frequency identification ("RFID") tags, may be attached on or adjacent to casing collars but placement unrelated to casing collars is also an option. Electronics for detecting the tags are integrated with the toolstring 2031 and the onboard computer may 'count' the tags that have been passed. Alternatively, each tag attached to a portion of the wellbore may be uniquely identified. The detecting electronics may be configured to detect the unique tag identifier and pass this information along to the computer, which can then determine current location of the toolstring 2031 along the wellbore 2016.

Accordingly, current wellbore operations and system(s) require substantial amounts of onsite personnel and equipment and sometimes result in large residual debris post perforation in the wellbore. Even with selective gun strings, a substantial amount of time, equipment, and labor may be required to deploy the perforating gun or wellbore tool string, position the perforating gun or wellbore tool string at the desired location(s), and remove residual debris post perforating. Further, current perforating devices and systems may be made from materials that remain in the wellbore after detonation of the shaped charges and leave a large amount of debris that must either be removed from the wellbore or left within. Accordingly, devices, systems, and methods that may reduce the time, equipment, labor, and debris associated with downhole operations would be beneficial, including systems and methods of determining location along a wellbore that do not necessarily rely on the presence of casing collars or any other standardized structural element, e.g., tags, associated with the wellbore casing.

BRIEF DESCRIPTION OF THE EXEMPLARY EMBODIMENTS

Devices, systems, and methods for autonomous or semi-autonomous downhole delivery and performance of one or more wellbore tools and operations in an oil or gas wellbore.

For purposes of this disclosure and without limitation, "autonomous" means without a physical connection or manual control and "semi-autonomous" means without a physical connection.

In an aspect, the exemplary embodiments include a selective untethered drone string for downhole delivery of a wellbore tool, comprising: a first untethered drone, wherein the first untethered drone includes a selective detonator and a control circuit programmed for controlling selective detonation of a plurality of selective detonators, and the selective detonator of the first untethered drone is in electrical communication with the control circuit; and, a second untethered drone connected to the first untethered drone, wherein the second untethered drone includes a selective detonator in electrical communication with the control circuit, wherein the control circuit is configured for transmitting a selective sequence signal to at least one of the selective detonator of the second untethered drone and the selective detonator of the first untethered drone.

In another aspect, the exemplary embodiments include a selective untethered drone string, comprising: a first untethered drone connected to a second untethered drone, the first untethered drone and the second untethered drone respectively including a body portion; a selective detonator and optionally, a detonating cord coupled to the selective detonator; and a plurality of shaped charges received in shaped charge apertures in the body portion, wherein the shaped charge apertures are respectively positioned adjacent to at least one of the detonator and the detonating cord within an interior of the body portion, wherein the first untethered drone includes a control circuit programmed for controlling selective detonation of a plurality of selective detonators, and the selective detonator of the first untethered drone is in electrical communication with the control circuit, the selective detonator of the second untethered drone is in electrical communication with the control circuit, and the control circuit is configured for transmitting a selective sequence signal to the selective detonator of each of the second untethered drone and the first untethered drone, and the selective sequence signal for the selective detonator of the second untethered drone is different than the selective sequence signal for the selective detonator of the first untethered drone.

In a further aspect, the exemplary embodiments include a method for downhole delivery of a wellbore tool using a selective untethered drone string, comprising: programming a control circuit of the selective untethered drone string at a surface of the wellbore before the selective untethered drone string is deployed into the wellbore, wherein programming the control circuit includes teaching the control circuit a selective sequence signal for each of a plurality of selective detonators, wherein the selective untethered drone string includes a first untethered drone including a selective detonator and the control circuit, wherein the selective detonator of the first untethered drone is in electrical communication with the control circuit, and the first untethered drone further includes a shaped charge, a second untethered drone connected to the first untethered drone, wherein the second untethered drone includes a selective detonator in electrical communication with the control circuit, and a shaped charge; deploying the selective untethered drone string into the wellbore; transmitting a first selective sequence signal from the control circuit to the selective detonator of the second untethered drone and detonating the selective detonator and the shaped charge of the second untethered drone when the selective untethered drone string reaches a first pre-determined condition; and transmitting a second selective sequence signal from the control circuit to the selective detonator of the first untethered drone and detonating the selective detonator and the shaped charge of the first untethered drone when the selective untethered drone string reaches the first pre-determined condition or a second pre-determined condition.

For purposes of this disclosure, a "drone" is a self-contained, autonomous or semi-autonomous vehicle for downhole delivery of a wellbore tool.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1A:
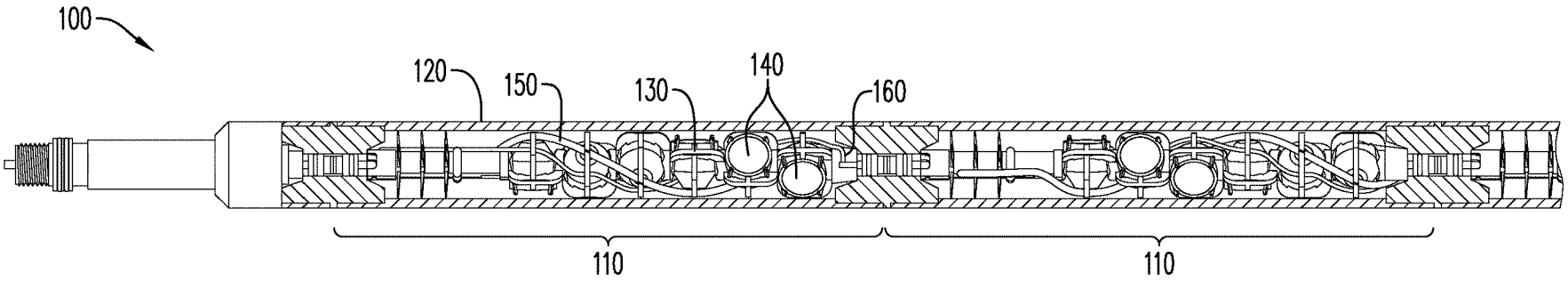
FIG. 1A (PRIOR ART)
FIG. 1A is a perspective view of a prior art perforating gun string.
Figure 1B:
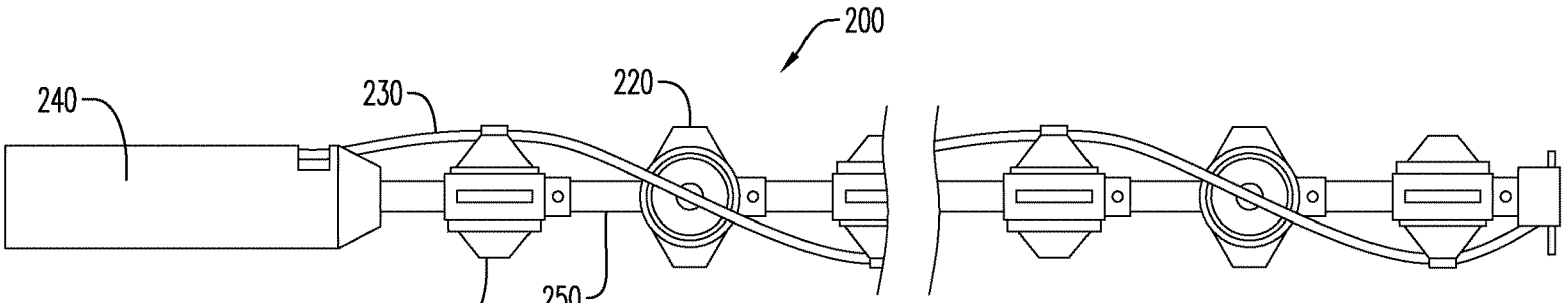
FIG. 1B (PRIOR ART)
FIG. 1B is a perspective view of a prior art exposed perforating gun.
Figure 2:
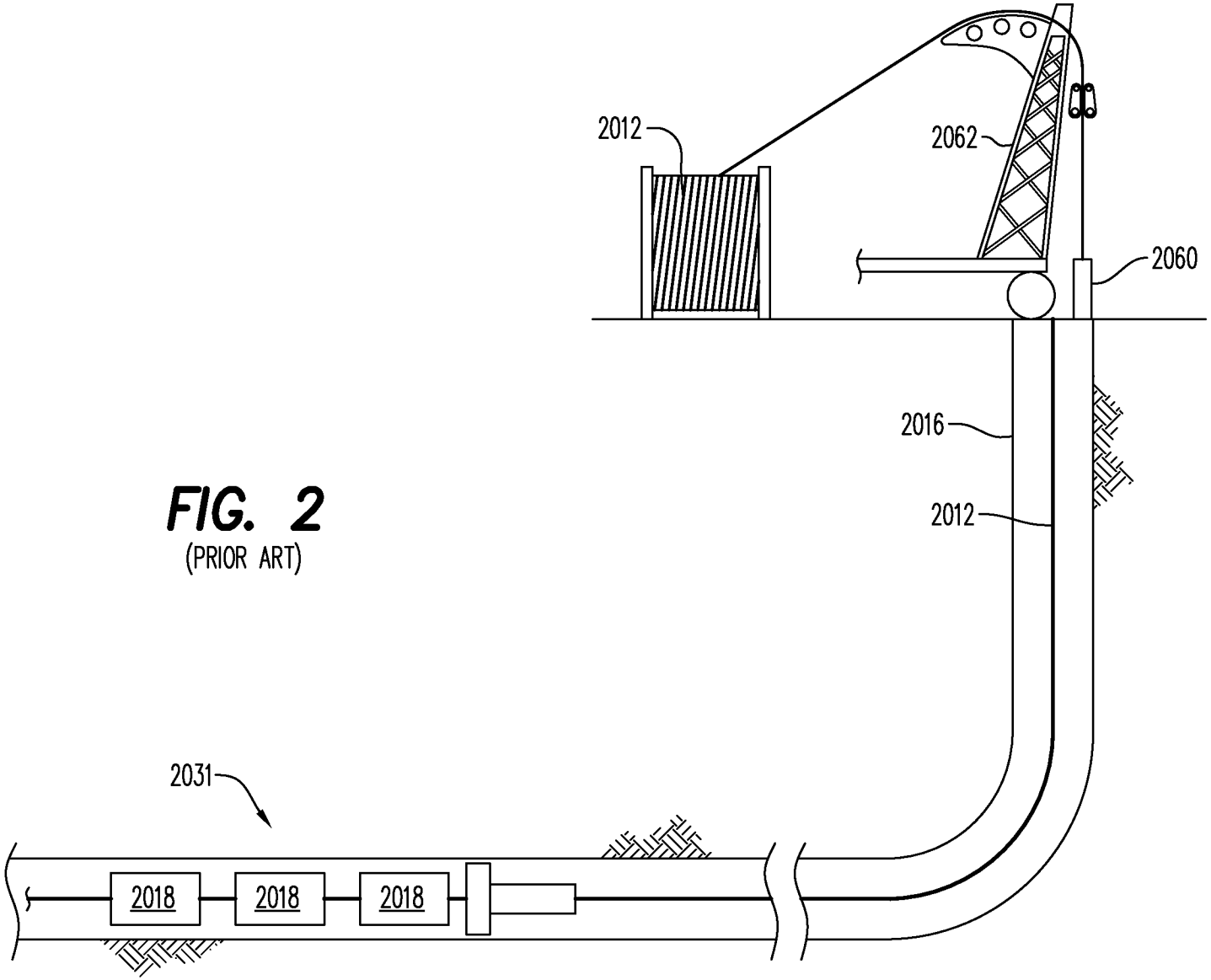
FIG. 2 (PRIOR ART)
FIG. 2 is a cross-sectional view of a wellbore and wellhead showing the prior art use of a wireline to place drones in a wellbore.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

This application incorporates by reference each of the following pending patent applications in their entireties: U.S. Provisional Patent Application No. 62/816,649, filed Mar. 11, 2019; U.S. Provisional Patent Application No. 62/720,638, filed Aug. 21, 2018; U.S. Provisional Patent Application No. 62/719,816, filed Aug. 20, 2018; U.S. Provisional Patent Application No. 62/678,654, filed May 31, 2018.

Reference will now be made in detail to various exemplary embodiments. Each example is provided by way of explanation and is not meant as a limitation and does not constitute a definition of all possible embodiments.

Figure 3A:
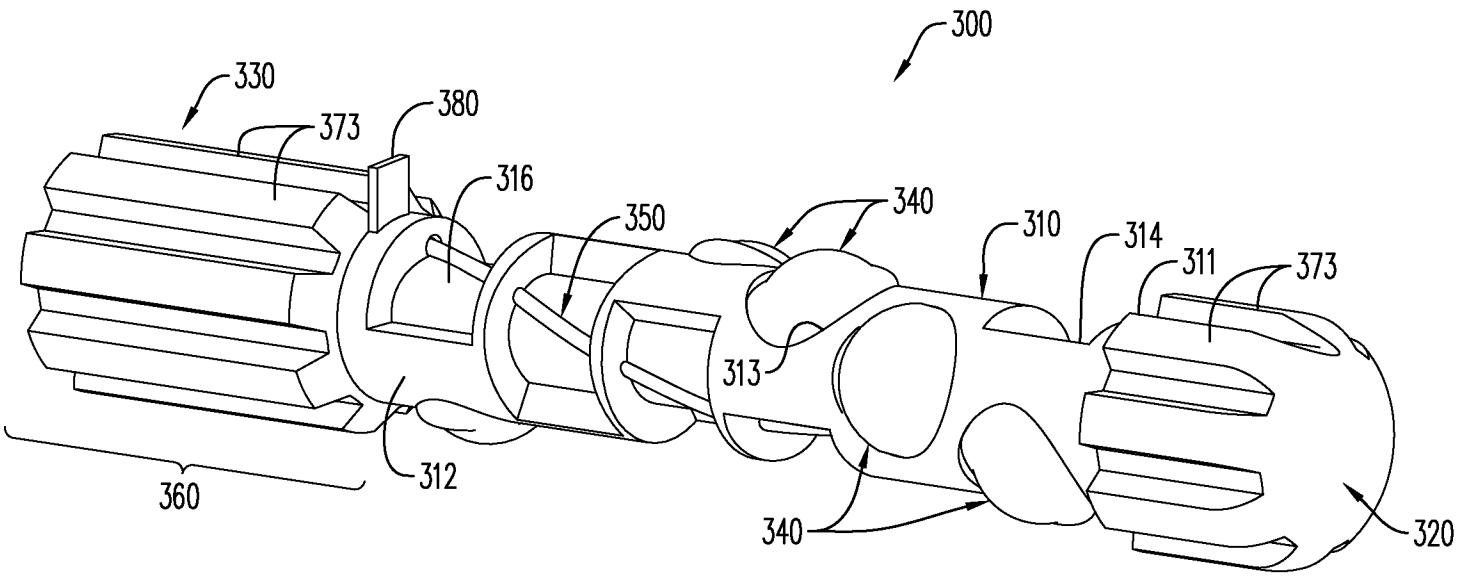
FIG. 3A is a perspective view of an untethered drone according to an exemplary embodiment.
Figure 3B:
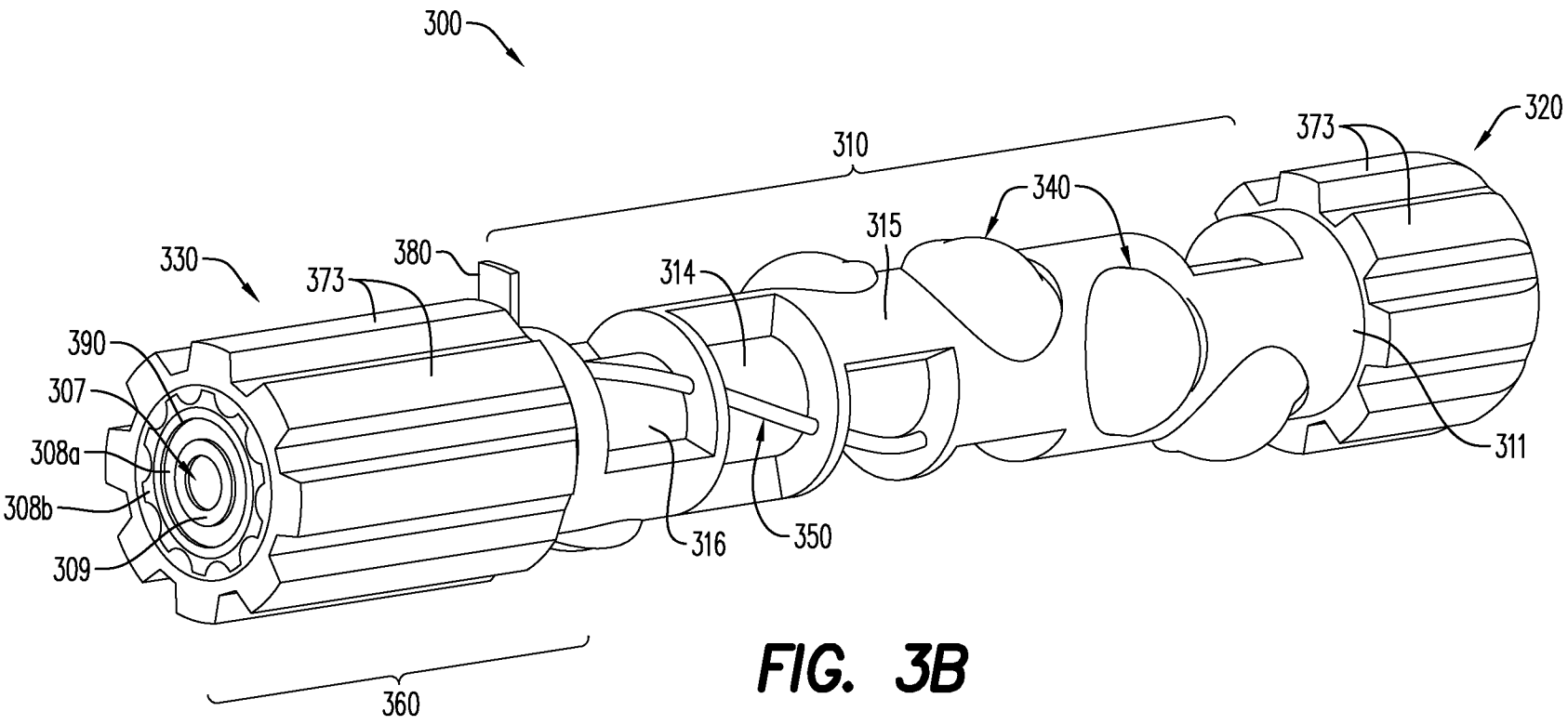
FIG. 3B is another perspective view of the exemplary embodiment shown in FIG. 3A.

With reference to FIGS. 3A and 3B, an exemplary embodiment of an untethered drone 300 is shown. As described herein, the untethered drone 300 may be launched autonomously or semi-autonomously into a wellbore 1070 (FIG. 10), for delivering one or more wellbore tools downhole. The wellbore tools may include, for example and without limitation, a perforating gun system, shaped charges, a bridge plug, a frac plug, a tubing cutter, and a wellbore data collection/topography mapping system that may be removed from the wellbore 1070 after a downhole wellbore operation. The exemplary untethered drone 300 shown in FIGS. 3A and 3B includes a body portion 310 having a front end 311 and a rear end 312. A head portion 320 extends from the front end 311 of the body portion 310 and a tail portion 330 extends from the rear end 312 of the body portion 310 in a direction opposite the head portion 320. The body portion 310 includes a plurality of shaped charge apertures 313 and open apertures 316 extending between an external surface 315 of the body portion 310 and an interior 314 of the body portion 310. Each of the plurality of shaped charge apertures 313 are configured for receiving and retaining a shaped charge 340. The purpose and configuration of the shaped charge apertures 313 and the open apertures 316 will be further described below.

In the exemplary embodiment shown in FIGS. 3A and 3B, the body portion 310, the head portion 320, and the tail portion 330 may be formed from a material that will substantially disintegrate upon detonation of the shaped charges 340. In an exemplary embodiment, the material may be an injection-molded plastic that will substantially dissolve into a proppant when the shaped charges 340 are detonated. In the same or other embodiments, one or more portions of the untethered drone 300 may be formed from a variety of techniques and/or materials including, for example and without limitation, injection molding, casting (e.g., plastic casting and resin casting), metal casting, 3D printing, and 3D milling from a solid plastic bar stock. Reference to the exemplary embodiments including injection-molded plastics is thus not limiting. An untethered drone 300 formed according to this disclosure leaves a relatively small amount of debris in the wellbore post perforation. In certain exemplary embodiments, one or more of the body portion 310, the head portion 320, and the tail portion 330 may be formed from plastic that is substantially depleted of other components including metals. Substantially depleted may mean, for example and without limitation, lacking entirely or including only nominal or inconsequential amounts. In other embodiments, the plastic may be combined with any other materials consistent with this disclosure. For example, the materials may include metal powders, glass beads or particles, known proppant materials, and the like that may serve as a proppant material when the shaped charges 340 are detonated. In addition, the materials may include, for example, oil or hydrocarbon-based materials that may combust and generate pressure when the shaped charges 340 are detonated, synthetic materials potentially including a fuel material and an oxidizer to generate heat and pressure by an exothermic reaction, and materials that are dissolvable in a hydraulic fracturing fluid.

In the exemplary disclosed embodiments, the body portion 310 is a unitary structure that may be formed from an injection-molded material. In the same or other embodiments, at least two of the body portion 310, the head portion 320, and the tail portion 330 are integrally formed from an injection-molded material. In other embodiments, the body portion 310, the head portion 320, and the tail portion 330 may constitute modular components or connections.

As shown in FIGS. 3A and 3B, each of the body portion 310, the head portion 320, and the tail portion 330 is substantially cylindrically-shaped. The head portion 320 and the tail portion 330 each have a maximum diameter that is greater than a maximum diameter of the body portion 310, and at least a portion of each of the head portion 320 and the tail portion 330 extends beyond the maximum diameter of the body portion 310. The exemplary disclosed configuration may help protect the body portion 310, the shaped charges 340, and the internal components of the body portion 310 from collisions and fluid pressures during the descent of the untethered drone 300 into the wellbore 670. For example, the larger diameter of the head portion 320 and tail portion 330 may block the body portion 310 from collisions and force fluid pressure away from the body portion 310. Each of the head portion 320 and the tail portion 330 also includes fins 373 configured for reducing friction during the descent of the untethered drone 300 into the wellbore 1070.

With continuing reference to FIGS. 3A and 3B, each of the plurality of shaped charge apertures 313 in the body portion 310 may receive and retain a portion of a shaped charge 340 in a corresponding hollow portion (unnumbered) of the interior 314 of the body portion 310. Another portion of the shaped charge 340 remains exposed to the surrounding environment. Thus, the body portion 310 may be considered in some respects as an exposed charge carrier, and the shaped charges 340 may be encapsulated, pressure sealed shaped charges having a lid or cap. The plurality of open apertures 316 may be configured for, among other things, reducing friction against the body portion 310 as the untethered drone 310 is conveyed into a wellbore 1070 and/or for enhancing the collapse/disintegration properties of the body portion 310 when the shaped charges 340 are detonated.

The interior 314 of the body portion 310 may have hollow regions and non-hollow regions. As discussed above, the shaped charge apertures 313 receive and retain a portion of the shaped charge 340 in a hollow portion of the interior 314 of the body portion 310. Other regions of the interior 314 may be formed as non-hollow or may include additional internal components of the untethered drone 300 as applications dictate. The hollow portion of the interior 314 may include one or more structures for supporting each of the shaped charge 340 in the shaped charge apertures 313. The supporting structure may support, secure, and/or position the shaped charge 340 and may be formed from a variety of materials in a variety of configurations consistent with this disclosure. For example and without limitation, the supporting structure may be formed from the same material as the body portion 310 and may include a retaining device such as a retaining ring, clip, tongue in groove assembly, frictional engagement, etc., and the shaped charge 340 may include a complimentary structure to interact with the supporting structure.

While the shaped charge apertures 313 (and correspondingly, the shaped charges 340) are shown in a typical helical arrangement about the body portion 310 in the exemplary embodiment shown in FIGS. 3A and 3B, the disclosure is not so limited and it is contemplated that any arrangement of one or more shaped charges 340 may be accommodated, within the spirit and scope of this disclosure, by the untethered drone 300. For example, a single shaped charge aperture or a plurality of shaped charge apertures for respectively receiving a shaped charge may be positioned at any phasing (i.e., circumferential angle) on the body portion, and a plurality of shaped charge apertures may be included, arranged, and aligned in any number of ways. For example, and without limitation, the shaped charge apertures 313 may be arranged, with respect to the body portion, along a single longitudinal axis, within a single radial plane, in a staggered or random configuration, spaced apart along a length of the body portion, pointing in opposite directions, etc.

An exemplary supporting structure will secure each shaped charge 340 such that a point of velocity created by detonation of the shaped charge 340 will be centered with respect to the shaped charge aperture 313. Keeping the shaped charges 340 respectively centered will help balance the untethered drone 300 towards the center of the wellbore 1070 when the shaped charges 340 are detonated, because opposing perforating shock forces propagating into the body portion 310 as a result of the detonations will reduce movement of the untethered drone 300 within the wellbore 1070 due to unbalanced detonation forces. The exemplary supporting structure and/or other structures within the body portion 310 may also absorb and/or contain the perforating shock forces to assist with disintegrating the untethered drone 300 when the shaped charges 340 are detonated. Disintegration of the untethered drone material must be slower than detonation of the shaped charges 340 to ensure that the perforating shock forces, heat, pressure, shockwaves, etc. generated by detonating the shaped charges 340 are available to thoroughly disintegrate the untethered drone 300. However, disintegration of the untethered drone material must not be so slow that the various energy sources generated by the detonations are lost to the surrounding environment before the untethered drone 300 is thoroughly disintegrated.

A detonating cord 350 for detonating the shaped charges 340 and relaying ballistic energy along the length of the untethered drone 300 may be housed within at least a portion of each of the body portion 310, the head portion 320, and the tail portion 330. In the exemplary embodiment shown in FIGS. 3A and 3B, the detonating cord 350 is housed within the interior 314 of the body portion and is exposed to the surrounding environment through the open apertures 316. Accordingly, the detonating cord 350 is configured for withstanding the conditions and materials within a wellbore, without becoming destroyed or inoperable, or detonating prematurely. Such exposed detonating cords are known.

In some embodiments, and depending on the arrangement of the shaped charge apertures 313 and shaped charges 340, the detonating cord 350 may be arranged in a complementary manner to ensure that the detonating cord 350 is in sufficient contact or proximity to the shaped charges 340, for detonating the shaped charges 340.

In an aspect, the detonating cord 350 extends through the body portion 310 between the head portion 320 and the tail portion 330. In a further aspect, an amount of detonating cord 350 within one or both of the head portion 320 and the tail portion 330 is increased by, e.g., weaving, wrapping, folding, rolling, and the like, the detonating cord 350 within the head portion 320 and/or the tail portion 330. Increasing the amount of detonating cord 350 within the head portion 320 and/or the tail portion 330 may help ensure that enough ballistic and incendiary energy to thoroughly disintegrate those portions (320, 330) is provided directly to those portions (320, 330) upon initiation of the detonating cord 350. The additional, direct energy to the head portion 320 and the tail portion 330 may also help to disintegrate those portions (320, 330) before the shaped charge explosions potentially collapse the body portion 310 and eject the undisintegrated head portion 320 and tail portion 330 away from the explosive forces.

In an aspect and with continuing reference to FIGS. 3A and 3B, the body portion 310 of the untethered drone 300 also houses a conductive line (not shown) for relaying an electrical signal along the length of the untethered drone 300, as discussed further below. In the exemplary embodiment shown in FIGS. 3A and 3B, the detonating cord 350 is a conductive detonating cord 10 (FIGS. 9A-9D) and includes the conductive line. In other embodiments, the conductive line and the detonating cord 350 may be separate components. The conductive detonating cord 350 according to the exemplary embodiments is discussed and shown with respect to FIGS. 9A-9D and described in U.S. Patent Application No. 62/683,083 filed Jun. 11, 2018, which is incorporated by reference herein in its entirety.

The conductive detonating cord 350 in the exemplary embodiment shown in FIGS. 3A and 3B is configured for being in ballistic and electrical contact at one end with one or more of an initiator, an igniter, or a detonator assembly 307 (collectively, "detonator 307"), an external contact point 309, and an onboard computer 390.

The detonator 307, the external contact point 309, and the onboard computer 390 are non-limiting examples of components that this disclosure refers to collectively as a vehicle driver 360. In the exemplary embodiment shown in FIGS. 3A and 3B, the vehicle driver 360 further includes a positioning device 308*a* which may be or include a positioning sensor and a correlation device 308*b* which may be or include a correlation sensor, as explained below. The vehicle driver 360 is generally the collection of components, connections, and logic that is responsible for controlling the autonomous or semi-autonomous operation of the untethered drone 300. In the exemplary embodiment shown in FIGS. 3A and 3B, the vehicle driver 360 is primarily housed and protected within the tail portion 330, while one or more connections 309 to the vehicle driver 360 or individual components of the vehicle driver 360 are exposed and configured for forming an electrical connection with, e.g., a power supply or relay and an electronic signal or relay. In the same or other embodiments, one or more components of the vehicle driver 360 and corresponding connections may be located in the head portion 320 or other portions of the untethered drone 300 as consistent with this disclosure. As a non-limiting example, the external contact point 309 may connect to an external power supply 524 (FIG. 5) and the onboard computer 390 may connect to a control unit 1030 (FIG. 10) when the untethered drone 300 is at a surface 1001 (FIG. 10) of the wellbore 1070 before it is launched into the wellbore 1070. In this fashion, the external power supply 524 may power the onboard computer 390 and thereby allow the control unit 1030 to teach the onboard computer 390 when the untethered drone 300 is at the surface 1001. For purposes of this disclosure, the term "teach" generally means to provide the untethered drone 300 (e.g., via the onboard computer 390 and/or other components of the vehicle driver 360) with information regarding, for example and without limitation, the wellbore and/or instructions for controlling at least one operation of the untethered drone 300. The control unit 1030 may teach the untethered drone 300 one or more of, for example and without limitation, a profile of the wellbore 1070, an order of launching a series of untethered drones into the wellbore 1070, and a selective sequence signal including one or more of an arming instruction, a detonation instruction, a detonation code, and an encrypted trigger signal. For safety reasons, the external power supply 524 and vehicle driver 360 are configured such that the external power supply 524 powers only the control circuitry when the untethered drone 300 is at the surface 1001 of the wellbore 1070. The external power supply 524 does not power any explosive systems or circuits associated with detonating the shaped charges 340. The explosive circuits may only be powered by the onboard battery 520, because the onboard battery 520 in the exemplary embodiments will not provide power to the explosive circuits until the untethered drone 300 is armed under conditions within the wellbore 1070. These and other aspects of the vehicle driver 360 and use of the exemplary untethered drones 300 are discussed in additional detail, below, with respect to (among other things) an untethered drone string 400 (FIG. 4) and a battery/onboard computer component 500 (FIG. 5).

The exemplary embodiment shown in FIG. 3B may also include appropriate seals, stand-offs, or other components for, e.g., protecting the vehicle driver components and connections from harsh wellbore conditions, electrically isolating different components, preventing wellbore fluid from infiltrating the interior of the tail portion 330, etc. Such components including their selection and use are known in oil and gas operations, among other industries.

Figure 11:
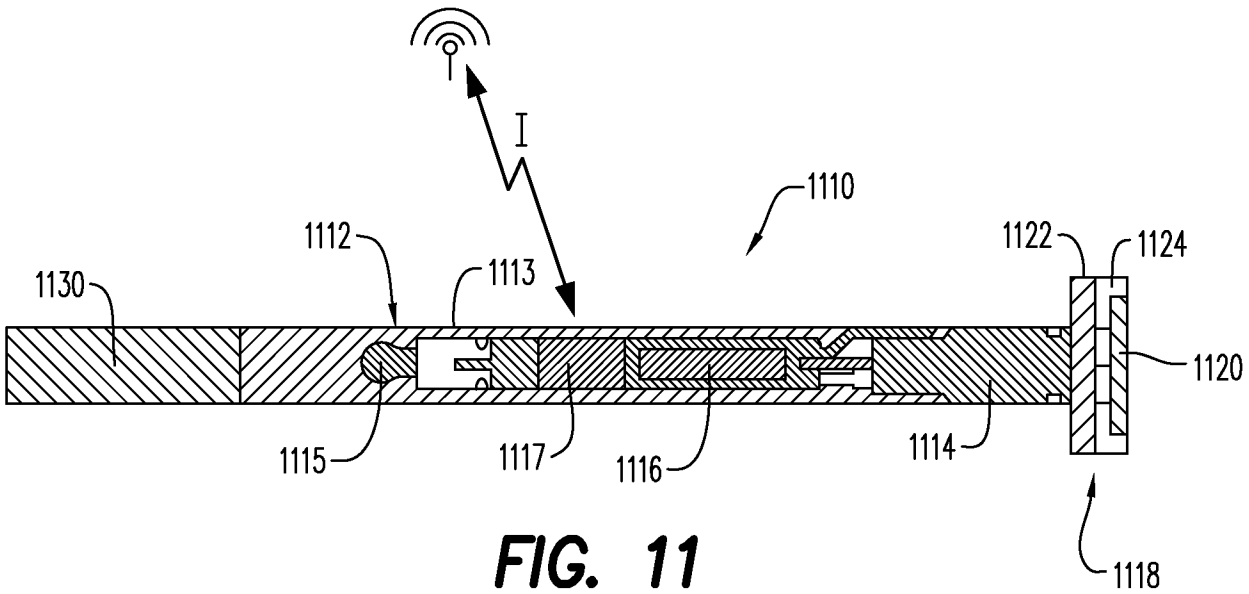
FIG. 11 is a cross-sectional view of a wire-free detonator for use with the untethered drone according to an exemplary embodiment.

With reference now specifically to the detonator 307, the exemplary untethered drone 300 shown in FIGS. 3A and 3B may include a wire-free detonator assembly 1110 as shown in FIG. 11 and further described in U.S. Pat. No. 9,581,422 which is incorporated herein by reference in its entirety. In the exemplary wire-free detonator assembly 1110 shown in FIG. 11, a detonator shell 1112 is shaped as a hollow cylinder and houses at least a detonator head plug 1114, a fuse head 1115, an electronic circuit board 1116, and explosive components 1130. The electronic circuit board 1116 is connected to the fuse head 1115 and is configured for allowing selective detonation of the detonator assembly 1110. As further discussed below with respect to FIG. 4, in an aspect, the electronic circuit board 1116 may receive one or more of, without limitation, a selective ignition signal I, a detonation signal, an addressing signal, and an arming signal as a digital code uniquely configured for a specific detonator, and/or sent selectively from a control component, such as a control circuit, and including a selective sequence signal received and relayed and/or processed by the control component, to fire a perforating gun. In the exemplary disclosed embodiments of an untethered drone 300 as shown, for example, in FIGS. 3A and 3B, the selective ignition signal I may be provided from the onboard computer 390 or via a wireless electrical contact connection to the onboard computer 390, as explained below. As discussed above, the untethered drone 300 at the surface 1001 of the wellbore 1070 may be taught, among other things, the selective sequence signal for its detonator 307. This improves safety, as the onboard computer 390 (or other control component) would not have the requisite signal information for activating the detonator 307 in storage, transit, etc.

With continuing reference to FIG. 11, a detonator head 1118 extends from one end of the detonator shell 1112 and includes more than one electrical contacting component including an electrically contactable line-in portion 1120 and an electrically contactable line-out portion 1122, according to an aspect. According to another aspect, the detonator assembly 1110 may also include an electrically contactable ground portion 1113. The detonator head 1118 may be disk-shaped. In an aspect, at least a portion of the detonator shell 1112 is configured as the ground portion 1113. The detonator head 1118 also includes an insulator 1124, which is positioned between the line-in portion 1120 and the line-out portion 1122. The insulator 1124 functions to electrically isolate the line-in portion 1120 from the line-out portion 1122. Insulation may also be positioned between other lines of the detonator head 1118. It is possible for all of the contacts to be configured as part of the detonator head 1118 (not shown), as found, for instance, in a banana connector used in a headphone wire assembly in which the contacts are stacked longitudinally along a central axis of the connector, with the insulating portion situated between them.

In the exemplary wire-free detonator assembly 1110, a capacitor 1117 is positioned or otherwise assembled as part of the electronic circuit board 1116. The capacitor 1117 is configured to be discharged to initiate the detonator assembly 1110 upon receipt of a digital firing sequence via the ignition signal I, the ignition signal I being electrically relayed directly through the line-in portion 1120 and the line-out portion 1122 of the detonator head 1118. The fuse head 1115 initiates the explosive load 1130. In a typical arrangement, a first digital code is received by the electronic circuit board 1116. Once it is confirmed that the first digital code is the correct code for that specific detonator assembly, an electronic gate is closed and the capacitor 1117 is charged. Then, as a safety feature, a second digital code is received by the electronic circuit board 1116. The second digital code, which is also confirmed as the proper code for the particular detonator, closes a second gate, which in turn discharges the capacitor 1117 via the fuse head 1115 to initiate the detonation.

With reference now back to the exemplary embodiment shown in FIGS. 3A and 3B, the untethered drone 300 further includes a deactivating safety device 380 for preventing activation of the arming/detonating mechanisms (including electronics) discussed above. In the exemplary embodiment, the deactivating safety device 380 is in the form of a tab that must be removed from the untethered drone 300 before the onboard battery 520 can begin supplying power to any of the onboard components of the untethered drone 300. For example, the tab 380 may be an insulator, shunt, or mechanical device that prevents an electrical connection between the battery 520 and control components including without limitation the onboard computer 390, a trigger circuit 530 (FIG. 5), and one or more onboard sensors (not shown) that may initiate the explosive circuits when certain conditions are sensed as discussed below with respect to FIG. 5. For safety reasons, it is important that the tab 380 is not removed until the untethered drone 300 is on its way downhole. Thus, in an exemplary method, the tab 380 may be removed by, for example and without limitation, a structure that mechanically snags or removes the tab 380 in the entrance to the wellbore 1070 as the untethered drone 300 is being deployed therethrough. In other embodiments, the tab 380 may be configured to dislodge or disintegrate in the fluid flow, temperatures, pressures, or other conditions inside the wellbore 1070. In still further embodiments, the deactivating safety device 380 may be a switch, a sensor, or generally any mechanism or component that may be e.g., actuated, initiated, or disabled in a manner consistent with this disclosure.

Figure 4:
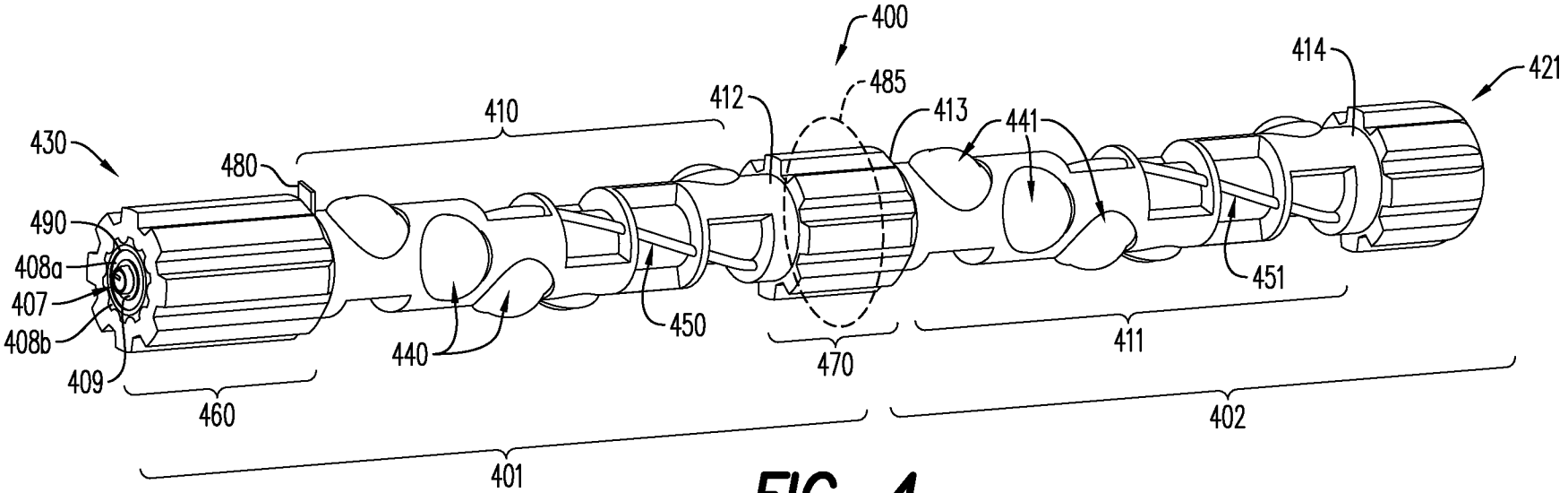
FIG. 4 is a perspective view of an untethered drone string according to an exemplary embodiment.
Figure 5:
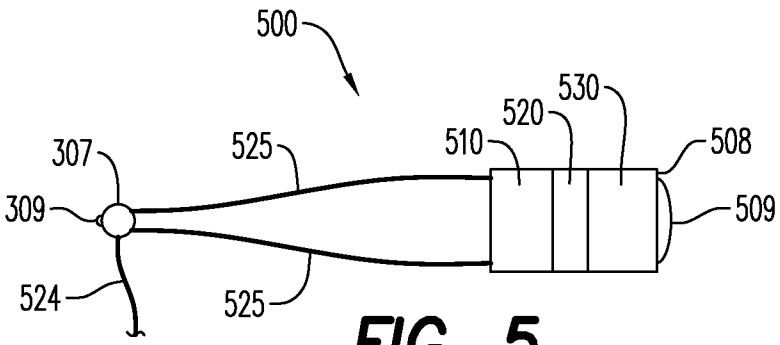
FIG. 5 shows an onboard computer/battery/trigger mechanism assembly according to an exemplary embodiment.

With reference now to FIG. 4, an exemplary untethered drone string 400 is shown. Two or more untethered drones 401, 402 may be connected to form an untethered drone string 400. Each of a first untethered drone 401 and a second untethered drone 402 includes a body portion 410, 411 as described above with respect to the exemplary untethered drone 300 shown in FIGS. 3A and 3B. The first untethered drone 401 has a tail portion 430 including a vehicle driver 460 and various components such as a detonator 407, a positioning device 408*a*, a correlation device 408*b*, an external contact 409, and an onboard computer 490. Each of the first untethered drone 401 and the second untethered drone 402 carries shaped charges 440, 441 in the body portion 410, 411 as discussed with respect to FIGS. 3A and 3B.

The first untethered drone 401 does not include a head portion and the second untethered drone 402 does not include a tail portion. Instead, each of the first untethered drone 401 and the second untethered drone 402 is respectively connected to a drone connector 470 at a front end 412 of the first untethered drone 401 and a rear end 413 of the second untethered drone 402. Each of the first untethered drone 401 and the second untethered drone 402 may be connected to the drone connector 470 by any known techniques that are capable of withstanding the wellbore conditions, including high temperatures, pressures, corrosivity, etc. In an exemplary embodiment, the connection between the drone connector 470 and each of the first untethered drone 401 and the second untethered drone 402 is a threaded connection. In another exemplary embodiment, the body portions 410, 411 of the first untethered drone 401 and the second untethered drone 402 are integrally formed with the drone connector 470. The drone connector 470 is formed from either the same material as the untethered drones 401, 402 or a different material that will substantially disintegrate after detonation of the shaped charges 440, 441.

The drone connector 470 includes an interior portion (not visible) that may be at least partially hollow to form cavities in which the body portions 410, 411 of the first untethered drone 401 and the second untethered drone 402 are received. In an exemplary embodiment, the interior portion of the drone connector 470 includes at least one electrical connector (not visible). The electrical connector is configured for providing an electrical contact between the first untethered drone 401 and the second untethered drone 402 when the first and second untethered drones 401, 402 are connected to the drone connector 470. For example, the electrical connector may be a conductive relay configured for being in electrical contact on a first side with a conductive detonating cord 450 of the first untethered drone 401 and on a second side with a conductive detonating cord 451 of the second untethered drone 402. Accordingly, the respective conductive detonating cords 450, 451 may relay an electrical signal along a length of each of the first and second untethered drones 401, 402. The conductive detonating cord 450 of the first untethered drone 401 may relay the electrical signal from the external contact 409 to the electrical connector within the drone connector 470. The conductive detonating cord 451 of the second untethered drone 402 may then relay the electrical signal from the electrical connector within the drone connector 470 to the terminus of the conductive detonating cord 451 in the head portion 421 of the second untethered drone 402. In the event that an untethered drone string 400 having three or more untethered drones is desired, the additional untethered drones may be connected in the same way as described above, excepting that intermediate untethered drones between the two endmost untethered drones will have neither a head portion 421 nor a tail portion 430, and the body portion of each intermediate untethered drone will have a front end and a rear end respectively configured for connecting to a drone connector 470.

The drone connector 470 may further include a blast barrier 485. The blast barrier 485 may be configured for shielding the first untethered drone 401 from detonation of the second untethered drone 402, including, for example and without limitation, a shock wave, incendiary effect, or debris from the second untethered drone 402 that may disable, destroy, or disintegrate the first untethered drone 401. The blast barrier 485 may be generally any shape consistent with this disclosure and may be formed from a variety of materials consistent with this disclosure, such as metals and plastics and combinations of those materials.

The untethered drone string 400 may also include/constitute one or more wellbore tools connected to one or more untethered drones for downhole delivery. In such untethered drone strings, the connection(s) between wellbore tools and untethered drones may be configured in the same manner as connections between untethered drones. The one or more wellbore tools may include, for example and without limitation, frac plugs, bridge plugs, tubing cutters, data collection devices, other wellbore tools disclosed herein, and other known wellbore tools consistent with this disclosure.

In use, the first untethered drone 401 may be the "upstream" or topmost untethered drone in the untethered drone string 400; i.e., the untethered drone that includes the tail portion 430 and the vehicle driver 460. When the untethered drone string 400 is at the surface 1001 of the wellbore 1070, an external power supply 524 may be connected to the external contact 409 to provide power for the onboard computer 490. The onboard computer 490 may be connected to the control unit 1030 such that the control unit can teach the onboard computer 490 one or more of, for example and without limitation, a profile of the wellbore 1070, an order of launching a series of untethered drones into the wellbore 1070, a selective sequence signal including one or more of an arming instruction, a detonation instruction, a detonation code, and an encrypted trigger signal. As previously discussed, for safety reasons the external power supply 524 and the onboard computer 490 are configured such that the external power supply 524 can only power the control circuitry of the onboard computer 490 when the untethered drone string 400 is at the surface 1001.

When the untethered drone string 400 is ready for launching into the wellbore 1070, the external power supply 524 and the control unit 1030 are disconnected respectively from the external contact 409 and the onboard computer 490. The untethered drone string 400 is then placed inside a wellhead or other launching mechanism. When the untethered drone string 400 is launched into the wellbore 1070 an exemplary deactivating safety device 480 in the form of a removable tab is removed by, for example and without limitation, a mechanical implement that snags the tab 480 after it passes through the wellhead or launching mechanism, or a force such as a shear force that the wellbore fluid creates against the untethered drone string 400. Removing the tab 480 provides a potential for the battery 520 and other onboard components to begin communicating, although additional safety and operational measures may be in place to prevent arming the device prematurely. Exemplary safety and operational measures are discussed below with respect to FIG. 5.

According to a further aspect, an electrical selective sequence signal may be sent from the vehicle driver 360 (e.g., via the onboard computer 409 and/or trigger circuit 530) to the detonator 407 when the untethered drone string 400 reaches at least one of a threshold pressure, temperature, horizontal orientation, inclination angle, depth, distance traveled, rotational speed, and position within the wellbore. The threshold conditions may be measured by any known devices consistent with this disclosure including a temperature sensor, a pressure sensor, a positioning device 408*a* such as a gyroscope and/or accelerometer (for horizontal orientation, inclination angle, and rotational speed), and a correlation device 408*b* such as a casing collar locator (CCL) or position determining system (for depth, distance traveled, and position within the wellbore) as discussed below with respect to FIGS. 14A-17. Moreover, as previously discussed, the threshold values and other instructions for addressing, arming, and detonating the untethered drone string 400 may be taught to the untethered drone string 400 (i.e., the onboard computer connection 409) by the control unit 1030 at the surface 1001 of the wellbore 1070 before the untethered drone string 400 is launched into the wellbore 1070.

Figure 10:
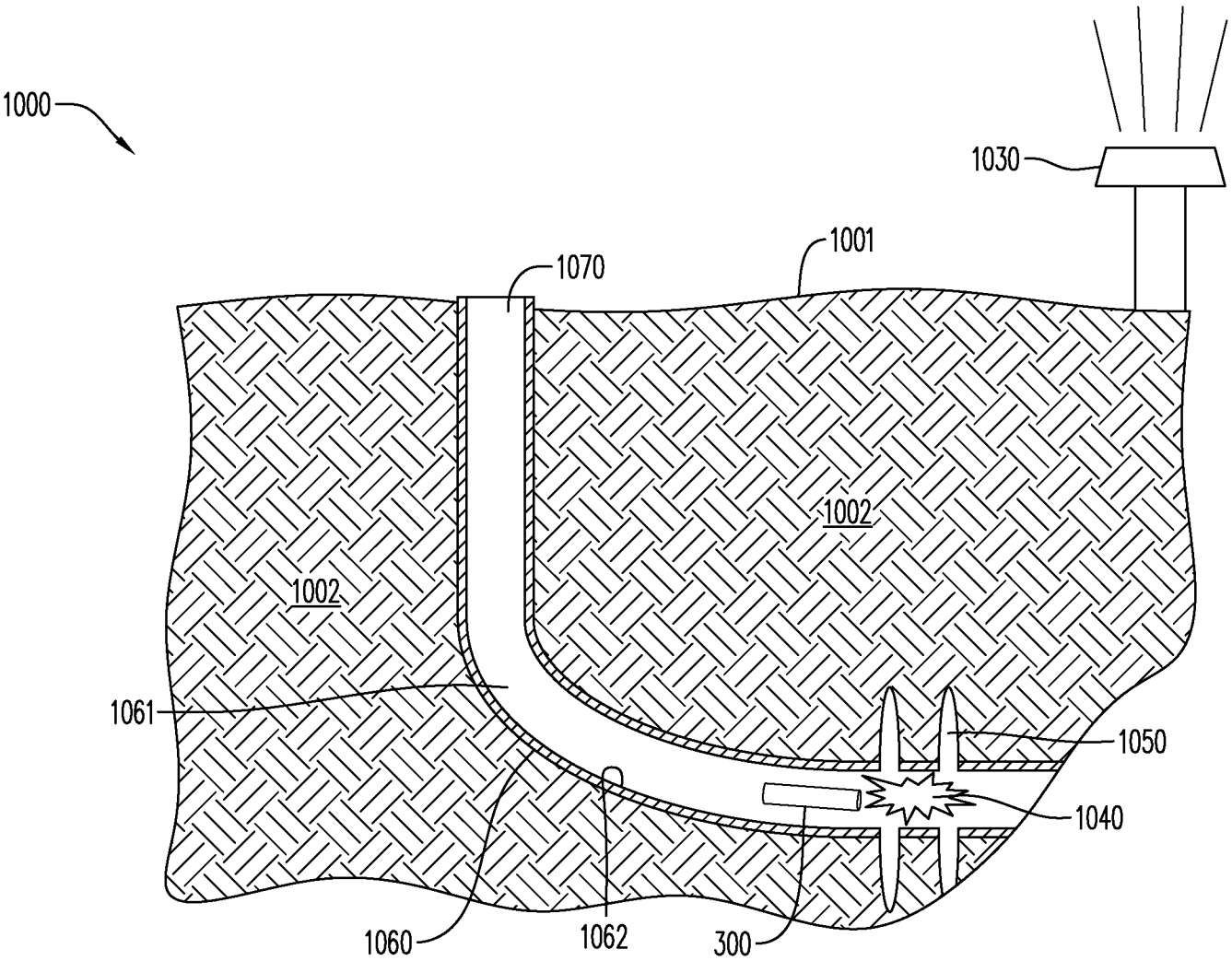
FIG. 10 illustrates a wellbore perforating system according to an exemplary embodiment.
Figure 14B:
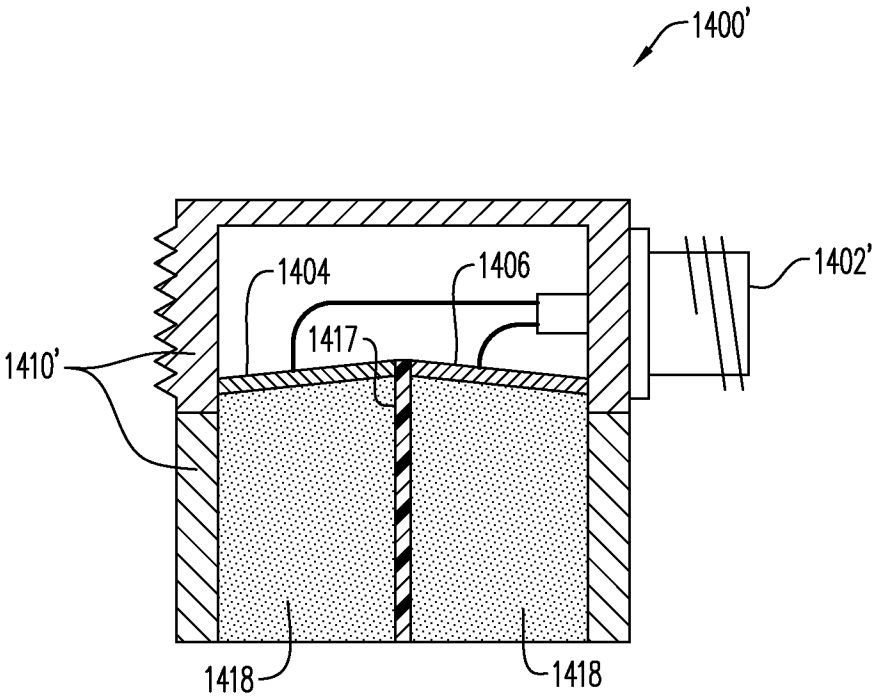
FIG. 14B is a cross-sectional, side plan view of an ultrasonic transceiver utilized in an embodiment.
Figure 14A:
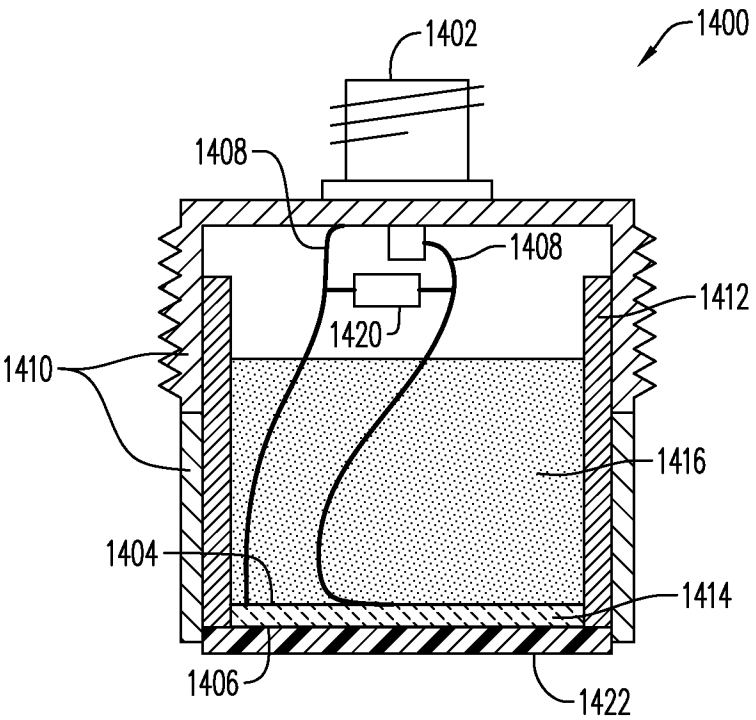
FIG. 14A is a cross-sectional, side plan view of an ultrasonic transceiver utilized in an embodiment.

FIG. 14A is a cross-section of an ultrasonic transducer 1400 that may be used in a system and method of determining location along a wellbore 1070 (as seen, for instance, in FIG. 10). The transducer 1400 may include a housing 1410 and a connector 1402; the connector 1402 is the portion of the housing 1410 allowing for connections to the onboard computer/control circuit 390 that may generate and interpret the ultrasound signals. The key elements of the transducer 1400 are a transmitting element 1404 and a receiving element 1406 that are contained in the housing 1410. In the transducer shown in FIG. 14A, the transmitting element 1404 and the receiving element 1406 are integrated into a single active element 1414. That is, the active element 1414 is configured to both transmit an ultrasound signal and receive an ultrasound signal. Electrical leads 1408 are connected to electrodes on the active element 1414 and convey electrical signals to/from the onboard computer/control circuit 390. An electrical network 1420 may be connected between the electrical leads 1408. Optional elements of a transducer include a sleeve 1412, a backing 1416 and a cover/wearplate 1422 protecting the active element 1414.

FIG. 14B is a cross-section of an alternative version of an ultrasonic transducer 1400' that may be used in a system and method of determining location along a wellbore 1070. The transducer 1400' may include a housing 1410' and a connector 1402'; the connector 1402' is the portion of the housing 1410' allowing for connections to the onboard computer/control circuit 390 that may generate and interpret the ultrasound signals. The key elements of the transducer 1400' are a transmitting element 1404' and a receiving element 1406' that are contained in the housing 1410'. A delay material 1418 and an acoustic barrier 1417 are provided for improving sound transmission and receipt in the context of a separate transmitting element 1404' and receiving element 1406' apparatus.

Figure 15:
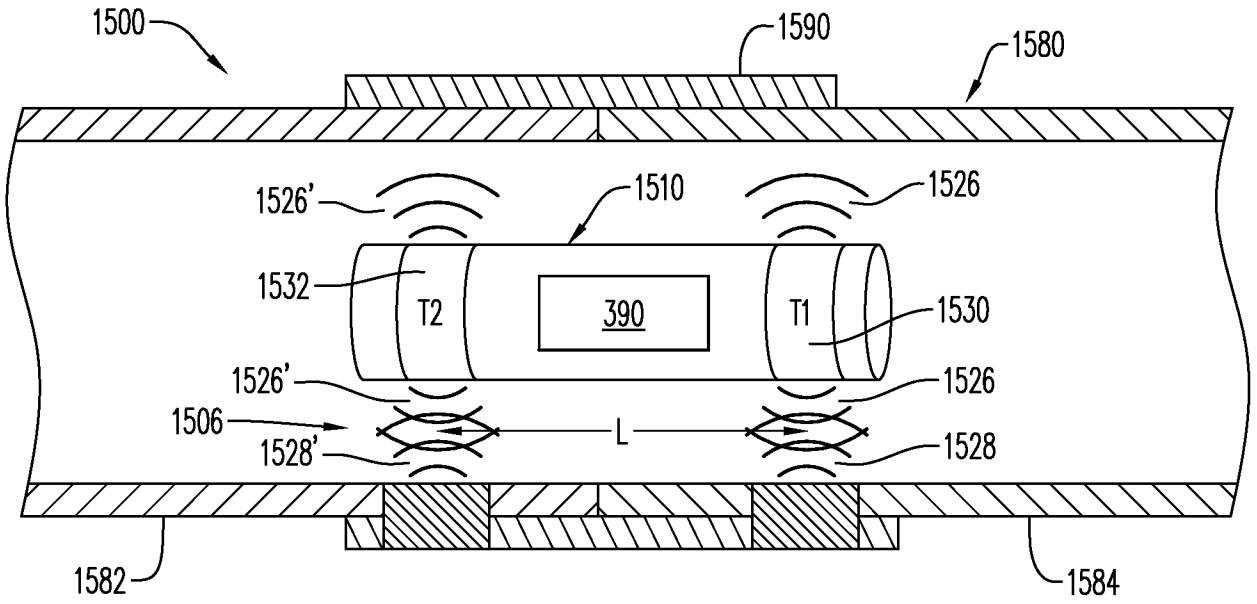
FIG. 15 is a cross-sectional plan view of a two ultrasonic transceiver based navigation system of an embodiment.

With additional reference to FIG. 15, an exemplary untethered drone 1510 as part of an ultrasonic transducer system 1500 for determining the speed of the untethered drone 1510 traveling down a wellbore 1070 by identifying ultrasonic waveform changes is shown. As depicted in FIG. 15, an untethered drone 1510 may be equipped with one or more ultrasonic transducers 1530, 1532. In an embodiment, the untethered drone 1510 has a first transducer 1530 (also marked T1) and a second transducer 1532 (also marked T2), one at each end of the untethered drone 1510. The distance separating the first transducer 1530 from the second transducer 1532 is a constant and may be referred to as distance 'L'. Each of the first transducer 1530 and the second transducer 1532 may have a transmitting element 1404 and a receiving element 1406 (as shown in FIGS. 14A and 14B) that sends/receives signals radially from the untethered drone 1510. In an embodiment, each transmitting element 1404 and receiving element 1406 may be disposed about an entire radius of the untethered drone 1510; such an arrangement permits the transmitting element 1404 and the receiving element 1406 respectively to send and receive signals about essentially the entire radius of the untethered drone 1510.

The exemplary untethered drone shown in FIG. 15 includes the first ultrasonic transceiver 1530 and the second ultrasonic transceiver 1532. Each of the first ultrasonic transceiver 1530 and the second ultrasonic transceiver 1532 is capable of detecting alterations in the medium through which the untethered drone 1510 is traversing by transmitting an ultrasound signal 1526, 1526' and receiving a return ultrasound signal 1528, 1528'. Changes in the material and geometry of the wellbore casing 1580 and other material external to wellbore casing 1580 will often result in a substantial change in the return ultrasound signal 1528, 1528' received by receiving element 1406 and conveyed to the onboard computer/control circuit 390.

With continuing reference to FIG. 15, because T2 1532 is axially displaced from T1 1530 along the long axis of the untethered drone 1510, T2 1532 passes through an anomaly in the wellbore 2016 at a different time than T1 1530 as the untethered drone 1510 traverses the wellbore 2016. Put another way, assuming the existence of an anomalous point 1506 along the wellbore, T1 1530 and T2 1532 pass the anomalous point 1506 in wellbore 1070 at slightly different times. In the event that T1 1530 and T2 1532 both register a sufficiently strong and identical, i.e., repeatable, modified return signal as a result of an anomaly at the anomalous point 1506, it is possible to determine the time difference between T1 1530 registering the anomaly at the anomalous point 1506 and T2 1532 registering the same anomaly. The distance L between T1 1530 and T2 1532 being known, a sufficiently precise measurement of time between T1 1530 and T2 1532 passing a particular anomaly provides a measure of the velocity of the untethered drone 1510, i.e., velocity equals change in position divided by change in time. Utilizing the typically safe presumption that an anomaly is stationary, the velocity of the untethered drone 1510 through the wellbore 2016 is available every time the untethered drone 1510 passes an anomaly that returns a sufficient change in amplitude of a return signal for each of T1 1530 and T2 1532.

The potential exists for locating ultrasonic transceiver T1 1530 and ultrasonic transceiver T2 1532 in different portions of untethered drone 1510 and connecting them electrically to onboard computer/control circuit 390. As such, it is possible to increase the axial distance L between T1 1530 and T2 1532 almost to the limit of the total length of the untethered drone 1510. Placing T1 1530 and T2 1532 further away from one another achieves a more precise measure of velocity and retains precision more effectively as higher drone velocities are encountered, especially where sample rate for T1 1530 and T2 1532 reach an upper limit.

Figure 16:
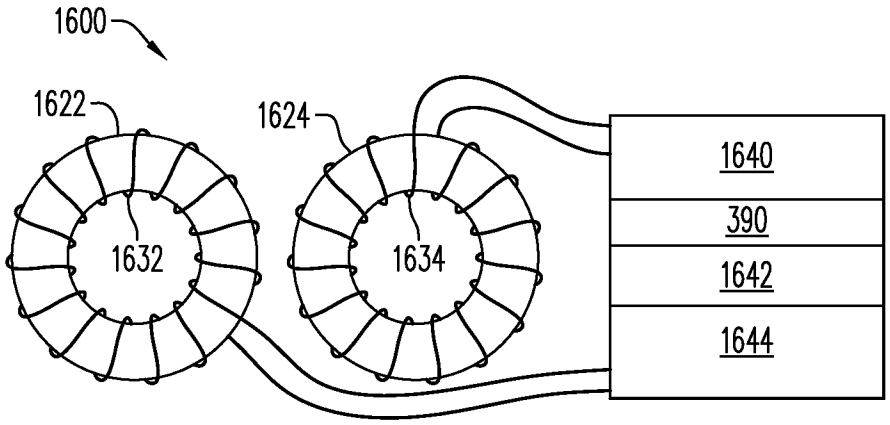
FIG. 16 is a plan view of a navigation system of an embodiment.

In an exemplary embodiment of a navigation system 1600 such as used in the ultrasonic transducer system 1500 shown in FIG. 15, two wire coils 1632, 1634 are respectively used with the transceivers 1530, 1532. As seen in FIG. 16, a signal generating and processing unit 1640 is attached to both ends of a first coil 1632 wrapped around a first core 1622 of high magnetic permeability material and a second coil 1634 wrapped around a second core 1624 of high magnetic permeability material. As discussed previously, although the cores 1622, 1624 and the coils 1632, 1634 are presented in FIG. 16 as toroidal in shape, other shapes are possible. The first coil 1632 and the second coil 1634 of the exemplary embodiment shown in FIG. 15 and FIG. 16 are configured coplanar to one another. Since a toroidal coil defines a plane, the magnetic field established by such a coil possesses a structure related to this plane. Changes in magnetic permeability occurring coplanar to the plane of the toroidal coil will have greater effect on the coil's inductance than changes that are not coplanar. Changes in magnetic permeability in a plane perpendicular to the plane of the coil may have little to no impact on the coil's inductance value. As previously described, the exemplary ultrasonic transducer system 1500 may register the same anomaly, i.e., change in magnetic permeability, once for each coil 1632, 1634. In this configuration, having the coils 1632, 1634 disposed on the same plane may achieve this result.

The processing unit 1640 may include an oscillator circuit 1644 and a capacitor 1642. An oscillating signal is generated by the oscillator circuit 1644, and sent to the wire coils 1632, 1634. With the wire coils 1632, 1634 acting as inductors, a magnetic field is established around the wire coils 1632, 1634 when charge flows through the wire coils 1632, 1634. Insertion of the capacitor 1642 in the processing unit 1640 results in constant transfer of electrons between the wire coils/inductors 1632, 1634 and the capacitor 1642, i.e., in a sinusoidal flow of electricity between the wire coils 1632, 1634 and the capacitor 1642. The frequency of this sinusoidal flow will depend upon the capacitance value of the capacitor 1642 and the magnetic field generated around the wire coils 1632, 1634, i.e., the inductance value of the wire coils 1632, 1634. The peak strength of the sinusoidal magnetic field around the wire coils 1632, 1634 will depend on the materials immediately external to the wire coils 1632, 1634. With the capacitance of the capacitor 1642 being constant and the peak strength of the magnetic field around the wire coils 1632, 1634 being constant, the circuit will resonate at a particular frequency. That is, current in the circuit will flow in a sinusoidal manner having a frequency, referred to as a resonant frequency, and a constant peak current.

With reference now back to FIG. 4, in various embodiments, and without limitation, the onboard computer 409 via, e.g., a control circuit, may relay, or determine based on a selective sequence signal to transmit, the selective sequence signal to one or more selected selective detonators in the untethered drone string 400. The selective sequence signal may include, without limitation, a sequence of signals including a first signal to address the selected selective detonator (e.g., by drone) being selected for detonation, a second signal for arming the selected selective detonator by, e.g., initiating charging a capacitor or other firing initiator of the selected selective detonator, and a third signal for detonating the selected selective detonator by discharging the capacitor or other firing mechanism of the selected selective detonator. In an aspect, the selective sequence signal may be one or more digital codes including or more digital codes uniquely configured for the selected selective detonator. For example, and without limitation, the selective sequence signal may include a unique first signal to uniquely address the selected selective detonator, while an arming signal and a detonation signal may not be unique to the selected selective detonator. In some embodiments, each signal in a selective sequence signal may be unique to the selected selective detonator. In other embodiments, a single selective sequence signal may uniquely instruct the selected selective detonator to receive the signal and perform each of the arming and detonation. The electronic circuit board 1116 of the selected selective detonator may be programmed for carrying out any such particular selective detonation sequence. In an aspect of the exemplary embodiments, the control circuit may relay through the untethered drone string 400, e.g., via the line-in 1120, the line-out 1122, and the conductive line of each selective detonator and untethered drone in series, a selective sequence signal including at least an addressing signal unique to a selected selective detonator. In this aspect, only the selective detonator associated with the unique addressing signal will accept the code and follow any further arming and/or detonation instructions.

The untethered drone string 400 use discussed above is a non-limiting representative use for individual untethered drones 300 and wellbore tools as well. Exemplary wellbore tools as discussed above include a bridge plug, a frac plug, a tubing cutter, and the like. The mechanisms, measurements, safety measures, and order of steps in the process may be varied and adapted to various applications without departing from the scope of this disclosure.

In an additional aspect of the exemplary untethered drone string 400 use, the selective sequence signal as discussed above is received at the line-in portion 1120 of the detonator assembly 1110 for the first untethered drone 401 and provided to the electronic circuit board 1116 of that detonator assembly. The selective sequence signal may include the unique addressing signal for the selected selective detonator. If the unique addressing signal does not match the stored address code of that detonator assembly, the detonator will not activate. The conductive detonating cord 450 of the first untethered drone 401 will relay the selective sequence signal from the line-out portion 1122 of the detonator assembly 1110 to the line-in portion of a detonator assembly for the second untethered drone 402, via the electrical connector in the drone connector 470. If the selective sequence signal corresponds, according to the unique addressing signal, to the detonator assembly of the second untethered drone 402, the detonator will activate and ballistically initiate the conductive detonating cord 451 to detonate the shaped charges 441 that the second untethered drone 402 carries. The process will repeat for each untethered drone and/or wellbore tool in the untethered drone string 400. According to the exemplary embodiment of the untethered drone 300, each untethered drone 401, 402 in the untethered drone string 400 may be formed from an injection-molded plastic material that will substantially disintegrate and/or dissolve into a proppant upon detonation of the shaped charges 440, 441, thereby reducing the amount of debris generated by successive detonations of the untethered drones 401, 402.

Notably, the configuration of the untethered drone string 400 and, in particular, the conductive line (for example, in the conductive detonating cord 450, 451 of the exemplary embodiments) allows a single power source, such as a single battery 520 in the vehicle driver 460 at the top of the untethered drone string 400, to provide power to each untethered drone 401, 402 and/or wellbore tool in the untethered drone string 400. The power may be relayed between each untethered drone 401, 402 and/or wellbore tool via the conductive detonating cords 450, 451 in the same manner as, e.g., the selective sequence signal. Similarly, a single vehicle driver 460 can be used to control each untethered drone 401, 402 and wellbore tool in the untethered drone string 400 because, for example, arming and detonation instructions for each untethered drone 401, 402 and wellbore tool may be relayed from the vehicle driver 460 to downstream drones/tools via the conductive detonating cords 450, 451. In some embodiments, the vehicle driver 460 may wirelessly relay electrical signals including a selective sequence signal to each untethered drone in an untethered drone string, for example via a Bluetooth connection.

With reference now to FIG. 5, an exemplary onboard assembly 500 for the untethered drone 300 includes an onboard battery 520 in electrical communication with each of an onboard computer 510 and a trigger circuit 530. When the untethered drone 300 becomes armed, for example by removing a deactivating safety device 380, the battery 520 provides power to the onboard computer 510 for controlling autonomous or semi-autonomous operation of the untethered drone and to the trigger circuit 530 for activating the detonator 307 at the appropriate time. In addition, one or more of the battery 520, the onboard computer 510, and the trigger circuit 530 may be electrically connected to the external contact point 309 and/or the detonator 307 via leads 525, and to one or more driver contact points 508, 509. Different leads 525 and driver contact points 508, 509 may have different functions, for example transmitting power versus electrical signals. This disclosure does not limit the number or nature of the connections.

The leads 525 and the driver contact points 508, 509 may be connected further to various vehicle driver 360 components including without limitation a central processing unit (CPU) (the CPU may also be integral with the onboard computer) and at least one sensor including a temperature sensor, a pressure sensor, a positioning device 308*a*, and a correlating sensor 308*b*. Moreover, the onboard assembly 500 may connect to an engine 645 (FIG. 6B) and the engine 645 may include a centralizing device 650 (FIG. 6B) as described below with respect to FIG. 6B. Even further, in certain embodiments having a separate detonating cord 350 and a conductive line, the onboard assembly 500 may be connected to a downstream untethered drone in an untethered drone string 400 and a driver contact point 508 may be connected to the conductive line.

The external connection 309 and onboard assembly 500 are configured for receiving an external power supply 524 when the untethered drone 300 is at the surface 1001 of the wellbore 1070, before the untethered drone 300 is launched into the wellbore 1070. In an aspect, the onboard assembly 500 is configured such that the external power supply 524 is only provided to control circuits (i.e., circuits that are responsible for, e.g., data and instructions for non-explosive systems). Accordingly, the control unit 1030 may teach the untethered drone 300 information such as described herein above and the like when the external power supply 524 and the control unit 1030 are connected to the untethered drone 300 at the wellbore surface 1001. As previously discussed, the information may include a selective sequence signal including one or more of a unique arming instruction, detonation instruction, and/or detonation code for each individual untethered drone. The ability to provide such unique information after the untethered drone 300 is on site and shortly before it is launched into the wellbore 1070 provides additional safety against inadvertent or malicious triggers of the arming and/or detonation circuits.

Figure 17:
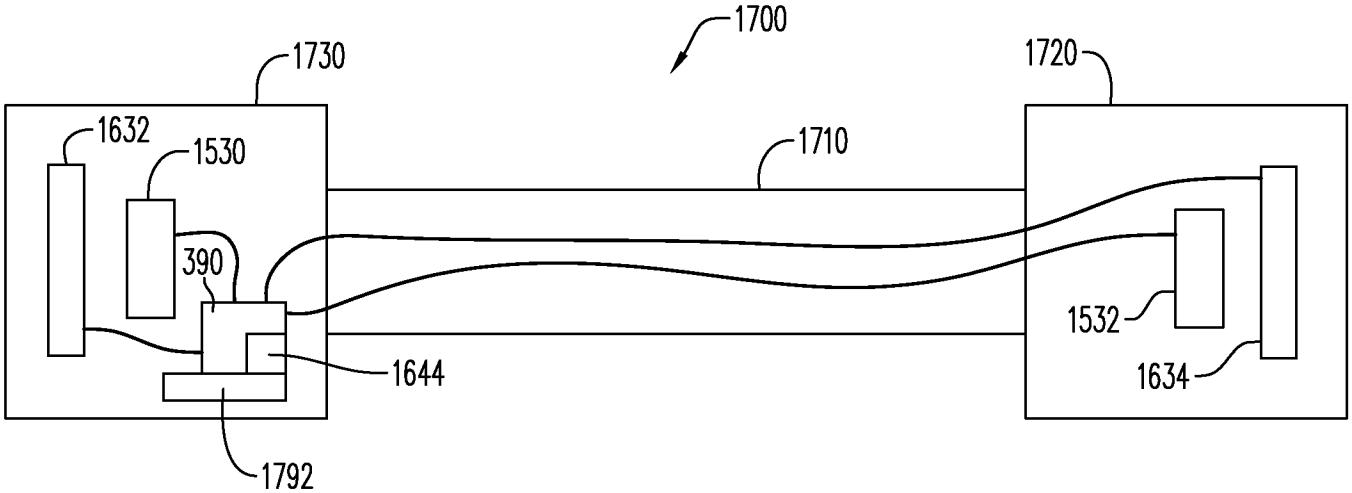
FIG. 17 is a block diagram, cross sectional view of a drone in accordance with an embodiment.

With reference to FIG. 17 a schematic cross-sectional view of an untethered drone 1700 as generally described throughout this disclosure is shown. For example, the untethered drone 1700 may take the form of the perforating gun untethered drone 300 shown in FIGS. 3A and 3B, among others. For example, the body portion 1710 of the untethered drone 1700 may bear one or more shaped charges. As is well-known in the art, detonation of the shaped charges is typically initiated with an electrical pulse or signal supplied to a detonator. The detonator of the perforating gun embodiment 1700 shown in FIG. 17 and generally with respect to the exemplary embodiments of an untethered drone as described throughout this disclosure—e.g., in FIGS. 3A and 3B, among others—may be located in the body portion 1710 or adjacent the intersection of the body portion 1710 and the head portion 1720 or the tail portion 1730 to initiate the shaped charges either directly or through an intermediary structure such as a detonating cord.

As would be understood by one of ordinary skill in the art, electrical power typically supplied via the wireline cable 2012 to wellbore tools, such as a tethered drone or typical perforating gun, would not be available to an untethered drone as described herein and shown in FIG. 17. In order for all components of the untethered drone 1700 to be supplied with electrical power, a power supply 1792 may be included as part of the untethered drone 1700. The power supply 1792 may occupy any portion of the untethered drone 1700, i.e., one or more of the body portion 1710, the head portion 1720 or the tail portion 1730. It is contemplated that the power supply 1792 may be disposed so that it is adjacent any components of the untethered drone 1700 that require electrical power.

The on-board power supply 1792 for the untethered drone 1700 may take the form of an electrical battery (e.g., battery 520); the battery may be a primary battery or a rechargeable battery. Whether the power supply 1792 is a primary or rechargeable battery, it may be inserted into the untethered drone 1700 at any point during construction of the untethered drone 1700 or immediately prior to insertion of the untethered drone 1700 into the wellbore 1070. If a rechargeable battery is used, it may be beneficial to charge the battery immediately prior to insertion of the untethered drone 1700 into the wellbore 1070. Charge times for rechargeable batteries are typically on the order of minutes to hours.

In an embodiment, another option for the power supply 1792 is the use of a capacitor or a supercapacitor. A capacitor is an electrical component that consists of a pair of conductors separated by a dielectric. When an electric potential is placed across the plates of a capacitor, electrical current enters the capacitor, the dielectric stops the flow from passing from one plate to the other plate and a charge builds up. The charge of a capacitor is stored as an electric field between the plates. Each capacitor is designed to have a particular capacitance (energy storage). In the event that the capacitance of a chosen capacitor is insufficient, a plurality of capacitors may be used. When a capacitor is connected to a circuit, a current will flow through the circuit in the same way as a battery. That is, when electrically connected to elements that draw a current the electrical charge stored in the capacitor will flow through the elements. Utilizing a DC/DC converter or similar converter, the voltage output by the capacitor will be converted to an applicable operating voltage for the circuit. Charge times for capacitors are on the order of minutes, seconds or even less.

A supercapacitor operates in a similar manner to a capacitor except there is no dielectric between the plates. Instead, there is an electrolyte and a thin insulator such as cardboard or paper between the plates. When a current is introduced to the supercapacitor, ions build up on either side of the insulator to generate a double layer of charge. Although the structure of supercapacitors allows only low voltages to be stored, this limitation is often more than outweighed by the very high capacitance of supercapacitors compared to standard capacitors. That is, supercapacitors are a very attractive option for low voltage/high capacitance applications as will be discussed in greater detail hereinbelow. Charge times for supercapacitors are only slightly greater than for capacitors, i.e., minutes or less.

A battery typically charges and discharges more slowly than a capacitor due to latency associated with the chemical reaction to transfer the chemical energy into electrical energy in a battery. A capacitor is storing electrical energy on the plates so the charging and discharging rate for capacitors are dictated primarily by the conduction capabilities of the capacitors plates. Since conduction rates are typically orders of magnitude faster than chemical reaction rates, charging and discharging a capacitor is significantly faster than charging and discharging a battery. Thus, batteries provide higher energy density for storage while capacitors have more rapid charge and discharge capabilities, i.e., higher power density, and capacitors and supercapacitors may be an alternative to batteries especially in applications where rapid charge/discharge capabilities are desired.

Thus, the on-board power supply 1792 for the untethered drone 1700 may take the form of a capacitor or a supercapacitor, particularly for rapid charge and discharge capabilities. A capacitor may also be used to provide additional flexibility regarding when the power supply is inserted into the untethered drone 1700, particularly because the capacitor will not provide power until it is charged. Thus, shipping and handling of the untethered drone 1700 containing shaped charges or other explosive materials presents low risks where an uncharged capacitor is installed as the power supply 1792. This is contrasted with shipping and handling of an untethered drone 1700 with a battery, which can be an inherently high risk activity and frequently requires a separate safety mechanism to prevent accidental detonation. Further, and as discussed previously, the act of charging a capacitor is very fast. Thus, the capacitor or supercapacitor being used as a power supply 1792 for the untethered drone 1700 can be charged immediately prior to deployment of the untethered drone 1700 into the wellbore 1070.

While the option exists to ship the untethered drone 1700 preloaded with a rechargeable battery which has not been charged, i.e., the electrochemical potential of the rechargeable battery is zero, this option comes with some significant drawbacks. The goal must be kept in mind of assuring that no electrical charge is capable of inadvertently accessing any and all explosive materials in the untethered drone 1700. Electrochemical potential is often not a simple, convenient or failsafe thing to measure in a battery. It may be the case that the potential that a 'charged' battery may be mistaken for an 'uncharged' battery simply cannot be reduced sufficiently to allow for shipping the untethered drone 1700 with an uncharged battery. In addition, as mentioned previously, the time for charging a rechargeable battery having adequate power for the untethered drone 1700 could be on the order of an hour or more. Currently, fast recharging batteries of sufficient charge capacity are uneconomical for the 'one-time-use' or 'several-time-use' that would be typical for batteries used in the untethered drone 1700.

In an embodiment, electrical components of an exemplary untethered drone as described throughout this disclosure including the onboard computer/control circuit 390, an oscillator circuit 1644, one or more wire coils 1632, 1634, and one or more ultrasonic transceivers 1530, 1532 may be battery powered while explosive elements like the detonator for initiating detonation of the shaped charges are capacitor powered. Such an arrangement would take advantage of the possibility that some or all of the onboard computer/control circuit 390, the oscillator circuit 1644, the wire coils 1632, 1634, and the ultrasonic transceivers 1530, 1532 may benefit from a high density power supply having higher energy density, i.e., a battery, while initiating elements such as detonators typically benefit from a higher power density, i.e., capacitor/supercapacitor. A very important benefit for such an arrangement is that the battery is completely separate from the explosive materials, affording the potential to ship the untethered drone 1700 preloaded with a charged or uncharged battery. The power supply that is connected to the explosive materials, i.e., the capacitor/supercapacitor, may be very quickly charged immediately prior to dropping the untethered drone 1700 into wellbore 1070.

In another aspect of the exemplary disclosed embodiments, the untethered drone 300 is configured for performing a self-test of, e.g., operability and connections of the untethered drone components. The untethered drone 300 may receive instructions to perform the self-test from the control unit 1030 when the untethered drone 300 is at the surface 1001 of the wellbore 1070. More specifically and without limitation, the self-test may include at least one of testing an electrical connection, a ballistic connection, a selective detonation code, an onboard computer 390, 490, a power source such as a battery 520, control circuitry, a trigger circuit 530, a positioning device 308*a*, a correlation device 308*b*, and a sensor. The self-test may be performed when the untethered drone 300 is connected to the control unit 1030 and external power supply 524 at the wellbore surface 1001. Conducting a self-test using power from an onboard battery 520 is not advisable because merely activating the battery 520 may arm the explosive devices, deplete the battery 520, and require installation of additional batteries in the untethered drone 300 at additional cost. Further, a self-test of the explosive circuits is not advisable for safety reasons, although a self-test of the explosive circuits may be performed according to known techniques and the exemplary systems disclosed herein—for example, if the onboard computer 390 and/or pre-programming of the control logic for the untethered drone 300 allows the explosive circuits to receive power from the external power supply 524. A deficient untethered drone 300 according to the self-test may be immediately removed from the launch sequence, thereby eliminating another source of potential debris from an incomplete or failed detonation of the shaped charges 340.

An untethered drone string 400 may also conduct a self-test. The untethered drone string 400 self-test may include the same tests as discussed above with respect to the individual drones, and may add tests for, e.g., the electrical connection(s) and mechanical connection(s) between the first untethered drone 401 and the second untethered drone 402. According to the exemplary disclosed embodiments of an untethered drone string 400, this includes testing the threaded connection between each of the first untethered drone 401 and the drone connector 470 and the second untethered drone 402 and the drone connector 470. The connections between the first untethered drone 401 and the electrical connector within the interior of the drone connector 470 and the second untethered drone 402 and the electrical connector within the interior of the drone connector 470 may also be tested. Further, the feed-through wiring of the untethered drone string 400 may be tested to determine whether power and control signals from a vehicle driver 460 at the topmost untethered drone 401 are propagating through the entire untethered drone string 400.

In an exemplary embodiment of the untethered drone 300 including one or more sensors such as the sensors described above, the untethered drone 300 may be taught to initiate one or more operations including detonating the shaped charges 340 when one or more metrics meets a particular threshold or expected value. For example, before the battery 520 connects to and powers the onboard computer 510 and trigger circuit 530, thereby arming the untethered drone 300, the battery 520 powers the one or more sensors for operation as the untethered drone 300 proceeds through the wellbore 1070. The sensors may then communicate an electrical signal to the battery 520 when one or more of a threshold or expected pressure, temperature, depth, distance traveled, rotational speed, and position within the wellbore 1070 has been met. In response to receiving the electrical signal, the battery 520 may begin delivering power to one or both of the onboard computer 510 and trigger circuit 530, and thereby initiate execution of any control instructions that the untethered drone 300 has been taught.

In another exemplary embodiment of the untethered drone 300 including one or more sensors such as the sensors described above, the untethered drone 300 may be taught to initiate one or more operations including detonating the shaped charges 340 when one or more metrics meets a particular threshold or expected value and the onboard battery 520 receives a valid, encrypted trigger signal from the sensor. For example, before the battery 520 connects to and powers the onboard computer 510 and trigger circuit 530, thereby arming the untethered drone 300, the battery 520 powers the one or more sensors for operation as the untethered drone 300 proceeds through the wellbore 1070. The sensors may then communicate an electrical signal to the battery 520, either as an encrypted electrical signal or accompanying an encrypted electrical signal, when one or more of a threshold or expected pressure, temperature, depth, distance traveled, rotational speed, and position within the wellbore 1070 has been met. In response to receiving, decrypting, and verifying the electrical signal, the battery 520 may begin delivering power to one or both of the onboard computer 510 and trigger circuit 530, and thereby initiate execution of any control instructions that the untethered drone 300 has been taught. In a further aspect of such an embodiment, the control unit 1030 may teach each individual untethered drone 300 a unique encryption or encrypted trigger signal when the untethered drone 300 is connected to the external power supply 524 and control unit 1030 at the surface 1001 of the wellbore 1070, in much the same way as the control unit 1030 provides a unique arming instruction, detonating instruction, and/or detonation code to each untethered drone 300. The encryption/encrypted trigger signal provides a further level of safety against accidental or malicious detonations.

Figure 6A:
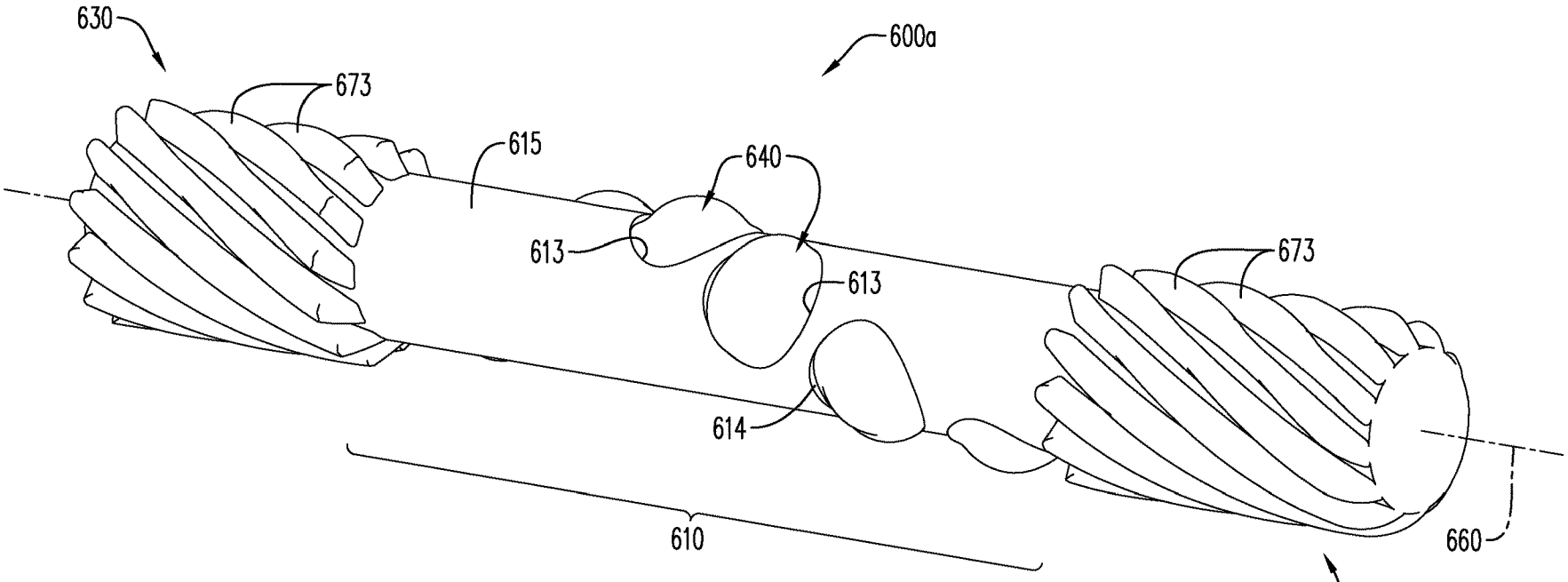
FIG. 6A is a perspective view of an untethered drone including a curved topology according to an exemplary embodiment.
Figure 6B:
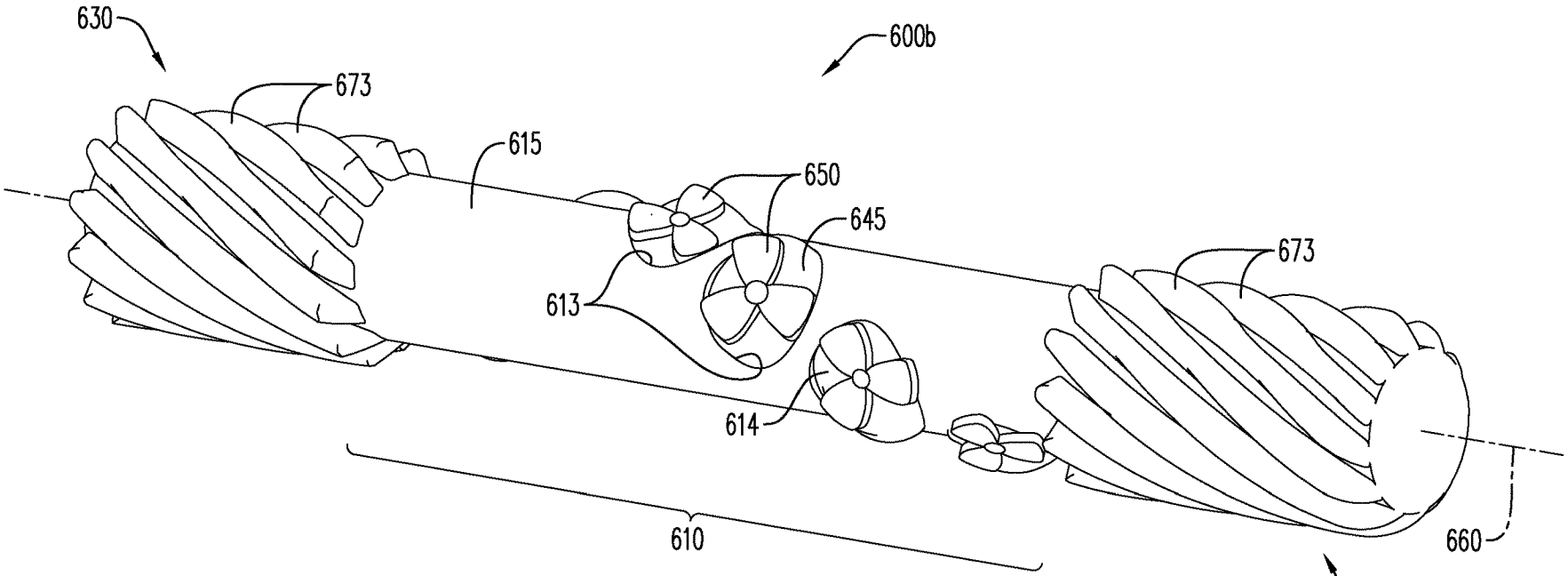
FIG. 6B is a perspective view of the untethered drone shown in FIG. 6A further including an engine and a centralizing device according to an exemplary embodiment.

With reference now to FIGS. 6A and 6B, additional exemplary embodiments of an untethered drone 600*a*, 600*b* are shown. The exemplary embodiments 600*a*, 600*b* shown in FIGS. 6A and 6B each have fundamental components and configurations that are similar to the exemplary untethered drone 300 shown in FIGS. 3A and 3B. For example, each of the current exemplary untethered drones 600*a*, 600*b* includes a body portion 610, a head portion 620, a tail portion 630, and a plurality of apertures 613 extending from an outer surface 615 of the body portion 610 to an interior 614 of the body portion 610. The exemplary untethered drones 600*a*, 600*b* further include fins 673 on the head portion 620 and the tail portion 630. The fins 673 are curved for causing the untethered drone 600*a*, 600*b* to rotate about an axis 660 of the untethered drone 600*a*, 600*b*. Rotation of the untethered drone 600*a*, 600*b* in the wellbore fluid through which the untethered drone 600*a*, 600*b* travels generates (at certain rotational speeds) substantially balanced radial forces that extend in a direction away from the untethered drone 600*a*, 600*b* and exert a pressure against an inner surface 1062 (FIG. 10) of a wellbore casing 1060 (FIG. 10) that contains the wellbore fluid and the untethered drone 600*a*, 600*b* within an interior 1061 (FIG. 10) of the wellbore casing 1060. The pressure that the radial forces exert on the inner surface 1062 of the wellbore casing 1060 help to center the untethered drone 600*a*, 600*b* within the interior 1061 of the wellbore casing 1060 and wellbore fluid and stabilize the untethered drone 600*a*, 600*b* on the axis 660. The configuration of the curved fins 673 including the angle of the curves, the height and profile of the fins 673, the number and spacing of the fins 673, and the like may be varied to achieve desired and/or constant rotational speeds in a variety of wellbore casing 1060 diameters and wellbore fluid velocities, densities, and turbulence.

In the exemplary untethered drones 600*a*, 600*b* shown in FIGS. 6A and 6B, the topology of the curved fins 673 on the head portion 620 is substantially the same as the topology of the curved fins 673 on the tail portion 630. In other embodiments, the head portion 620 may include curved fins 673 with a different topology than the curved fins 673 on the tail portion 630. In still further embodiments, one of the head portion 620 and the tail portion 630 may not include fins.

Moreover, any embodiment of an untethered drone disclosed herein may generally include an integral, curved or other topology on a surface that is exposed to the wellbore fluid, for causing the untethered drone to rotate within the wellbore fluid.

In an aspect of an alternative embodiment, any disclosed embodiment of an untethered drone may include at least one of curved fins 673 and an integral, curved or other topology on a surface that is exposed to the wellbore fluid, for causing the untethered drone to rotate around an axis 660 while traveling through the wellbore fluid, and may further include an engine 645 for exerting a force along the axis 660 in a direction away from the tail end 630 of the untethered drone, wherein the engine may include a centralizing device 650, and the engine propels the untethered drone forward while the at least one of curved fins 673 and the integral, curved or other topology stabilizes the untethered drone on the axis 660.

With specific reference to FIG. 6A, the untethered drone 600*a* includes shaped charges 640 that may be retained within the apertures 613 of the body portion 610 in substantially the same manner as in the exemplary untethered drone 300 shown in FIGS. 3A and 3B. Descriptions of these and other features, functions, and constructions that are common to the exemplary untethered drone embodiments 300, 600*a*, 600*b* shown in FIGS. 3A, 3B, 6A, and 6B are not necessarily repeated, although it should be understood that the above descriptions of an exemplary untethered drone 300 as shown in FIGS. 3A and 3B, including components, features, materials, and functions, may apply to the exemplary untethered drones 600*a*, 600*b* shown in FIGS. 6A and 6B.

With specific reference now to FIG. 6B, the exemplary untethered drone 600*b* includes a one or more engines 645 including centering devices 650 retained in the apertures 613 of the body portion 610. In the exemplary untethered drone 600*b* shown in FIG. 6B, the centering devices 650 are formed substantially as propellers that are rotated by the engines 645. Rotation of the propellers 650 through the wellbore fluid generates additional radial force with respect to the untethered drone 600*b* and the additional radial force exerts additional pressure on the inner surface 1062 of the wellbore casing 1060. The additional pressure exerted on the inner surface 1062 of the wellbore casing 1060 may enhance the resultant supporting and centering effect on the untethered drone 600*b*.

With continuing reference to FIG. 6B, the untethered drone 600*b* includes a plurality of engines 645, and each engine includes a propeller-type centering device 650. In other embodiments, one or more engines 645 may not have a separate centering device 650, but the engine 645 may generate radial force by, for example and without limitation, exhausting or siphoning wellbore fluid radially in a direction away from the untethered drone 600*b*. Further, the untethered drone 600*b* may include any combination of one or more engines 645 with, e.g., one or more shaped charges 640 or other components consistent with this disclosure in the available apertures 613 of the body portion 610. Generally, the fewer engines 645/centering devices 650 the untethered drone 600*b* has, the higher the untethered drone 600*b* rotation speed must be to create balanced radial forces that contribute to centering the untethered drone 600*b* within the wellbore casing 1060/wellbore fluid.

In various other embodiments, engines 645 with or without centering devices 650 may be attached to the untethered drone 600*b* according to any known techniques consistent with this disclosure and may be oriented in any manner consistent with the goals of supporting and/or centering the untethered drone 600*b* within the wellbore casing 1060/wellbore fluid. For example, the one or more engines 645/centering devices 650 may be located on any accommodating portion of the head portion 620, body portion 610, or tail portion 630. In other examples, the one or more engines 645 including one or more centering devices 650 may generate lateral forces extending in an upstream direction away from the untethered drone 600*b* along the axis 660 of the untethered drone 600*b*. In that configuration radial propulsion may be created if the untethered drone 600*b* achieves a positive forward movement relative to the wellbore fluid flow.

In any configuration, rotating the untethered drone 600*a*, 600*b* through the wellbore fluid provides several benefits. The radial forces and curved topology respectively help to keep the untethered drone 600*a*, 600*b* centered within the wellbore casing 1060/wellbore fluid and reduce friction against the untethered drone 600*a*, 600*b*. As a result, the untethered drone 600*a*, 600*b* will experience fewer and less severe collisions with the wellbore casing 1060 as it travels downhole. Accordingly, the untethered drone 600*a*, 600*b* may be formed from less material and/or lighter material without sacrificing the integrity of the untethered drone 600*a*, 600*b* under downhole conditions. Similarly, a rotating untethered drone 600*a*, 600*b* reduces the need to increase the weight or density of the untethered drone 600*a*, 600*b* to center and stabilize the untethered drone 600*a*, 600*b* and decreases the frequency and degree to which the untethered drone 600*a*, 600*b* will bounce and rebound as it travels. Thus, the location of the untethered drone 600*a*, 600*b* in the wellbore may be determined with greater precision because positioning and correlation factors such as the horizontal orientation and inclination angle of the untethered drone 600*a*, 600*b* will experience less interference from bouncing and thereby reflect more accurately the profile of the wellbore. Further, forming the untethered drone 600*a*, 600*b* from less material and/or lighter material, in particular for the head portion 620 and the tail portion 630, makes thoroughly disintegrating the untethered drone 600*a*, 600*b* easier upon detonation of the shaped charges, dissolution in the wellbore fluid, etc.

The exemplary untethered drones 600*a*, 600*b* shown in FIGS. 6A and 6B may be formed from any of the materials and according to any of the techniques disclosed for the untethered drone shown in FIGS. 3A and 3B. By way of example, the exemplary untethered drones 600*a*, 600*b* are formed at least in part from a plastic material that will substantially disintegrate when the shaped charge(s) are detonated. In an aspect, the exemplary untethered drones 600*a*, 600*b* are formed from one or more of an injection-molded material, a casted material, a 3D printed material, and a 3D milled material from a solid plastic bar stock.

Figure 7A:
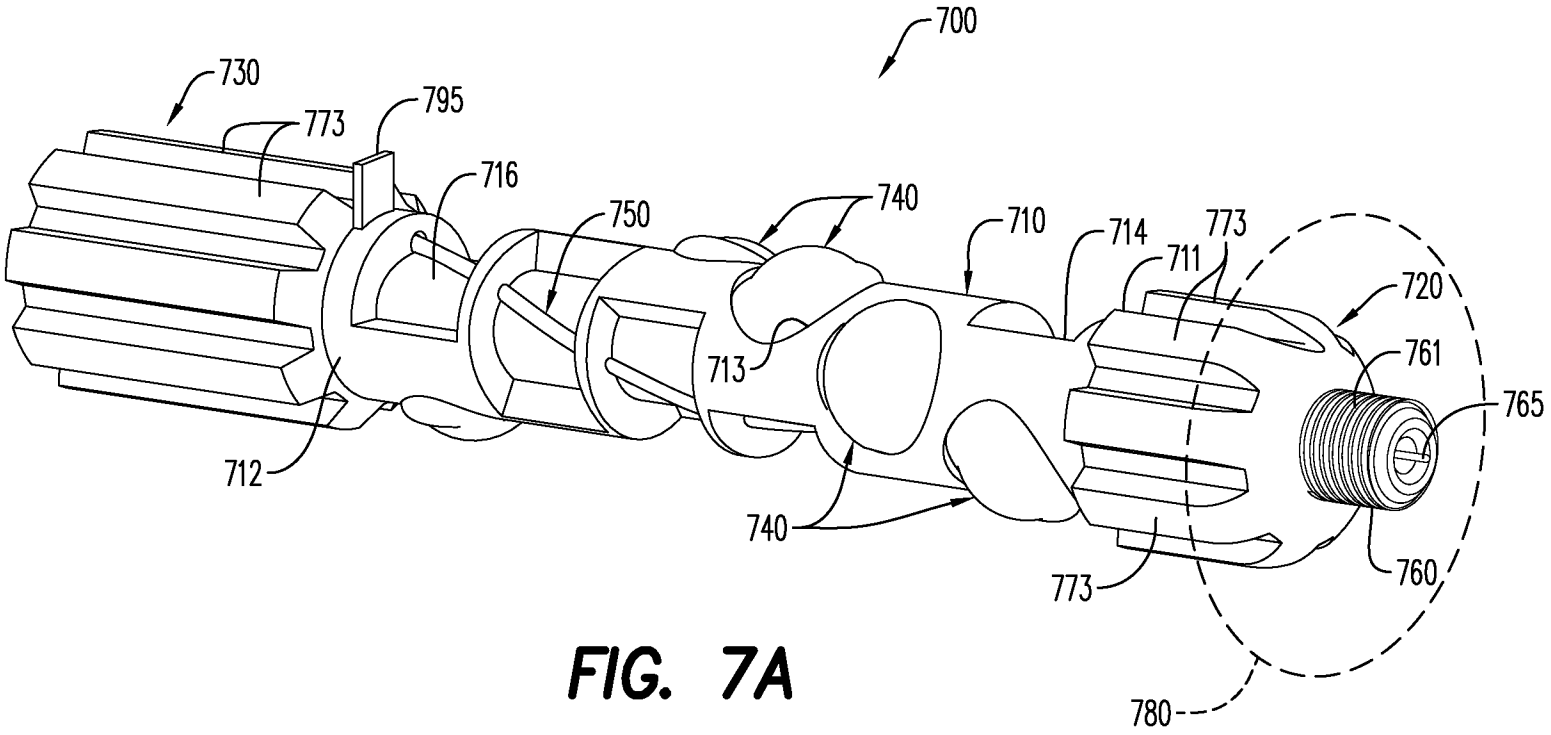
FIG. 7A is a perspective view of an untethered drone including a head connecting portion according to an exemplary embodiment.
Figure 7B:
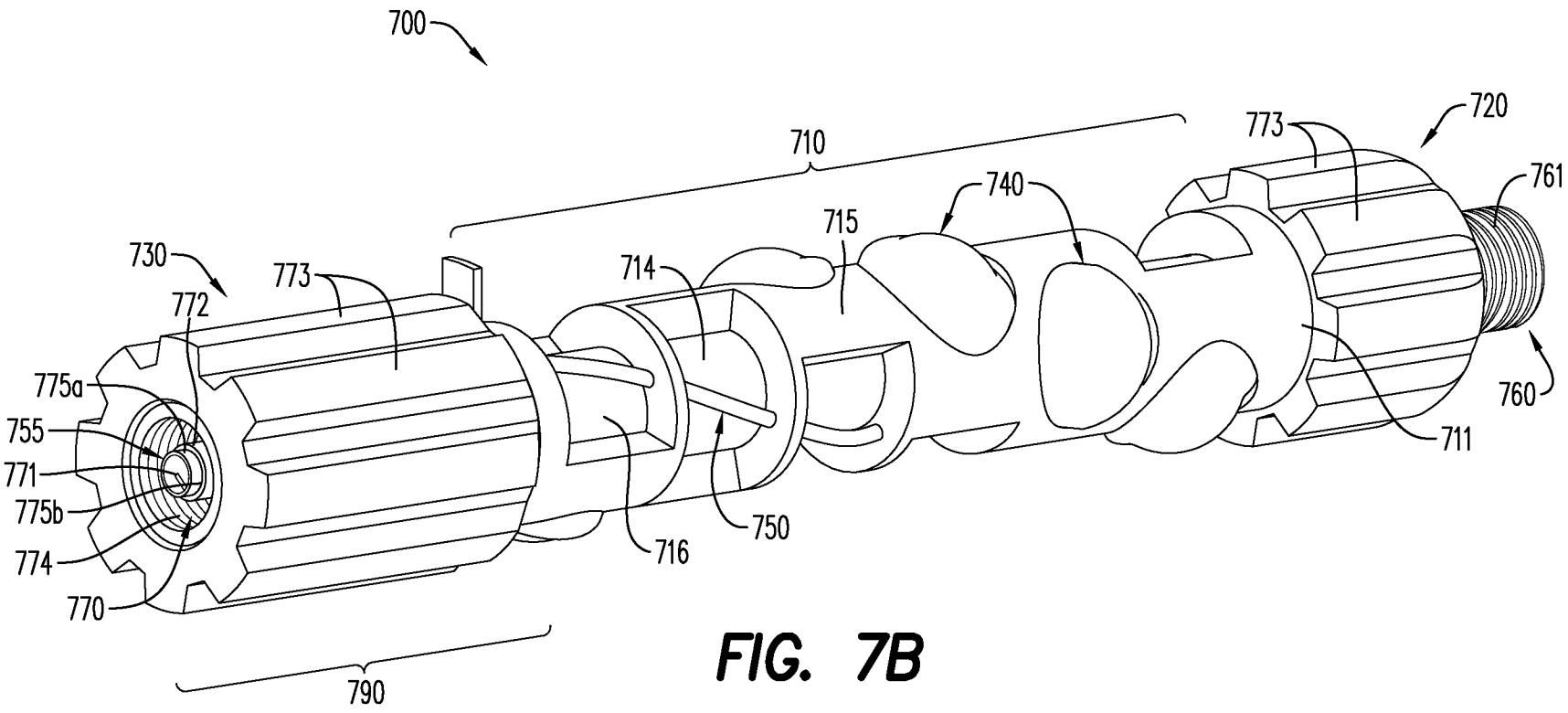
FIG. 7B is another perspective view of the untethered drone shown in FIG. 7A including a tail connecting portion.

With reference now to FIGS. 7A and 7B, a further exemplary embodiment of an untethered drone 700 is shown. The untethered drone 700 shown in FIGS. 7A and 7B includes fundamental components and configurations that are similar to those in the exemplary untethered drone embodiment 300 shown in FIGS. 3A and 3B. For example, the current exemplary untethered drone 700 includes a body portion 710 having a front end 711 and a rear end 712, a head portion 720 that extends from the front end 711 of the body portion 710, and a tail portion 730 that extends from the rear end 712 of the body portion 710 in a direction opposite the head portion 720. Further, the body portion 710 includes a plurality of shaped charge apertures 713 and open apertures 716 extending between an external surface 715 of the body portion 710 and an interior 714 of the body portion 710. Each of the plurality of shaped charge apertures 713 are configured for receiving and retaining at least a portion of a shaped charge 740, using the same structures and techniques as described above with respect to the exemplary untethered drone 300 shown in FIGS. 3A and 3B. Accordingly, descriptions of these and other features, functions, and constructions that are common to the exemplary embodiments 300, 700 shown in FIGS. 3A, 3B, 7A, and 7B are not necessarily repeated, although it should be understood that such descriptions with respect to the exemplary untethered drone 300 shown in FIGS. 3A and 3B may apply to the exemplary untethered drone 700 shown in FIGS. 7A and 7B. In particular, the exemplary untethered drone 700 shown in FIGS. 7A and 7B may be formed from the materials and according to the techniques discussed with respect to the untethered drone 300 shown in FIGS. 3A and 3B. For example, the material may be, among other things, a plastic material that will substantially disintegrate when the shaped charges are detonated. In addition, the material may be one or more of an injection-molded material, a casted material, a 3D printed material, and a 3D milled material from a solid plastic bar stock.

A detonating cord 750 for detonating the shaped charges 740 and relaying ballistic energy along the length of the untethered drone 700 may be housed within at least a portion of each of the body portion 710, the head portion 720, and the tail portion 730. In the exemplary embodiment shown in FIGS. 7A and 7B, the detonating cord 750 is housed within the interior 714 of the body portion and is exposed to the surrounding environment through the open apertures 716. Accordingly, the detonating cord 750 is configured for withstanding the conditions and materials within a wellbore, without becoming destroyed or inoperable, or detonating prematurely. Such exposed detonating cords are known.

In an aspect, the detonating cord 750 extends through the body portion 710 between the head portion 720 and the tail portion 730. In a further aspect, an amount of detonating cord 750 within one or both of the head portion 720 and the tail portion 730 is increased by, e.g., weaving, wrapping, folding, rolling, and the like, the detonating cord 750 within the head portion 720 and/or the tail portion 730.

In an aspect and with continuing reference to FIGS. 7A and 7B, the body portion 710 of the untethered drone 700 also houses a conductive line (not shown) for relaying an electrical signal along the length of the untethered drone 700. In the exemplary embodiment shown in FIGS. 7A and 7B, the detonating cord 750 is a conductive detonating cord 10 and includes the conductive line. In other embodiments, the conductive line and the detonating cord 750 may be separate components.

The exemplary untethered drone 700 further includes a vehicle driver 790 as described above with respect to the exemplary untethered drone 300 shown in FIGS. 3A and 3B. The vehicle driver 790 may include, among other things, an initiator, an igniter, or a detonator assembly 755 (collectively, "detonator 755"), an external contact point 771, an onboard computer 510, a trigger circuit 530, a positioning device 775*a*, a correlation device 775*b*, and an onboard battery assembly 500 within the tail portion 730 of the untethered drone 700. The detonator assembly 755 may be a wire-free detonator assembly 1110 as shown in FIG. 11 and previously described with respect to the untethered drone 300 shown in FIGS. 3A and 3B. The description of the wire-free detonator assembly 1110 and corresponding functions is not repeated here.

The exemplary untethered drone 700 further includes a tab-shaped deactivating safety device 795 according to the structure and use as described with respect to the untethered drone 300 shown in FIGS. 3A and 3B for preventing activation of the arming/detonating mechanisms of the exemplary untethered drone 700.

With continuing reference to FIGS. 7A and 7B, the head portion 720 includes a head connecting portion 760 and the tail portion 730 includes a tail connecting portion 770 for connecting a first untethered drone to a second untethered drone in an untethered drone string 800, described below with respect to FIG. 8, or to, for example and without limitation, a wellbore tool or data collection system. The untethered drone 700 may also include appropriate seals, stand-offs, or other components for, e.g., protecting the vehicle driver 790 components and connections from harsh wellbore conditions, electrically isolating different components, preventing wellbore fluid from infiltrating the interior of the tail portion 330, etc. For example, a detonator bulkhead seal 772 may substantially isolate the detonator 755 and vehicle driver 790 from exposure to the wellbore fluid, including the associated high temperatures, pressures, and potentially corrosive components. Such components including their selection and use are known in oil and gas operations.

The conductive detonating cord 750 in the exemplary embodiment shown in FIGS. 7A and 7B is configured for being in ballistic and electrical contact at one end with one or more of the detonator 755, the external contact point 771, and the onboard computer 510 at or in the tail end 730, and at an opposite end with an electrical transfer contact such as a pin contact 765 in the head connecting portion 760. The conductive detonating cord 750 transfers an electrical signal along the length of the untethered drone from at least one of the external contact point 771, line-out portion 1122 of the detonator 755, and onboard computer 510 to the pin contact 765 in the head connecting portion 760. The electrical signal may provide, among other things, a selective sequence signal for one or more downstream untethered drones in an untethered drone string 800 as described below with respect to FIG. 8.

The head connecting portion 760 is configured for connecting to and being in electrical contact with a downstream untethered drone or wellbore tool in an untethered drone string 800. In the exemplary embodiment shown in FIGS. 7A and 7B, the head connecting portion 760 and the tail connecting portion 770 each include a threaded portion 761, 774 that is respectively configured for being threadingly connected to a complimentary connecting portion on an adjacent untethered drone. In other embodiments, the connection between the head connecting portion 760 and the tail connecting portion 770 may be by other known devices or techniques that are consistent with the scope of this disclosure. Additional components such as a wellbore tool or a data collection system with a complimentary threaded connection (or other connection) may also be connected to the untethered drone 700 via the head connecting portion 760 and/or the tail connecting portion 770. For purposes of this disclosure, the exemplary disclosed connections between adjacent untethered drones is representative of connections between an untethered drone 300 and such additional components.

According to the exemplary embodiment shown in FIGS. 7A and 7B, the pin contact 765 of the head connecting portion 760 is configured for being in electrical contact with at least one of an external contact point and a line-in portion of a detonator of an adjacent untethered drone when the head connecting portion 760 is connected to the tail connecting portion 770 of the adjacent untethered drone. The pin contact 765 is configured to transfer the electrical signal from the conductive line or conductive detonating cord 750 to the external contact point and/or the line-in portion of the detonator of the adjacent untethered drone, such that the electrical signal may be provided to, e.g., the detonator or other component(s) of the adjacent untethered drone and/or a conductive line or conductive detonating cord of the adjacent untethered drone. In an aspect, the pin contact 765 may, among other things, also transfer control information, instructions, data, or power from the onboard computer 510 and/or battery 520 of the untethered drone 700 to the external contact point and/or the line-in portion of the detonator, or other onboard systems, of the adjacent untethered drone. In another aspect, the pin contact 765 may be a spring-loaded pin contact 765 that is biased towards the adjacent untethered drone to maintain electrical contact with the external contact point and/or the line-in portion of the detonator of the adjacent untethered drone. The respective electrical transfer components of the head connecting portion 760 and the tail connecting portion 770 are not limited according to this disclosure. The respective electrical transfer components of the head connecting portion 760 and the tail connecting portion 770 may take any form or configuration consistent with this disclosure—for example, configured for being in electrical contact when the head connecting portion 760 of a first untethered drone 801 (FIG. 8) is connected to the tail connecting portion 770 of a second untethered drone 820 (FIG. 8) and for relaying the electrical signal from the conductive detonating cord 750 of the first untethered drone 801 to, e.g., the detonator 755 or other component(s) of the second untethered drone 802.

The exemplary untethered drone 700 may also include a blast barrier 780 positioned between at least a portion of the head portion 720 of the untethered drone 700 and the tail portion 730 of a downstream untethered drone that is attached to the head connecting portion 760 of the untethered drone 700. The blast barrier 780 may be configured for shielding the head portion 720 of the untethered drone 700 from detonation, disintegration, and debris from the downstream untethered drone and preventing destruction and/or disintegration of the head portion 720 of the untethered drone 700 as a result of the downstream detonation. The blast barrier 780 may generally be any shape consistent with this disclosure and may be formed from a variety of materials consistent with this disclosure such as, for example and without limitation, metals and plastics and combinations of those materials. In the same or other embodiments, the head portion 720 of the untethered drone 700 may be formed from a material such as metals, plastics, or combinations of those materials, and/or have a material structure or size configured for resisting disintegration under the force and heat of a downstream detonation.

Figure 8:
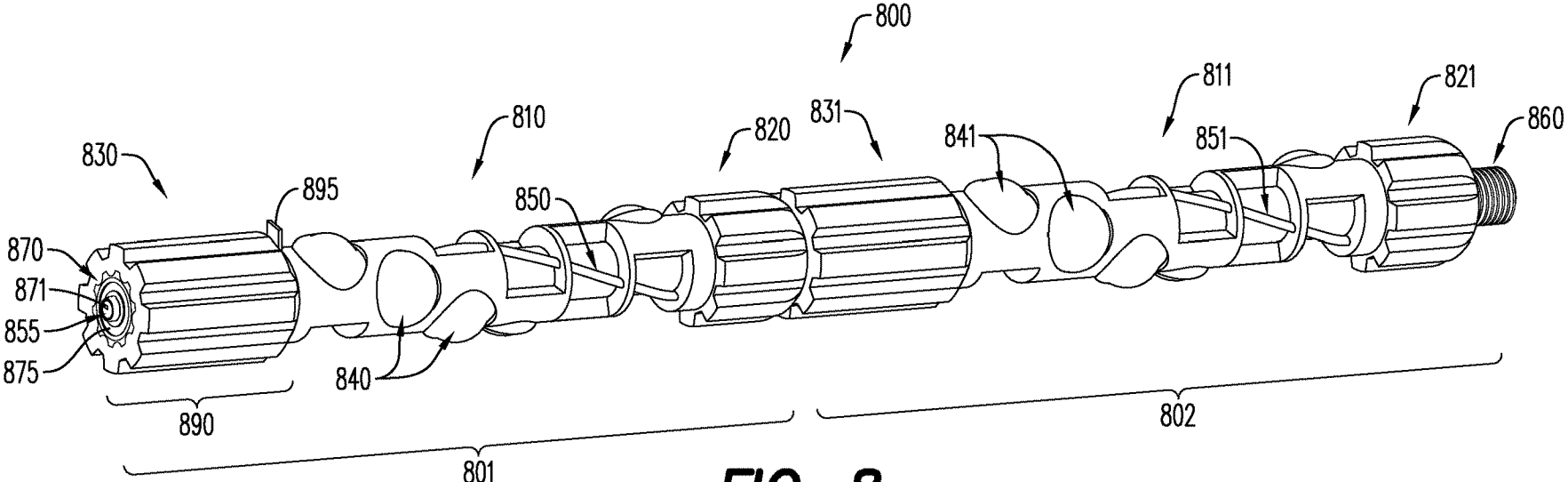
FIG. 8 is a perspective view of an untethered drone string according to an exemplary embodiment.

With reference now to FIG. 8, an exemplary untethered drone string 800 of the exemplary untethered drones 700 shown in FIGS. 7A and 7B is shown. Two or more untethered drones 801, 802 may be connected to form the untethered drone string 800. Each of the first untethered drone 801 and the second untethered drone 802 is an exemplary untethered drone as described above with respect to FIGS. 7A and 7B and includes a body portion 810, 811, a head portion 820, 821 having a head connecting portion 860, and a tail portion 830, 831 having a tail connecting portion 870. Each of the first untethered drone 801 and the second untethered drone 802 carries shaped charges 840, 841 in the body portion 810, 811 as discussed with respect to FIGS. 7A and 7B. The head connecting portion 860 (not visible in the illustration of FIG. 8) of the first untethered drone 801 is connected to the tail connecting portion 870 (not visible in the illustration of FIG. 8) of the second untethered drone 802. In the same or other embodiments, the head connecting portion 860 or the tail connecting portion 870 of an untethered drone 801, 802 in a drone string 800 may be connected to, for example and without limitation, a wellbore tool or a data collection system.

The head connecting portion 820, 821 of each of the first untethered drone 801 and the second untethered drone 802 in the exemplary embodiment shown in FIG. 8 includes, among other things, an electrical transfer contact such as the pin contact 865 (not visible in FIG. 8) as discussed with respect to FIGS. 8A and 8B. The tail connecting portion 830, 831 of each of the first untethered drone 801 and the second untethered drone 802 includes, among other things, an external contact point 871 and a detonator 855 including a line-in portion 1120 as also discussed with respect to FIGS. 7A and 7B. Accordingly, a conductive detonating cord 850, 851 may relay ballistic energy and an electrical signal along a length of the respective untethered drones 801, 802 from at least one of the external contact point 871, the detonator 855, and the onboard computer 510 to the pin contact 865, in the same manner as discussed with respect to the exemplary embodiment shown in FIGS. 7A and 7B. In the exemplary embodiment shown in FIG. 8, the pin contact (865) of the first untethered drone 801 is in electrical contact with the external contact point (871) and/or detonator (855) of the second untethered drone 802.

Use of the exemplary untethered drone string 800 is substantially similar to the use of the exemplary untethered drone string 400 described with respect to FIG. 4, save for making the electrical contact between the first untethered drone 801 and the second untethered drone 802 via the pin connector (865) of the first untethered drone 801 and the external contact point (871) and/or the detonator (855) of the second untethered drone 802. The used of the exemplary untethered drone strings 400, 800 will otherwise not be repeated here.

As with the exemplary drone string 400 described with respect to FIG. 4, the configuration of the untethered drone string 800 shown in FIG. 8 and, in particular, the conductive line (for example, in the conductive detonating cord 850, 851 of the exemplary embodiment) allows a single power source, such as a single battery at the top of the untethered drone string 800, to provide power to each untethered drone 801, 802 and/or wellbore tool in the untethered drone string 800. The power may be relayed between each untethered drone 801, 802 and/or wellbore tool via the conductive detonating cords 850, 851 in the same manner as, e.g., the selective sequence signal. Similarly, a single vehicle driver 890 can be used to control each untethered drone 801, 802 and wellbore tool in the untethered drone string 800 because, for example, a selective sequence signal including arming and detonation instructions for each untethered drone 801, 802 and wellbore tool may be relayed from the vehicle driver 890 to downstream drones/tools via the conductive detonating cords 850, 851.

Figure 9A:
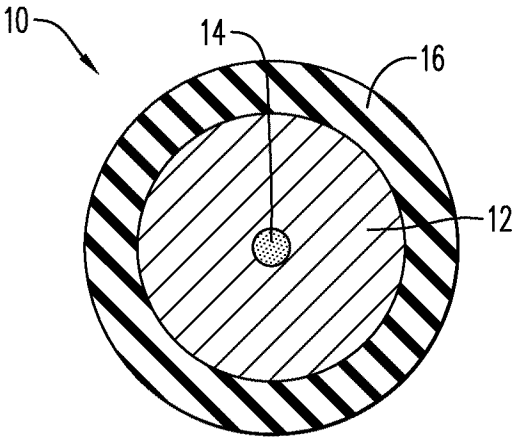
FIG. 9A is a lateral cross-sectional view of a conductive detonating cord according to an exemplary embodiment.
Figure 9B:
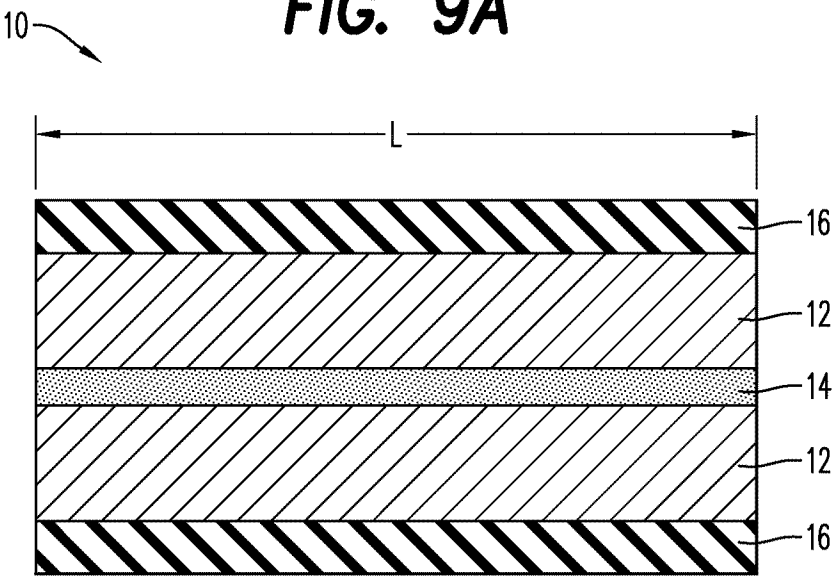
FIG. 9B is a side cross-sectional view of the conductive detonating cord shown in FIG. 9A.
Figure 9C:
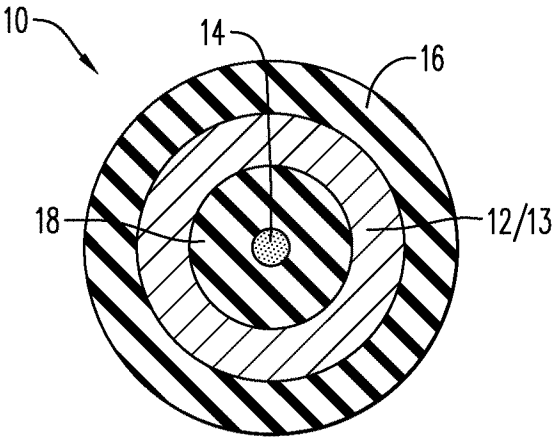
FIG. 9C is a lateral cross-sectional view of a conductive detonating cord according to another exemplary embodiment.
Figure 9D:
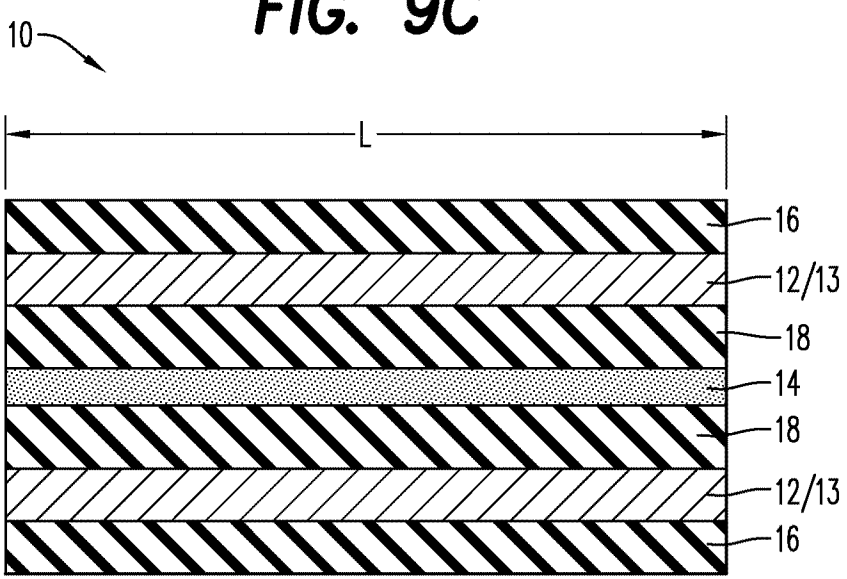
FIG. 9D is a side cross-sectional view of the conductive detonating cord shown in FIG. 10A.

With reference now to FIGS. 9A-9D, FIGS. 9A and 9B respectively show a lateral cross-section and a longitudinal cross-section of a first exemplary embodiment of a conductive detonating cord 10 for use with the exemplary disclosed untethered drones 300, 600, 700 and FIGS. 9C and 9D respectively show a lateral cross-section and a longitudinal cross-section of a second exemplary embodiment of a conductive detonating cord 10 for use with the exemplary disclosed untethered drones 300, 600, 700. The conductive detonating cord 10 may be a flexible structure that allows the conductive detonating cord 10 to be bent or wrapped around structures. According to an aspect, the conductive detonating cord 10 may include a protective structure or sheath 16 that prevents the flow of an extraneous or stray electric current through an explosive layer 14 within the conductive detonating cord 10. The explosive layer 14 may include an insensitive secondary explosive (i.e., an explosive that is less sensitive to electrostatic discharge (ESD), friction and impact energy within the detonating cord, as compared to a primary explosive). According to an aspect, the explosive layer 14 includes at least one of pentaerythritol tetranitrate (PETN), cyclotrimethylenetrinitramine (RDX), octahydro- 1,3,5,7-tetranitro-1,3,5,7-tetrazocine/cyclotetramethylene-tetranitramine (HMX), Hexanitrostilbene (HNS), 2,6-Bis (picrylamino)-3,5-dinitropyridine (PYX), and nonanitroterphenyl (NONA). The type of material selected to form the explosive layer 14 may be based at least in part on the temperature exposure, radial output and detonation velocity of the material/explosive. In an embodiment, the explosive layer 14 includes a mixture of explosive materials, such as, HNS and NONA. As would be understood by one of ordinary skill in the art, the explosive layer 14 may include compressed explosive materials or compressed explosive powder. The explosive layer 14 may include constituents to improve the flowability of the explosive powder during the manufacturing process. Such constituents may include various dry lubricants, such as, plasticizers, graphite, and wax.

The conductive detonating cord 10 further includes an electrically conductive layer 12. The electrically conductive layer 12 is configured to transfer a communication signal along a length L of the conductive detonating cord 10. The communication signal may be a telemetry signal. According to an aspect, the communication signal includes at least one of a signal to check and count for detonators in a perforating gun string assembly, address and switch to certain detonators, charge capacitors, send a signal to initiate a detonator communicably connected to the conductive detonating cord 10, and various other functions as described in this disclosure. The integration of the electrically conductive layer 12 in the conductive detonating cord 10 helps to omit conductive lines as a separate component.

According to an aspect, the electrically conductive layer 12 extends around the explosive layer 14 in a spaced apart configuration. An insulating layer 18 (FIGS. 9C and 9D) may be sandwiched between the explosive layer 14 and the electrically conductive layer 12. The electrically conductive layer 12 of the detonating cord 10 may include a plurality of electrically conductive threads/fibers spun or wrapped around the insulating layer 18, or an electrically conductive sheath/pre-formed electrically conductive sheath 13 in a covering relationship with the insulating layer 18. According to an aspect, the electrically conductive sheath 13 comprises layers of electrically conductive woven threads/fibers that are pre-formed into a desired shape that allows the electrically conductive sheath to be easily and efficiently placed or arranged over the insulating layer 18. The layers of electrically conductive woven threads may be configured in a type of crisscross or overlapping pattern in order to minimize the effective distance the electrical signal must travel when it traverses through the conductive detonating cord 10. This arrangement of the threads helps to reduce the electrical resistance (Ohm/ft or Ohm/m) of the conductive detonating cord 10. The electrically conductive threads and the electrically conductive woven threads may include metal fibers or may be coated with a metal, each metal fiber or metal coating having a defined resistance value (Ohm/ft or Ohm/m). It is contemplated that longer gun strings (i.e., more perforating guns in a single string) may be formed using perforating guns that include the conductive detonating cord 10.

FIGS. 9C and 9D illustrate the conductive detonating cord 10 including the insulating layer 18. The insulating layer 18 is disposed/positioned between the explosive layer 14 and the electrically conductive layer 12. As illustrated in FIG. 9D, for example, the insulating layer 18 may extend along the length L of the conductive detonating cord 10. In other embodiments, the insulating layer 18 may only extend along a portion of the length L of the detonating cord and the explosive layer 14 may be adjacent to the electrically conductive layer 12. The insulating layer 18 may be formed of any nonconductive material. According to an aspect, the insulating layer 18 may include at least one of a plurality of non-conductive aramide threads, a polymer, such as fluorethylenpropylene (FEP), polyamide (PA), polyethylenterephthalate (PET), or polyvinylidenfluoride (PVDF), and a coloring additive.

The conductive detonating cord 10 may include a layer of material along its external surface to impart additional strength and protection to the structure of the conductive detonating cord 10. FIGS. 9A-9D each illustrate a jacket/outer protective jacket 16 externally positioned on the conductive detonating cord 10. According to an aspect, the jacket 16 is formed of at least one layer of woven threads. The jacket 16 may be formed from a nonconductive polymer material, such as FEP, PA, PET, and PVDF. According to an aspect, the jacket 16 is formed of at least one layer of non-conductive woven threads and covered by a sheath formed from a plastic, composite or lead.

As illustrated in FIGS. 9A and 9C, the jacket 16 extends around/surrounds/encases the electrically conductive layer 12/electrically conductive sheath 13, the insulating layer 18, and the explosive layer 14. The jacket 16 extends along the length L of the conductive detonating cord 10, and may be impervious to at least one of sour gas (H2S), water, drilling fluid, and electrical current.

According to an aspect, electric pulses, varying or alternating current or constant/direct current may be induced into or retrieved from the electrically conductive layer 12/electrically conductive sheath 13 of the conductive detonating cord 10. The conductive detonating cord 10 includes contacts (not shown) that are configured to input a communication signal at a first end of the conductive detonating cord 10, and output the communication signal at a second end of the conductive detonating cord 10. According to an aspect, the contacts may include a metal, such as aluminum, brass, copper, stainless steel or galvanized steel (including zinc). In order to facilitate the communication of the communication signal, the contacts may at least partially be embedded into the conductive detonating cord 10. The contacts may be coupled to or otherwise secured to the conductive detonating cord 10. According to an aspect, the contacts are crimped onto the detonating cord 10, in such a way that the contacts pierce through the protective outer jacket 16 of the conductive detonating cord 10 to engage the electrically conductive layer 12 or the conductive sheath 13. In use with an exemplary untethered drone 300, the contacts are configured without limitation for being in electrical communication with the electrical transfer contact 371*a* and the pin contact 365.

With reference now to FIG. 10, an exemplary wellbore operation site and system as has been reference herein above is illustrated. The site includes a hydrocarbon formation 1002 under the surface 1001 of the ground/wellbore 1070. The wellbore 1070 extends into the hydrocarbon formation 1002 in both vertical and horizontal directions. The wellbore casing or tubing 1060 lines the inside of the wellbore 1070. One or more untethered drones 300, 600, 700 according to the exemplary disclosed embodiments are launched downhole in the wellbore 1070 within the interior 1061 of the tubing/casing 1060. Upon reaching a desired position within the wellbore 1070, the shaped charges 340 of the untethered drone 300 are detonated 1040 and perforate 1050 the tubing/casing 1060 and the hydrocarbon formation 1002. The untethered drone(s) 300 proceed autonomously or semi-autonomously through the wellbore, although the control unit 1030 may teach each untethered drone 300 relevant codes, controls, instructions, etc. when the untethered drone 300 is at the surface 1001 of the wellbore 1070, as has been described herein above. In an exemplary embodiment, the control unit 1030 may communicate unidirectionally with the untethered drone 300 via a wireless link. In other embodiments, the control unit 1030 and the untethered drone 300 may communicate bi-directionally.

Figure 12A:
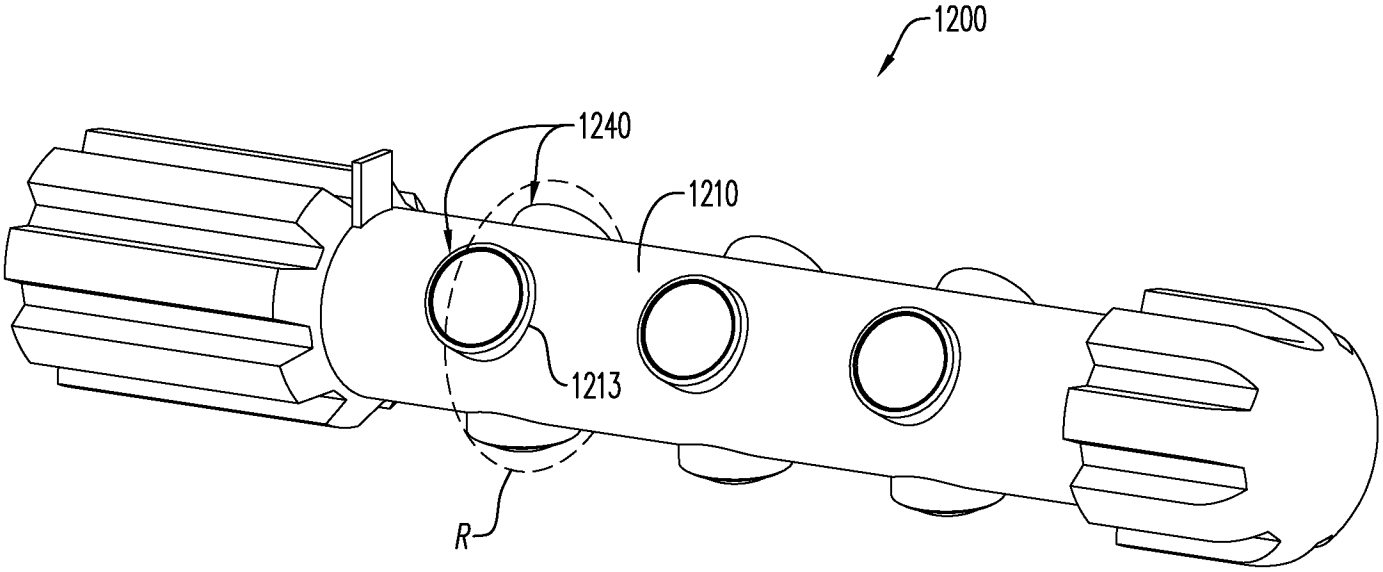
FIG. 12A is a perspective view of an untethered drone according to an exemplary embodiment.
Figure 12B:
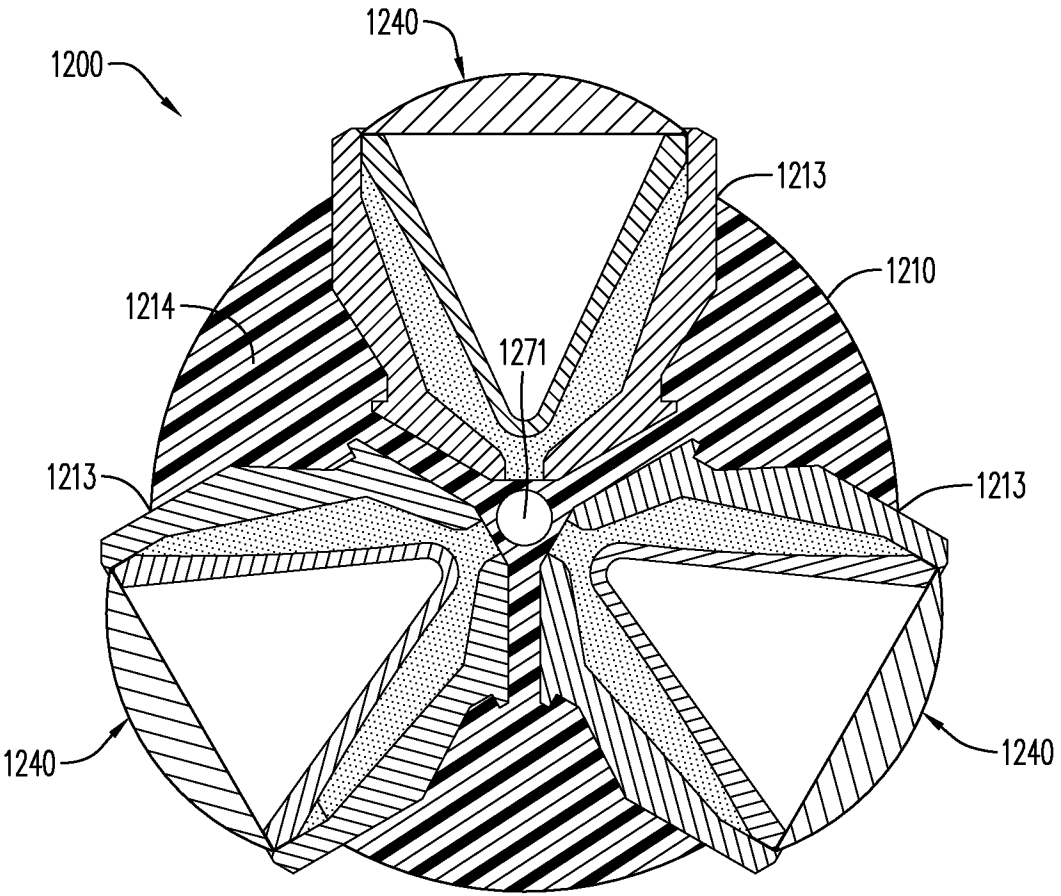
FIG. 12B is a lateral cross-sectional view of the untethered drone shown in FIG. 12A.

With reference now to FIGS. 12A and 12B, FIG. 12A shows an untethered drone 1200 according to an exemplary embodiment in which a plurality of shaped charges 1240 are arranged within one or more single radial planes R around a body portion 1210 of the untethered drone 1200. Each of the shaped charges 1240 is received and retained in a corresponding shaped charge aperture 1213 at least in part within an interior 1214 of the body portion 1210. FIG. 12B is a cross-sectional view showing the arrangement of the shaped charges 1240 and the shaped charge apertures 1213, among other things, within the interior 1214 of the body portion 1210 of the exemplary untethered drone 1200 shown in FIG. 12A. In particular, FIG. 12B is a lateral cross-sectional view of the body portion 1210 of the untethered drone 1200 shown in FIG. 12A taken along the radial plane R. For purposes of this disclosure, a radial plane is a plane generally containing each of a plurality of radii (e.g., shaped charges 1240) extending from a common center. The exemplary untethered drone 1200 shown in FIGS. 12A and 12B includes three shaped charges 1240 arranged in the same radial plane R and spaced apart by about a 120-degree phasing around the body portion 1210. The type(s) of shaped charges used with an untethered drone as described throughout this disclosure are not limited and may include any shaped charges as are well-known and/or would be understood in the art and consistent with this disclosure.

FIG. 12B also shows a selective detonator 1271 positioned within the interior 1214 of the body portion 1210 and adjacent to the shaped charges 1240 such that the shaped charges 1240 extend radially from the selective detonator 1271. In an aspect, the selective detonator 1271 may directly initiate detonation of the shaped charges 1240 upon detonation of the selective detonator 1271. In some embodiments, a detonation extender, such as a detonating cord or a booster device may also be secured in the interior 1214 of the body portion 1210. The detonator extender may abut an end of the selective detonator 1271 or may be in side-by-side contact with at least a portion of the selective detonator 1271. The detonation extender may be in communication with the selective detonator 1271 such that upon activation of the selective detonator 1271 a detonation energy from the detonator 1271 simultaneously detonates the shaped charges in a first radial plane R and the initiates the detonation extender such that the detonation extender transfers a ballistic energy to detonate shaped charges arranged in a second, third, etc. radial plane R+1, R+2.

Figure 13:
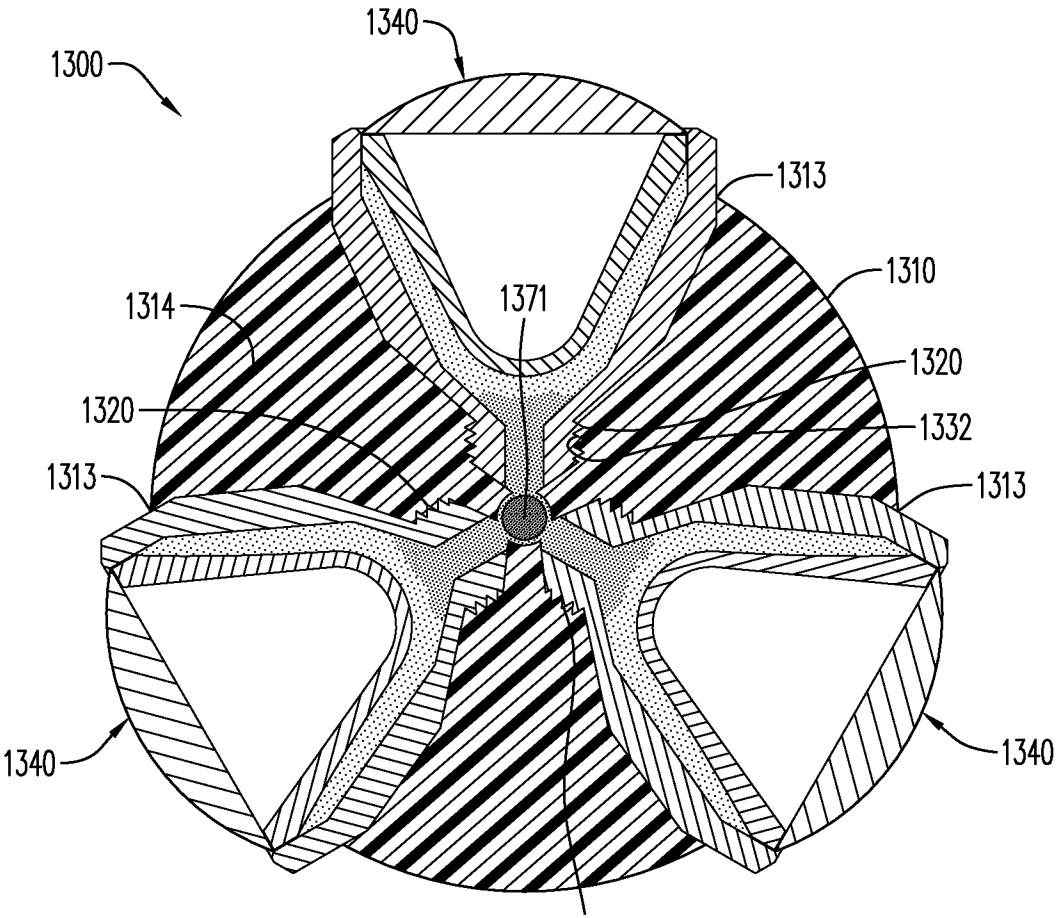
FIG. 13 is a lateral cross-sectional view of an untethered drone according to an exemplary embodiment.

With reference now to FIG. 13, an exemplary untethered drone 1300 according to some embodiments may include a threaded connection between a shaped charge 1340 and a shaped charge aperture 1313 in which the shaped charge 1340 is received. For example, FIG. 13 shows a lateral cross-sectional view taken along a radial plane of a body portion 1310 of the exemplary untethered drone 1300, similar to the lateral cross-sectional view shown in FIG. 12B. As shown in FIG. 13, the exemplary untethered drone 1300 includes three shaped charges 1340 arranged in the same radial plane and spaced apart by about a 120-degree phasing around the body portion 1310. The shaped charges 1340 are respectively received and retained in the shaped charge apertures 1313 at least in part within an interior 1314 of the body portion 1310. According to an aspect the shaped charge apertures 1313 include an internal thread 1320 for threadingly securing the shaped charge 1340 therein. The internal thread 1320 may be a continuous thread or interrupted threads that mate or engage with corresponding threads 1332 formed on a back wall protrusion 1330 of the shaped charge 1340. Other aspects of a configuration of a shaped charge for use with an untethered drone as described throughout this disclosure are not limited by this disclosure and may include a shaped charge having any configuration as is well-known and/or would be understood in the art and consistent with this disclosure. For example, a shaped charge configuration in which a shaped charge casing houses one or more explosive loads and a liner atop the explosive loads for containing the explosive load(s) within the shaped charge and forming a perforating jet upon detonating the shaped charge.

In the exemplary configuration shown in FIG. 13, a selective detonator 1371 (and/or optionally, a detonating cord) is positioned within the interior 1314 of the body portion 1310 and adjacent to the shaped charges 1340 such that the shaped charges 1340 extend radially from the selective detonator 1371. In an aspect, the selective detonator 1371 may directly initiate detonation of the shaped charges 1340 upon detonation of the selective detonator 1371. It is contemplated that at least one of the shaped charge apertures 1313 may be in open communication with a hollow portion of the interior 1314 of the body portion 1310 in which the selective detonator 1371 and/or the detonating cord is positioned.

The arrangement of shaped charges within a single radial plane as shown in FIGS. 12A-13 is not limited to the embodiments depicted in those figures, nor is the disclosure of such arrangements limiting. For example, any number of charges capable of fitting around a circumference of a body portion of an untethered drone according to this disclosure may be arranged within a single radial plane and respectively spaced apart at any desired phasing. In another non-limiting example, shaped charges in separate radial planes may be arranged in a staggered fashion such that the shaped charges overlap along a single radial plane. In addition, one or more of a selective detonator, detonating cord, and other internal components of an untethered drone may be included and configured as particular applications consistent with this disclosure dictate.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if, for example, they have structural elements that do not differ from the literal language of the claims, or if they include structural elements with insubstantial differences from the literal language of the claims.

What is claimed is:

1. A selective untethered drone string for downhole delivery of a wellbore tool, comprising:

a first untethered drone, wherein the first untethered drone includes a detonator, a control circuit programmed for controlling selective detonation of a plurality of detonators, and a conductive line configured for relaying an electrical signal from the control circuit along a length of the first untethered drone, wherein the detonator of the first untethered drone is in electrical communication with the control circuit; and, a second untethered drone connected to the first untethered drone, wherein the second untethered drone includes a detonator in electrical communication with the control circuit, wherein the detonator of the second untethered drone is in electrical communication with the conductive line either directly or through one or more electrical connectors, the control circuit is configured for transmitting a selective sequence signal to at least one of the detonator of the second untethered drone and the detonator of the first untethered drone, the electrical signal includes the selective sequence signal for the detonator of the second untethered drone, and each of the first untethered drone and the second untethered drone respectively includes a body portion, a head portion extending from the body portion, and a tail portion extending from the body portion in a direction opposite the head portion, wherein the head portion of the first untethered drone includes an integrated electrical and mechanical connecting assembly including an electrical pin contact, wherein the conductive line is in electrical communication with the electrical pin contact, and the control circuit is in electrical communication with the electrical pin contact via the conductive line, the tail portion of the second untethered drone includes a tail connecting portion, wherein the tail connecting portion of the second untethered drone includes an external contact point, wherein the detonator of the second untethered drone is in electrical communication with the external contact point, the second untethered drone is connected to the first untethered drone via the integrated electrical and mechanical connecting assembly, and the external contact point is electrically connected to the electrical pin contact, and the detonator of the second untethered drone is in electrical communication with the control circuit via the external contact point, the electrical pin contact, and the conductive line.

2. The selective untethered drone string of claim 1, further comprising a drone connector positioned between the first untethered drone and the second untethered drone and including an electrical connector, wherein the first untethered drone is connected to the drone connector at a downstream end of the first untethered drone, the conductive line is in electrical communication with the electrical connector of the drone connector, and the control circuit is in electrical communication with the electrical connector of the drone connector via the conductive line, the second untethered drone is connected to the drone connector at an upstream end of the second untethered drone, and the detonator of the second untethered drone is in electrical communication with the electrical connector of the drone connector, and the second untethered drone is connected to the first untethered drone via the drone connector, and the detonator of the second untethered drone is in electrical communication with the control circuit via the electrical connector of the drone connector and the conductive line.

3. The selective untethered drone string of claim 1, wherein the tail connecting portion of the second untethered drone is threadingly connected to the integrated electrical and mechanical connecting assembly of the first untethered drone.

4. The selective untethered drone string of claim 1, wherein a conductive detonating cord includes the conductive line.

5. The selective untethered drone string of claim 1, wherein the control circuit is programmed to transmit the respective selective sequence signals when the selective untethered drone string reaches a pre-determined condition including one or more of a pressure within the wellbore, a temperature within the wellbore, a horizontal orientation, an inclination angle, a depth within the wellbore, a distance travelled, a rotational speed, and a position within the wellbore.

6. The selective untethered drone string of claim 1, wherein the first untethered drone includes a control circuit connecting portion at an upstream end of the first untethered drone, wherein the control circuit connecting portion is configured for electrically connecting to a control unit at a surface of the wellbore before the selective untethered drone string is deployed into the wellbore and receiving at least one of a power supply and a programming instruction for the control circuit via the electrical connection to the control unit.

7. The selective untethered drone string of claim 1, wherein the first untethered drone includes a single power source for providing power to each of the first untethered drone and the second untethered drone.

8. The selective untethered drone string of claim 7, wherein the single power source is a battery or a capacitor.

9. The selective untethered drone string of claim 1, wherein each of the first untethered drone and the second untethered drone includes at least one shaped charge, and the first untethered drone and the second untethered drone are formed at least in part from a material that will substantially disintegrate upon detonating their respective shaped charge.

10. An untethered drone string, comprising:

a first untethered drone comprising a conductive line configured for relaying an electrical signal from the control circuit along a length of the first untethered drone; and a second untethered drone connected to the first tethered drone, the first untethered drone and the second untethered drone respectively including a body portion;

a head portion extending from the body portion;

a tail portion extending from the body portion in a direction opposite the head portion;

a detonator and optionally, a detonating cord coupled to the detonator; and a plurality of shaped charges received in shaped charge apertures in the body portion, wherein the shaped charge apertures are respectively positioned adjacent to at least one of the detonator and the detonating cord within an interior of the body portion, wherein the head portion of the first untethered drone includes an integrated electrical and mechanical connecting assembly including an electrical pin contact, wherein the conductive line is in electrical communication with the electrical pin contact, the tail portion of the second untethered drone includes a tail connecting portion, wherein the tail connecting portion of the second untethered drone includes an external contact point, wherein the detonator of the second untethered drone is in electrical communication with the conductive line via the external contact point, the second untethered drone is connected to the first untethered drone via the integrated electrical and mechanical connecting assembly, and the external contact point is electrically connected to the electrical pin contact, the first untethered drone includes a control circuit programmed for controlling selective detonation of a plurality of detonators, and the detonator of the first untethered drone is in electrical communication with the control circuit, and the control circuit is in electrical communication with the electrical pin contact via the conductive line, the detonator of the second untethered drone is in electrical communication with the control circuit via the external contact point, the electrical pin contact, and the conductive line, and the control circuit is configured for transmitting a sequence signal to the detonator of each of the second untethered drone and the first untethered drone, the electrical signal includes the sequence signal for the detonator of the second untethered drone, and the sequence signal for the detonator of the second untethered drone is different than the sequence signal for the detonator of the first untethered drone.

11. The untethered drone string of claim 10, wherein each shaped charge aperture includes an internal thread and each shaped charge includes a back wall protrusion comprising a plurality of external threads threadingly connected to the internal threads of the shaped charge aperture for securing the shaped charge in the shaped charge aperture.

12. The untethered drone string of claim 10, wherein at least one shaped charge aperture is in open communication with a hollow portion of the interior of the body portion in which at least one of the detonator and the detonating cord is positioned.

13. The untethered drone string of claim 10, wherein the control circuit is programmed to transmit the respective sequence signals when the untethered drone string reaches a pre-determined condition including one or more of a pressure within the wellbore, a temperature within the wellbore, a horizontal orientation, an inclination angle, a depth within the wellbore, a distance travelled, a rotational speed, and a position within the wellbore.

14. A method for downhole delivery of a wellbore tool using a selective untethered drone string, comprising:

programming a control circuit of the selective untethered drone string at a surface of a wellbore before the selective untethered drone string is deployed into the wellbore, wherein programming the control circuit includes teaching the control circuit a selective sequence signal for each of a plurality of detonators, wherein the selective untethered drone string includes a first untethered drone including a selective detonator and the control circuit, wherein the selective detonator of the first untethered drone is in electrical communication with the control circuit, and the first untethered drone further includes a shaped charge and a control circuit connecting portion at an upstream end of the first untethered drone, a second untethered drone connected to the first untethered drone, wherein the second untethered drone includes a selective detonator in electrical communication with the control circuit, and a shaped charge, wherein the step of programming the control circuit includes electrically connecting the control circuit connecting portion of the first untethered drone to a control unit at the surface of the wellbore and receiving programming instructions for the control circuit via the electrical connection to the control unit;

deploying the selective untethered drone string into the wellbore;

transmitting a first selective sequence signal from the control circuit to the selective detonator of the second untethered drone and detonating the selective detonator and the shaped charge of the second untethered drone when the selective untethered drone string reaches a first pre-determined condition; and transmitting a second selective sequence signal from the control circuit to the selective detonator of the first untethered drone and detonating the selective detonator and the shaped charge of the first untethered drone when the selective untethered drone string reaches the first pre-determined condition or a second pre-determined condition.

15. The method of claim 14, wherein the step of transmitting the first selective sequence signal from the control circuit to the selective detonator of the second untethered drone is performed before the step of transmitting the second selective sequence signal from the control circuit to the selective detonator of the first untethered drone.

16. The method of claim 14, wherein one or both of the first pre-determined condition and the second pre-determined condition includes at least one of a pressure within the wellbore, a temperature within the wellbore, a horizontal orientation, an inclination angle, a depth within the wellbore, a distance travelled, a rotational speed, and a position within the wellbore.

* * * * *